US009121672B2

(12) United States Patent
Tubb

(10) Patent No.: US 9,121,672 B2
(45) Date of Patent: Sep. 1, 2015

(54) BALLISTIC EFFECT COMPENSATING RETICLE AND AIM COMPENSATION METHOD WITH SLOPED MIL AND MOA WIND DOT LINES

(71) Applicant: G. David Tubb, Canadian, TX (US)

(72) Inventor: G. David Tubb, Canadian, TX (US)

( * ) Notice: Subject to any disclaimer, the term of this patent is extended or adjusted under 35 U.S.C. 154(b) by 0 days.

(21) Appl. No.: 14/157,319

(22) Filed: Jan. 16, 2014

(65) Prior Publication Data

US 2014/0305025 A1 Oct. 16, 2014

Related U.S. Application Data

(60) Provisional application No. 61/753,301, filed on Jan. 16, 2013.

(51) Int. Cl.
*F41G 1/38* (2006.01)
*F41G 1/473* (2006.01)

(52) U.S. Cl.
CPC . *F41G 1/38* (2013.01); *F41G 1/473* (2013.01)

(58) Field of Classification Search
CPC ..... F41G 1/04; F41G 1/38; F41G 1/473; G02B 23/14; G02B 27/32
USPC ..... 42/122, 123, 130, 131, 141; 33/297, 33/298
See application file for complete search history.

(56) References Cited

U.S. PATENT DOCUMENTS

| | | | |
|---|---|---|---|
| 197,397 | A | 11/1877 | O'Neil |
| 252,240 | A | 1/1882 | Morris |
| D14,355 | S | 10/1883 | Dressel |
| 912,050 | A | 2/1909 | Wanee |
| 1,006,699 | A | 10/1911 | Straubel |
| 1,107,163 | A | 8/1914 | Grauheding |

(Continued)

FOREIGN PATENT DOCUMENTS

| | | |
|---|---|---|
| DE | 3401855 | 7/1985 |
| DE | 3834924 | 4/1990 |

(Continued)

OTHER PUBLICATIONS

Aerodynamic Jump Caused by the Wind, http://bisonballistics.com/system/uploaded_files/9/original/aerodynamic_jump_target.png, Bison Ballistics, printed Dec. 30, 2011.

(Continued)

*Primary Examiner* — Gabriel Klein
(74) *Attorney, Agent, or Firm* — J. A. McKinney & Associates, LLC.; J. Andrew McKinney, Jr.

(57) ABSTRACT

A dynamic ballistic effect compensating reticle and an aim compensation method for use in rifle sights or projectile weapon aiming systems includes a multiple point elevation and windage aim point field including a primary aiming mark indicating a primary aiming point adapted to be sighted-in at a first selected range (e.g., 200 yds) and a plurality sloped secondary aiming point arrays beneath the primary aiming mark. The method for compensating for a projectile's ballistic behavior while developing a field expedient firing solution permits the shooter to express the field expedient firing solution in units of distance, (e.g., yards or meters, when describing or estimating range and nominal air density ballistic characteristics), and angular offset of azimuth (e.g., MILS or MOA) for crosswind jump corrected windage hold points.

15 Claims, 27 Drawing Sheets

(56) References Cited

U.S. PATENT DOCUMENTS

| | | | |
|---|---|---|---|
| 1,127,230 | A | 2/1915 | Grauheding |
| 1,190,121 | A | 7/1916 | Critchett |
| 1,406,620 | A | 2/1922 | Dear |
| 1,425,321 | A | 8/1922 | Etherington |
| 1,428,389 | A | 9/1922 | Miller |
| 1,540,772 | A | 6/1925 | Gibbs |
| 1,851,189 | A | 3/1932 | King |
| 2,090,930 | A | 8/1937 | Schaffner |
| 2,094,623 | A | 10/1937 | Stokey |
| 2,150,629 | A | 3/1939 | Mossberg |
| 2,154,454 | A | 4/1939 | Joyce |
| 2,171,571 | A | 9/1939 | Karnes |
| 2,417,451 | A | 3/1947 | Schaffner |
| 2,420,273 | A | 5/1947 | West |
| 2,450,712 | A | 10/1948 | Brown |
| 2,464,521 | A | 3/1949 | McCall |
| 2,486,940 | A | 11/1949 | Garber et al. |
| 2,615,252 | A | 10/1952 | Wing |
| 2,806,287 | A | 9/1957 | Sullivan |
| 2,807,981 | A | 10/1957 | Barnes |
| 2,823,457 | A | 2/1958 | Mihalyi |
| 2,891,445 | A | 6/1959 | Staubach |
| 2,949,816 | A | 8/1960 | Weaver |
| 2,955,512 | A | 10/1960 | Kollmorgen et al. |
| 3,058,391 | A | 10/1962 | Leupold |
| 3,190,003 | A | 6/1965 | O'Brien |
| 3,229,370 | A | 1/1966 | Plisk et al. |
| 3,297,389 | A | 1/1967 | Gibson |
| 3,313,026 | A | 4/1967 | Akin, Jr. |
| 3,381,380 | A | 5/1968 | Thomas |
| D211,467 | S | 6/1968 | Wilbur |
| 3,392,450 | A | 7/1968 | Herter et al. |
| 3,410,644 | A | 11/1968 | McLendon |
| 3,431,652 | A | 3/1969 | Leatherwood |
| 3,470,616 | A | 10/1969 | Thompson |
| 3,492,733 | A | 2/1970 | Leatherwood |
| 3,540,256 | A | 11/1970 | Thompson |
| 3,575,085 | A | 4/1971 | McAdam, Jr. |
| 3,682,552 | A | 8/1972 | Hartman |
| 3,684,376 | A | 8/1972 | Lessard |
| 3,743,818 | A | 7/1973 | Marasco et al. |
| 3,744,133 | A | 7/1973 | Fukushima et al. |
| 3,744,143 | A | 7/1973 | Kilpatrick |
| 3,749,494 | A | 7/1973 | Hodges |
| 3,777,404 | A | 12/1973 | Oreck |
| 3,782,822 | A | 1/1974 | Spence |
| 3,798,796 | A | 3/1974 | Stauff et al. |
| 3,826,012 | A | 7/1974 | Pachmayr |
| 3,876,304 | A | 4/1975 | Novak |
| 3,902,251 | A | 9/1975 | Ross |
| 3,948,587 | A | 4/1976 | Rubbert |
| 4,014,482 | A | 3/1977 | Esker et al. |
| 4,102,053 | A | 7/1978 | Colwell |
| 4,132,000 | A | 1/1979 | Dulude |
| 4,244,586 | A | 1/1981 | Gorrow |
| 4,247,161 | A | 1/1981 | Unertl, Jr. |
| 4,248,496 | A | 2/1981 | Akin, Jr. et al. |
| 4,255,013 | A | 3/1981 | Allen |
| 4,263,719 | A | 4/1981 | Murdoch |
| 4,285,137 | A | 8/1981 | Jennie |
| 4,389,791 | A | 6/1983 | Ackerman |
| 4,395,096 | A | 7/1983 | Gibson |
| 4,403,421 | A | 9/1983 | Shepherd |
| 4,408,842 | A | 10/1983 | Gibson |
| 4,458,436 | A | 7/1984 | Bohl |
| 4,497,548 | A | 2/1985 | Burris |
| 4,531,052 | A | 7/1985 | Moore |
| 4,561,204 | A | 12/1985 | Binion |
| 4,584,776 | A | 4/1986 | Shepherd |
| 4,616,421 | A | 10/1986 | Forsen |
| 4,618,221 | A | 10/1986 | Thomas |
| 4,627,171 | A | 12/1986 | Dudney |
| D288,465 | S | 2/1987 | Darnall et al. |
| 4,671,165 | A | 6/1987 | Heidmann et al. |
| 4,695,161 | A | 9/1987 | Reed |
| 4,777,352 | A | 10/1988 | Moore |
| 4,787,739 | A | 11/1988 | Gregory |
| 4,806,007 | A | 2/1989 | Bindon |
| H613 | H | 4/1989 | Stello et al. |
| 4,833,786 | A | 5/1989 | Shores, Sr. |
| D306,173 | S | 2/1990 | Reese |
| 4,912,853 | A | 4/1990 | McDonnell et al. |
| 4,949,089 | A | 8/1990 | Ruszkowski, Jr. |
| 4,957,357 | A | 9/1990 | Barns et al. |
| 4,965,439 | A | 10/1990 | Moore |
| 5,026,158 | A | 6/1991 | Golubic |
| 5,157,839 | A | 10/1992 | Beutler |
| 5,171,933 | A | 12/1992 | Eldering |
| 5,181,323 | A | 1/1993 | Cooper |
| 5,181,719 | A | 1/1993 | Cleveland, III |
| 5,194,908 | A | 3/1993 | Lougheed et al. |
| 5,223,560 | A | 6/1993 | Cipolli et al. |
| 5,223,650 | A | 6/1993 | Finn |
| 5,375,072 | A | 12/1994 | Cohen |
| 5,415,415 | A | 5/1995 | Mujic |
| 5,454,168 | A | 10/1995 | Langner |
| 5,469,414 | A | 11/1995 | Okamura |
| 5,491,546 | A | 2/1996 | Wascher et al. |
| 5,616,903 | A | 4/1997 | Springer |
| 5,631,654 | A | 5/1997 | Karr |
| 5,657,571 | A | 8/1997 | Peterson |
| 5,672,840 | A | 9/1997 | Sage et al. |
| 5,781,505 | A | 7/1998 | Rowland |
| D397,704 | S | 9/1998 | Reese |
| D403,686 | S | 1/1999 | Reese |
| 5,860,655 | A | 1/1999 | Starrett |
| 5,887,352 | A | 3/1999 | Kim |
| 5,920,995 | A | 7/1999 | Sammut |
| 5,960,576 | A | 10/1999 | Robinson |
| 6,025,908 | A | 2/2000 | Houde-Walter |
| 6,032,374 | A | 3/2000 | Sammut |
| 6,041,508 | A | 3/2000 | David |
| 6,049,987 | A | 4/2000 | Robell |
| 6,058,921 | A | 5/2000 | Lawrence et al. |
| 6,064,196 | A | 5/2000 | Oberlin et al. |
| 6,213,470 | B1 | 4/2001 | Miller |
| 6,252,706 | B1 | 6/2001 | Kaladgew |
| 6,269,581 | B1 | 8/2001 | Groh |
| 6,357,158 | B1 | 3/2002 | Smith, III |
| D455,811 | S | 4/2002 | Fedio, Jr. |
| D456,057 | S | 4/2002 | Smith, III |
| 6,453,595 | B1 | 9/2002 | Sammut |
| 6,516,551 | B2 | 2/2003 | Gaber |
| 6,516,699 | B2 | 2/2003 | Sammut et al. |
| 6,568,092 | B1 | 5/2003 | Brien |
| D475,758 | S | 6/2003 | Ishikawa |
| 6,574,900 | B1 | 6/2003 | Malley |
| 6,591,537 | B2 | 7/2003 | Smith |
| 6,681,512 | B2 | 1/2004 | Sammut |
| 6,729,062 | B2 | 5/2004 | Thomas et al. |
| 6,772,550 | B1 | 8/2004 | Leatherwood |
| 6,813,025 | B2 | 11/2004 | Edwards |
| 6,862,832 | B2 | 3/2005 | Barrett |
| 6,886,287 | B1 | 5/2005 | Bell et al. |
| D506,520 | S | 6/2005 | Timm et al. |
| D517,153 | S | 3/2006 | Timm et al. |
| D536,762 | S | 2/2007 | Timm et al. |
| 7,171,776 | B2 | 2/2007 | Staley, III |
| 7,185,455 | B2 | 3/2007 | Zaderey |
| 7,325,353 | B2 | 2/2008 | Cole et al. |
| 7,603,804 | B2 | 10/2009 | Zaderey et al. |
| 7,712,225 | B2 | 5/2010 | Sammut |
| 7,748,155 | B2 | 7/2010 | Cole |
| 7,832,137 | B2 | 11/2010 | Sammut et al. |
| 7,937,878 | B2 | 5/2011 | Sammut et al. |
| 8,353,454 | B2 | 1/2013 | Sammut et al. |
| D684,653 | S | 6/2013 | Smith et al. |
| 8,701,330 | B2 * | 4/2014 | Tubb ..... 42/122 |
| 8,893,423 | B2 * | 11/2014 | Tubb ..... 42/122 |
| 2002/0124452 | A1 | 9/2002 | Sammut |
| 2002/0129535 | A1 | 9/2002 | Osborn, II |
| 2004/0016168 | A1 | 1/2004 | Thomas et al. |
| 2004/0020099 | A1 | 2/2004 | Osborn, II |
| 2004/0088898 | A1 | 5/2004 | Barrett |

(56) References Cited

U.S. PATENT DOCUMENTS

| | | | | |
|---|---|---|---|---|
| 2005/0005495 | A1 | 1/2005 | Smith | |
| 2005/0021282 | A1 | 1/2005 | Sammut et al. | |
| 2005/0229468 | A1 | 10/2005 | Zaderey et al. | |
| 2005/0257414 | A1 | 11/2005 | Zaderey et al. | |
| 2006/0260171 | A1 | 11/2006 | Cole et al. | |
| 2007/0044364 | A1 | 3/2007 | Sammut et al. | |
| 2008/0061509 | A1 | 3/2008 | Potterfield | |
| 2008/0098640 | A1 | 5/2008 | Sammut et al. | |
| 2009/0199451 | A1 | 8/2009 | Zaderey et al. | |
| 2010/0038854 | A1 | 2/2010 | Mraz | |
| 2014/0373424 | A1 * | 12/2014 | Silvers et al. | 42/122 |

FOREIGN PATENT DOCUMENTS

| | | |
|---|---|---|
| DE | 0008101 | 9/2000 |
| GB | 2094950 | 9/1982 |
| GB | 2294133 | 4/1996 |
| JP | 55-036823 | 3/1980 |
| WO | 9601404 | 1/1996 |
| WO | 9737193 | 10/1997 |
| WO | 02103274 | 12/2002 |

OTHER PUBLICATIONS

Chung, Gregory K. W. K., Nagashima, Sam O., Delacruz, Girlie C., Lee, John J., Wainess, Richard and Baker, Eva L., Review of Rifle Marksmanship Training Research, Cresst Report 783, The National Center for Research on Evaluation, Standards, and Student Testing, Jan. 2011.

Johnson, Richard F., Statistical Measures of Marksmanship, USARIEM Technical Note TN-01/2, U.S. Army Research Institute of Environmental Medicine, Feb. 2001.

Military Handbook: Range Facilities and Miscellaneous Training Facilities Other than Buildings, http://www.everyspec.com, MIL-HDBK-1027/3A, Jan. 31, 1989.

Military Specification: Propellants for Small Arms Ammunition, http://www.everyspec.com, MIL-P-3984J Amendment 3, Jun. 12, 2000.

Military Specification: Rifle, 7.62MM, Sniper w/Day Optical Sight and Carrying Cases, M24, http://www.everyspec.com, MIL-R-71126 (AR), Sep. 24, 1992.

Northwinds Flags, RFC-USBR Windrose, https://sites.google.com/a/wildblue.net/northwind-flags/home/Wind-Rose-2.jpg, printed Dec. 30, 2011.

Performance Specification: Rifle, 7.62MM; Semi-Automatic Sniper System (SASS)—M110, MIL-PRF-32316 (W/ Amendment 1), Oct. 5, 2009.

Rifle Marksmanship M16A1, M16A2/3, M16A4, and M4 Carbine, C 4, FM 3-22.9, Department of the Army, Sep. 13, 2006.

Von Wahlde, Raymond & Metz, Dennis, Sniper Weapon Fire Control Error Budget Analysis, US Army ARL-TR-2065, Aug. 1999—arl.army.mil.

"http://www.aircav.com/cobra/ballistic.html", printed Dec. 30, 2011, discussion of ballistics, interior, exterior, aerial, terminal and dispersion.

"http://www.hnsa.org/doc/firecontrol/partc.htm", printed Dec. 30, 2011, discussion of the projectile in flight-exterior ballistics.

Jonathan M. Weaver, Jr., LTC, USA Ret., Infantry, System Error Budgets, Target Distributions and Hitting Performance Estimates for General-Purpose Rifles and Sniper Rifles of 7.62x51mm and Larger Calibers, AD-A228 398, TR-461, AMSAA, May 1990.

Kent, R.H. and E.J. McShane, An Elementary Treatment of the Motion of a Spinning Projectile About it's Center of Gravity, Aberdeen Proving Grounds ("APG"), MD, BRL Memorandum Report No. 85, Apr. 1944.

Leupold® America's Optics Authority® : Ballistics Aiming System®.

Leupold® Tactical Optics: Using the Tactical Reticle System—Mil/Dot/TMR®/SPR®/CM-R$^{2}$™ Usage Instructions.

Leupold®: Ballistics Reticle Supplement.

US Army FM-23-10, Sniper Training, United States Army Infantry School ATSH-IN-S3, Fort Benning, GA 31905-5596, Aug. 1994.

USMC MCWP 3-15.3 (formerly FMFM 1-3B), Sniping, PCN 143 000118 00, Doctrine Division (C42) US Marine Corps Combat Development Command, 2 Broadway Street Suite 210 Quantico, VA 22134-5021, May 2004.

* cited by examiner

| L-WIND | | R-WIND | | Aero Jump | | Left ↑ | 6mph/.25 | 12mph/.5 | 18mph/.75 | 24mph/1 | 30mph/1.25 | 36mph/1.5 | Right↓ |
|---|---|---|---|---|---|---|---|---|---|---|---|---|---|
| 10X-W | MPH/MIL | MPH/MIL | 10X-W | YDS/SD | 2K | SL | 2K | 4K | 6K | 8K | 10K | 12K | 14K |
| 1.1 | 30.9 | 26.9 | 1.3 | 200 | 0.9 | 0.9 | 0.9 | 0.9 | 0.9 | 0.9 | 0.8 | 0.8 | 0.8 |
| 1.4 | 24.9 | 21.2 | 1.6 | 50 | 1.8 | 1.8 | 1.8 | 1.7 | 1.7 | 1.7 | 1.7 | 1.7 | 1.7 |
| 1.8 | 18.8 | 16.4 | 2.1 | 300 | 2.9 | 2.6 | 2.6 | 2.8 | 2.7 | 2.7 | 2.6 | 2.6 | 2.8 |
| 2.1 | 16.1 | 14.1 | 2.4 | 50 | 4.0 | 3.9 | 3.9 | 3.8 | 3.7 | 3.7 | 3.6 | 3.6 | 3.5 |
| 2.4 | 14.1 | 12.3 | 2.8 | 400/1L | 5.2 | 5.1 | 5.0 | 4.9 | 4.9 | 4.8 | 4.7 | 4.7 | 4.6 |
| 2.8 | 12.1 | 10.5 | 3.3 | 50 | 6.5 | 6.4 | 6.3 | 6.2 | 6.1 | 6.0 | 5.9 | 5.8 | 5.7 |
| 3.2 | 10.9 | 9.5 | 3.6 | 500/1L | 7.9 | 7.7 | 7.6 | 7.4 | 7.3 | 7.1 | 7.0 | 6.9 | 6.7 |
| 3.7 | 9.3 | 8.1 | 4.2 | 50 | 9.4 | 9.1 | 8.9 | 8.7 | 8.5 | 8.4 | 8.2 | 8.0 | 7.9 |
| 4.2 | 8.3 | 7.3 | 4.7 | 600/2L | 10.9 | 10.5 | 10.3 | 10.1 | 9.9 | 9.7 | 9.5 | 9.3 | 9.1 |
| 4.6 | 7.5 | 6.6 | 5.2 | 50 | 12.6 | 12.1 | 11.7 | 11.5 | 11.3 | 11.0 | 10.8 | 10.6 | 10.4 |
| 5.1 | 6.8 | 6.0 | 5.8 | 700/2L | 14.9 | 13.7 | 13.3 | 13.0 | 12.8 | 12.5 | 12.3 | 12.0 | 11.8 |
| 5.7 | 6.1 | 5.3 | 6.4 | 50 | 16.2 | 15.6 | 15.1 | 14.6 | 14.3 | 14.1 | 13.8 | 13.5 | 13.2 |
| 6.1 | 5.6 | 4.9 | 7.0 | 800/3L | 18.1 | 17.4 | 16.7 | 16.2 | 15.9 | 15.5 | 15.2 | 14.9 | 14.6 |
| 6.7 | 5.1 | 4.5 | 7.6 | 50 | 20.2 | 19.3 | 18.5 | 18.0 | 17.4 | 17.1 | 16.7 | 16.4 | 16.1 |
| 7.3 | 4.7 | 4.2 | 8.3 | 900/3L | 22.4 | 21.4 | 20.5 | 19.9 | 19.3 | 18.7 | 18.4 | 18.0 | 17.6 |
| 7.9 | 4.4 | 3.8 | 8.9 | 50 | 24.7 | 23.5 | 22.5 | 21.9 | 21.2 | 20.6 | 20.1 | 19.7 | 19.4 |
| 8.5 | 4.1 | 3.6 | 9.6 | 1000/4L | 27.1 | 25.7 | 24.7 | 24.0 | 23.3 | 22.6 | 21.9 | 21.3 | 20.6 |
| 9.2 | 3.8 | 3.3 | 10.4 | 50 | 29.7 | 28.2 | 27.1 | 26.0 | 25.2 | 24.5 | 23.7 | 23.0 | 22.3 |
| 9.9 | 3.5 | 3.1 | 11.2 | 1100/4L | 32.5 | 30.6 | 29.3 | 28.8 | 27.3 | 26.4 | 25.6 | 24.8 | 24.1 |

| L-WIND | | R-WIND | | Aero Jump | | Left ↑ | 6mph/.25 | 12mph/.5 | 18mph/.75 | 24mph/1 | 30mph/1.25 | 36mph/1.5 | Right↓ |
|---|---|---|---|---|---|---|---|---|---|---|---|---|---|
| 10X-W | MPH/MIL | MPH/MIL | 10X-W | YDS/SD | 2K | SL | 2K | 4K | 6K | 8K | 10K | 12K | 14K |
| 9.9 | 3.5 | 3.1 | 11.2 | 1100/4L | 32.5 | 30.6 | 29.3 | 28.2 | 27.2 | 26.2 | 25.4 | 24.7 | 23.9 |
| 10.5 | 3.3 | 2.9 | 11.9 | 50/5L | 35.4 | 33.3 | 31.6 | 30.3 | 29.3 | 28.3 | 27.4 | 26.6 | 25.8 |
| 11.2 | 3.1 | 2.7 | 12.7 | 200/5L | 38.5 | 36.0 | 34.2 | 32.8 | 31.7 | 30.6 | 29.5 | 28.6 | 27.8 |
| 12.0 | 2.9 | 2.5 | 13.5 | 50/7L | 41.8 | 38.9 | 36.9 | 35.5 | 34.0 | 32.7 | 31.5 | 30.6 | 29.7 |
| 12.8 | 2.7 | 2.4 | 14.5 | 300/8L | 45.3 | 42.1 | 40.0 | 38.0 | 36.5 | 35.0 | 33.8 | 32.6 | 31.5 |
| 13.6 | 2.5 | 2.2 | 15.3 | 50/9L | 49.0 | 45.3 | 43.1 | 40.9 | 38.9 | 37.3 | 35.8 | 34.6 | 33.4 |
| 14.5 | 2.4 | 2.1 | 16.3 | 400/10L | 52.9 | 48.7 | 46.0 | 43.7 | 41.5 | 39.8 | 38.3 | 36.9 | 35.6 |
| 15.3 | 2.2 | 2.0 | 17.2 | 50/11L | 57.0 | 52.4 | 49.6 | 46.8 | 44.5 | 42.5 | 40.8 | 39.2 | 37.8 |
| 16.1 | 2.1 | 1.9 | 18.1 | 500/12L | 61.4 | 56.2 | 52.8 | 49.9 | 47.4 | 45.3 | 43.2 | 41.5 | 40.1 |
| 16.8 | 2.0 | 1.8 | 19.0 | 50/13L | 65.9 | 60.3 | 56.7 | 53.6 | 50.6 | 48.1 | 45.9 | 43.9 | 42.1 |
| 17.7 | 1.9 | 1.7 | 19.9 | 600/14L | 70.7 | 64.5 | 60.6 | 56.9 | 53.7 | 51.0 | 48.7 | 46.5 | 44.7 |
| 18.6 | 1.9 | 1.7 | 20.8 | 50/15L | 75.7 | 68.9 | 64.6 | 60.7 | 57.2 | 54.2 | 51.5 | 49.1 | 47.1 |
| 19.3 | 1.8 | 1.6 | 21.7 | 700/16L | 81.0 | 73.5 | 68.7 | 64.6 | 60.9 | 57.5 | 54.5 | 51.9 | 49.7 |
| 20.2 | 1.7 | 1.5 | 22.6 | 50/17L | 86.4 | 78.4 | 73.3 | 68.7 | 64.6 | 60.9 | 57.7 | 54.8 | 52.3 |
| 21.1 | 1.6 | 1.5 | 23.6 | 800/18L | 92.1 | 83.4 | 77.7 | 72.9 | 68.3 | 64.4 | 60.8 | 57.8 | 55.2 |
| 21.9 | 1.6 | 1.4 | 24.6 | 50/19L | 98.0 | 88.7 | 82.7 | 77.3 | 72.5 | 68.1 | 64.2 | 60.7 | 57.8 |
| 22.7 | 1.5 | 1.4 | 25.4 | 900/20L | 104.2 | 94.0 | 87.7 | 82.0 | 76.7 | 72.1 | 67.9 | 64.0 | 60.8 |
| 23.5 | 1.5 | 1.3 | 26.3 | 50/21L | 110.5 | 99.7 | 92.7 | 86.7 | 81.1 | 76.0 | 71.5 | 67.3 | 64.0 |
| 24.4 | 1.4 | 1.3 | 27.3 | 2000/22L | 117.1 | 98.3 | 98.3 | 91.7 | 85.5 | 80.1 | 75.3 | 70.8 | 66.9 |

270

FIG. 6A

FIG. 6B

M118LR

John Doe

175 GR 308 CAL@2550

CJ=2.5moa/5 mph XW

| | | CJ↑ | .5moa | CJ↓ | | | | CJ↑ | .5moa | CJ↓ | | | | | CJ↑ | .5moa | CJ↓ | | | | | CJ↑ | .5moa | CJ↓ | | |
|---|---|---|---|---|---|---|---|---|---|---|---|---|---|---|---|---|---|---|---|---|---|---|---|---|---|---|
| 14K | 13K | 10→ | 12K | ←10 | 11K | 10K | 9K | 10→ | 8K | ←10 | 7K | 6K | DA | | 5K | 10→ | 4K | ←10 | 3K | 2K | 1K | 10→ | SL | ←10 | -1K | -2K |
| 50 | 51 | mph | 53 | mph | 55 | 56 | 58 | mph | 60 | mph | 62 | 64 | Du | | 66 | mph | 68 | mph | 70 | 72 | 74 | mph | 76 | mph | 78 | 81 |
| 1.5 | 1.6 | 1.0 | 1.6 | 1.2 | 1.6 | 1.6 | 1.7 | 1.2 | 1.7 | 1.4 | 1.7 | 1.7 | 200 | YD | 1.7 | 1.3 | 1.7 | 1.5 | 1.7 | 1.7 | 1.7 | 1.5 | 1.8 | 1.7 | 1.8 | 1.8 |
| 2.8 | 2.9 | 1.3 | 2.9 | 1.5 | 2.9 | 2.9 | 2.9 | 1.5 | 2.9 | 1.7 | 3.0 | 3.0 | 50 | | 3.0 | 1.7 | 3.0 | 2.0 | 3.0 | 3.1 | 3.1 | 1.9 | 3.1 | 2.2 | 3.1 | 3.2 |
| 4.2 | 4.2 | 1.6 | 4.3 | 1.9 | 4.3 | 4.3 | 4.3 | 1.8 | 4.4 | 2.1 | 4.4 | 4.4 | 300 | /SD | 4.5 | 2.1 | 4.5 | 2.4 | 4.5 | 4.6 | 4.6 | 2.3 | 4.6 | 2.7 | 4.7 | 4.7 |
| 5.7 | 5.7 | 1.9 | 5.7 | 2.2 | 5.8 | 5.8 | 5.9 | 2.1 | 5.9 | 2.4 | 5.9 | 6.0 | 50 | | 6.0 | 2.4 | 6.1 | 2.8 | 6.1 | 6.2 | 6.2 | 2.8 | 6.3 | 3.2 | 6.3 | 6.4 |
| 7.2 | 7.3 | 2.2 | 7.3 | 2.6 | 7.4 | 7.4 | 7.5 | 2.5 | 7.5 | 2.9 | 7.6 | 7.6 | 400 | /1L | 7.7 | 2.8 | 7.8 | 3.2 | 7.8 | 7.9 | 8.0 | 3.3 | 8.1 | 3.8 | 8.2 | 8.2 |
| 8.8 | 8.9 | 2.5 | 9.0 | 2.9 | 9.0 | 9.1 | 9.2 | 2.8 | 9.2 | 3.2 | 9.3 | 9.4 | 50 | | 9.5 | 3.3 | 9.6 | 3.8 | 9.7 | 9.8 | 9.9 | 3.7 | 10.0 | 4.3 | 10.1 | 10.2 |
| 10.5 | 10.6 | 2.8 | 10.7 | 3.2 | 10.8 | 10.9 | 11.0 | 3.2 | 11.1 | 3.7 | 11.2 | 11.3 | 500 | /1L | 11.4 | 3.7 | 11.5 | 4.3 | 11.6 | 11.7 | 11.9 | 4.2 | 12.0 | 4.9 | 12.2 | 12.3 |
| 12.3 | 12.4 | 3.2 | 12.5 | 3.7 | 12.6 | 12.7 | 12.8 | 3.7 | 13.0 | 4.3 | 13.1 | 13.2 | 50 | | 13.4 | 4.3 | 13.5 | 4.9 | 13.7 | 13.8 | 14.0 | 4.9 | 14.2 | 5.6 | 14.4 | 14.5 |
| 14.1 | 14.2 | 3.6 | 14.4 | 4.1 | 14.5 | 14.6 | 14.8 | 4.1 | 15.0 | 4.7 | 15.1 | 15.3 | 600 | /2L | 15.5 | 4.8 | 15.7 | 5.5 | 15.9 | 16.1 | 16.3 | 5.5 | 16.5 | 6.4 | 16.7 | 17.0 |
| 16.0 | 16.2 | 3.9 | 16.3 | 4.5 | 16.5 | 16.7 | 16.9 | 4.5 | 17.1 | 5.2 | 17.3 | 17.5 | 50 | | 17.7 | 5.3 | 17.9 | 6.1 | 18.2 | 18.4 | 18.7 | 6.2 | 18.9 | 7.1 | 19.2 | 19.5 |
| 18.0 | 18.2 | 4.3 | 18.4 | 5.0 | 18.6 | 18.8 | 19.0 | 5.1 | 19.3 | 5.8 | 19.5 | 19.8 | 700 | /2L | 20.0 | 5.8 | 20.3 | 6.7 | 20.6 | 20.9 | 21.2 | 6.8 | 21.6 | 7.8 | 21.9 | 22.3 |
| 20.0 | 20.3 | 4.7 | 20.5 | 5.4 | 20.7 | 21.0 | 21.3 | 5.5 | 21.6 | 6.3 | 21.9 | 22.2 | 50 | | 22.5 | 6.4 | 22.8 | 7.3 | 23.2 | 23.6 | 23.9 | 7.4 | 24.3 | 8.5 | 24.8 | 25.2 |
| 22.2 | 22.4 | 5.1 | 22.7 | 5.9 | 23.0 | 23.3 | 23.6 | 6.0 | 24.0 | 6.9 | 24.3 | 24.7 | 800 | /3L | 25 | 7.0 | 25.5 | 8.1 | 25.9 | 26.4 | 26.8 | 8.2 | 27.3 | 9.4 | 27.8 | 28.4 |
| 24.4 | 24.7 | 5.6 | 25.0 | 6.4 | 25.4 | 25.8 | 26.1 | 6.5 | 26.5 | 7.5 | 26.9 | 27.4 | 50 | | 27.8 | 7.6 | 28.3 | 8.7 | 28.8 | 29.3 | 29.9 | 8.9 | 30.5 | 10.2 | 31.1 | 31.7 |
| 26.7 | 27.1 | 6.0 | 27.5 | 6.9 | 27.9 | 28.3 | 28.7 | 7.0 | 29.2 | 8.0 | 29.7 | 30.2 | 900 | /3L | 30.7 | 8.3 | 31.3 | 9.5 | 31.9 | 32.5 | 33.2 | 9.7 | 33.8 | 11.1 | 34.5 | 35.3 |
| 29.1 | 29.5 | 6.5 | 30.0 | 7.4 | 30.5 | 30.9 | 31.5 | 7.6 | 32.0 | 8.7 | 32.6 | 33.2 | 50 | | 33.8 | 8.9 | 34.4 | 10.2 | 35.1 | 35.9 | 36.6 | 10.4 | 37.4 | 11.9 | 38.2 | 39.1 |
| 31.6 | 32.1 | 6.9 | 32.6 | 8.0 | 33.2 | 33.7 | 34.3 | 8.1 | 34.9 | 9.3 | 35.6 | 36.3 | ### | /4L | 37.0 | 9.5 | 37.8 | 11.0 | 38.6 | 39.4 | 40.3 | 11.2 | 41.2 | 12.8 | 42.2 | 43.2 |
| 34.2 | 34.8 | 7.4 | 35.4 | 8.5 | 36.0 | 36.6 | 37.3 | 8.7 | 38.0 | 10.0 | 38.8 | 39.6 | 50 | | 40.4 | 10.2 | 41.3 | 11.8 | 42.2 | 43.2 | 44.2 | 12.0 | 45.2 | 13.8 | 46.4 | 47.5 |
| 36.9 | 37.6 | 7.9 | 38.3 | 9.0 | 39.0 | 39.7 | 40.5 | 9.3 | 41.3 | 10.7 | 42.2 | 43.1 | ### | /5L | 44.1 | 11.0 | 45.0 | 12.6 | 46.1 | 47.2 | 48.3 | 12.8 | 49.5 | 14.7 | 50.8 | 52.1 |

| | | | | |
|---|---|---|---|---|
| Du = Air Density = .0XX lb/ft$^3$ | DA = Density Altitude = X000 ft | CJ = Crosswind Jump | DWD = Dissimilar Wind Drift | XW = Cross Wind |
| SD = Spin Drift | Elev Zero = Du/DA +/- CJ | Wind = DWD +/- SD | Velocity Compensation {25 fps = 1K DA} add to DA for faster MV | |

271

Step One

The fence is bigger than the coyote so range the fence posts.

MIL the fence ... = approximately 1-3/4 MIL

Fence post = 4 ft. tall

1. Put bottom of post directly on next whole MIL line, in this case "1MIL line."
2. Put top of post into fractional measuring stadia.
3. Read fractional measurement plus whole measurement = 1-3/4 MIL

Step Two

600

Angle Firing Numbers SL Thru 12K DA [+/- 1-25yds to nearest #]

| ANGLE | 300 | 350 | 400 | 450 | 500 | 550 | 600 | 650 | 700 | 750 | 800 | 850 | 900 |
|---|---|---|---|---|---|---|---|---|---|---|---|---|---|
| 5 | 290 | 340 | 390 | 440 | 490 | 539 | 588 | 636 | 683 | 731 | 780 | 829 | 878 |
| 10 | 285 | 335 | 385 | 434 | 484 | 532 | 581 | 628 | 675 | 721 | 768 | 816 | 865 |
| 15 | 280 | 330 | 380 | 429 | 478 | 525 | 574 | 621 | 668 | 711 | 754 | 803 | 852 |
| 20 | 275 | 322 | 370 | 418 | 468 | 511 | 554 | 602 | 649 | 694 | 740 | 785 | 831 |
| 25 | 270 | 315 | 360 | 408 | 459 | 497 | 535 | 582 | 630 | 677 | 725 | 768 | 810 |
| 30 | 265 | 310 | 355 | 398 | 442 | 480 | 518 | 562 | 607 | 653 | 700 | 742 | 785 |
| 35 | 260 | 305 | 350 | 382 | 425 | 462 | 500 | 543 | 585 | 630 | 675 | 718 | 760 |
| 40 | 250 | 287 | 325 | 358 | 400 | 440 | 480 | 520 | 560 | 600 | 640 | 680 | 720 |

Use Current DA For Firing Solution Boxes Shaded in Black Require 10K DA or Higher

| ANGLE | 950 | 1000 | 1050 | 1100 | 1150 | 1200 | 1250 | 1300 | 1350 | 1400 | 1450 | 1500 |
|---|---|---|---|---|---|---|---|---|---|---|---|---|
| 5 | 927 | 977 | 1025 | 1075 | 1123 | 1172 | 1220 | 1271 | 1320 | 1370 | 1417 | 1468 |
| 10 | 915 | 965 | 1014 | 1064 | 1114 | 1163 | 1212 | 1260 | 1307 | 1358 | 1405 | 1456 |
| 15 | 899 | 950 | 1000 | 1050 | 1099 | 1148 | 1194 | 1240 | 1289 | 1338 | 1387 | 1436 |
| 20 | 879 | 928 | 978 | 1027 | 1073 | 1120 | 1164 | 1207 | 1256 | 1306 | 1347 | 1400 |
| 25 | 855 | 900 | 950 | 1000 | 1045 | 1090 | 1132 | 1176 | 1222 | 1270 | 1315 | 1360 |
| 30 | 830 | 875 | 918 | 960 | 1005 | 1050 | 1092 | 1135 | 1180 | 1225 | 1270 | 1317 |
| 35 | 805 | 850 | 885 | 920 | 965 | 1010 | 1055 | 1100 | 1135 | 1176 | 1225 | 1275 |
| 40 | 760 | 800 | 832 | 910.4 | 954 | 997.6 | 1039 | 1080 | 1119 | 1161 | 1207 | 1210 |

DTUBB

Superior Shooting Systems (806) 323-9486

DTR MILDOT RH

DTR MILDOT LH

DTR MOA RH

DTR MOA LH

BALLISTIC EFFECT COMPENSATING RETICLE AND AIM COMPENSATION METHOD WITH SLOPED MIL AND MOA WIND DOT LINES

PRIORITY CLAIM AND CROSS-REFERENCE TO RELATED APPLICATIONS

This application is related to commonly owned:

(1) U.S. provisional patent application No. 61/429,128, filed Jan. 1, 2011, entitled RETICLE AND AIM COMPENSATION METHOD, (2) U.S. provisional patent application No. 61/437,990, filed Jan. 31, 2011, (3) U.S. provisional patent application No. 61/490,916, filed May 27, 2011, (4) U.S. provisional patent application No. 61/553,161, filed Oct. 29, 2011, (5) U.S. provisional patent application No. 61/582,185, filed Dec. 30, 2011, (6) U.S. patent application Ser. No. 13/342,197, filed Jan. 2, 2012, and (7) U.S. patent application Ser. No. 13/482,679 filed May 28, 2012 and entitled DYNAMIC TARGETING SYSTEM WITH PROJECTILE-SPECIFIC AIMING INDICIA IN A RETICLE AND METHOD FOR ESTIMATING BALLISTIC EFFECTS OF CHANGING ENVIRONMENT AND AMMUNITION, the entire disclosures of which are incorporated herein by reference. In addition, this application claims priority benefit to U.S. provisional patent application No. 61/753,301, filed Jan. 16, 2013, the entire disclosure of which is also incorporated herein by reference.

BACKGROUND OF THE INVENTION

1. Field of the Invention

The present invention relates to optical instruments and methods for aiming a rifle, external ballistics and methods for predicting a gyroscopically stabilized projectile's trajectory to a target. This application relates to projectile weapon aiming systems such as rifle scopes, to reticle configurations for projectile weapon aiming systems, and to associated methods of compensating for a projectile's external ballistic behavior while developing a field expedient firing solution.

2. Discussion of the Prior Art

Rifle marksmanship has been continuously developing over the last few hundred years, and now refinements in materials and manufacturing processes have made increasingly accurate aimed fire possible. These refinements have made previously ignored environmental and external ballistics factors more significant as sources of aiming error.

The term "rifle" as used here, means a projectile controlling instrument or weapon configured to aim and propel or shoot a projectile, and rifle sights or projectile weapon aiming systems are discussed principally with reference to their use on rifles and embodied in telescopic sights commonly known as rifle scopes. It will become apparent, however, that projectile weapon aiming systems may include aiming devices other than rifle scopes, and may be used on instruments or weapons other than rifles which are capable of controlling and propelling projectiles along substantially pre-determinable trajectories (e.g., rail guns or cannon). The prior art provides a richly detailed library documenting the process of improving the accuracy of aimed fire from rifles (e.g., as shown in FIG. 1A) and other firearms or projectile weapons.

Most shooters or marksmen, whether hunting or target shooting, understand the basic process for aiming. The primary aiming factors are (a) elevation, for range or distance to the target or Point of Aim ("POA"), where the selected elevation determines the arcuate trajectory and "drop" of the bullet in flight and the Time of Flight ("TOF"), and (b) windage, because transverse or lateral forces act on the bullet during TOF and cause wind deflection or lateral drift. All experienced marksmen account for these two factors when aiming. Precision long-range shooters such as military and police marksmen (or "snipers") often resort to references including military and governmental technical publications such as the following:

(Ref 1) Jonathan M. Weaver, Jr., LTC, USA Ret., Infantry, System Error Budgets, Target Distributions and Hitting Performance Estimates for General-Purpose Rifles and Sniper Rifles of 7.62×51 mm and Larger Calibers, AD-A228 398, TR-461, AMSAA, May, 1990;

(Ref 2) McCoy, Robert L., A Parametric Study of the Long Range, Special Application Sniper Rifle, Aberdeen Proving Grounds ("APG"), MD, BRL Memorandum Report No. 3558, December 1986;

(Ref 3) Brophy, William S., Maj., Ord., A Test of Sniper Rifles, 37th Report of Project No. TS2-2015, APG, MD D&PS, 27 Jul. 1955;

(Ref 4) Von Wahlde, Raymond & Metz, Dennis, Sniper Weapon Fire Control Error Budget Analysis, US Army ARL-TR-2065, August, 1999-arl.army.mil;

(Ref 5) US Army FM-23-10, Sniper Training, United States Army Infantry School ATSH-IN-S3, Fort Benning, Ga. 31905-5596, August 1994; and (Ref 6) USMC MCWP 3-15.3 (formerly FMFM 1-3B), Sniping, PCN 143 000118 00, Doctrine Division (C42) US Marine Corps Combat Development Command, 2 Broadway Street Suite 210 Quantico, Va. 22134-5021, May 2004.

For nomenclature purposes and to provide a more complete background and foundation for what follows, these published references are incorporated herein by reference.

A number of patented rifle sights or projectile weapon aiming systems have been developed to help marksmen account for the elevation/range and windage factors when aiming. For example, U.S. Pat. No. 7,603,804 (to Zadery et al) describes a riflescope made and sold by Leupold & Stevens, Inc., with a reticle including a central crosshair defined as the primary aiming mark for a first selected range (or "zero range") and further includes a plurality of secondary aiming marks spaced below the primary aiming mark on a primary vertical axis. Zadery's secondary aiming marks are positioned to compensate for predicted ballistic drop at selected incremental ranges beyond the first selected range, for identified groups of bullets having similar ballistic characteristics.

Zadery's rifle scope has variable magnification, and since Zadery's reticle is not in the first focal plane ("F1") the angles subtended by the secondary aiming marks of the reticle can be increased or decreased by changing the optical power of the riflescope to compensate for ballistic characteristics of different ammunition. The rifle scope's crosshair is defined by the primary vertical line or axis which is intersected by a perpendicular horizontal line or primary horizontal axis. The reticle includes horizontally projecting windage aiming marks on secondary horizontal axes intersecting selected secondary aiming marks, to facilitate compensation for the effect of crosswinds on the trajectory of the projectile at the selected incremental ranges At each secondary aiming mark on the primary vertical axis, the laterally or horizontally projecting windage aiming marks project symmetrically (left and right)

from the vertical axis, indicating a windage correction for wind from the shooter's right and left sides, respectively.

Beyond bullet drop over a given range and basic left-right or lateral force windage compensation, there are several other ballistic factors which result in lesser errors in aiming. As the inherent precision of rifles and ammunition improves, it is increasingly critical that these other factors be taken into consideration and compensated for, in order to make an extremely accurate shot. These factors are especially critical at very long ranges, (e.g., approaching or beyond one thousand yards). Many of these other factors were addressed in this applicant's U.S. Pat. No. 7,325,353 (to Cole & Tubb) which describes a riflescope reticle including a plurality of charts, graphs or nomographs arrayed so a shooter can solve the ranging and ballistic problems required for correct estimation and aiming at a selected target. The '353 patent's scope reticle includes at least one aiming point field to allow a shooter to compensate for range (with elevation) and windage, with the "vertical" axis precisely diverging to compensate for "spin drift" and precession at longer ranges. Stadia for determining angular target dimension(s) are included on the reticle, with a nomograph for determining apparent distance from the apparent dimensions being provided either on the reticle or external to the scope. Additional nomographs are provided for the determination and compensation of non-level slopes, non-standard density altitudes, and wind correction, either on the reticle or external to the riflescope.

The elevation and windage aim point field (50) in the '353 patent's reticle is comparable, in one respect, to traditional bullet drop compensation reticles such as the reticle illustrated in the Zaderey '804 patent, but includes a number of refinements such as the compensated elevation or "vertical" crosshair 54, which can be seen to diverge laterally away from a true vertical reference line 56 (e.g., as shown in FIG. 3 of the '353 patent), to the right (i.e., for a rifle barrel with rifling oriented for right hand twist). The commercial embodiment of the '353 patent reticle is known as the DTAC™ Reticle, and the RET-2 version of the DTAC reticle is illustrated in FIG. 1C.

The compensated elevation or "vertical" crosshair of the DTAC™ reticle is useful for estimating the ballistic effect of the bullet's gyroscopic precession or "spin drift" caused by the bullet's stabilizing axial rotation or spin, which is imparted on the bullet by the rifle barrel's inwardly projecting helical "lands" which bear upon the bullet's circumferential surfaces as the bullets accelerates distally down the barrel. Precession or "spin drift" is due to an angular change of the axis of the bullet in flight as it travels an arcuate ballistic flight path. While various corrections have been developed for most of these factors, the corrections were typically provided in the form of programmable electronic devices or earlier in the form of logbooks developed over time by precision shooters. Additional factors affecting exterior ballistics of a bullet in flight include atmospheric variables, specifically altitude and barometric pressure, temperature, and humidity.

Traditional telescopic firearm sight reticles have been developed with markings to assist the shooter in determining the apparent range of a target. A nearly universal system has been developed by the military for artillery purposes, known as the "milli-radian," or "mil," for short. This system has been adopted by most of the military for tactical (e.g., sniper) use, and was subsequently adopted by most of the sport shooting world. The mil is an angle having a tangent of 0.001. A mil-dot scale is typically an array of dots (or similar indicia) arrayed along a line which is used to estimate or measure the distance to a target by observing the apparent target height or span (or the height or span of a known object in the vicinity of the target). For example, a target distance of one thousand yards would result in one mil subtending a height of approximately one yard, or thirty six inches, at the target. This is about 0.058 degree, or about 3.5 minutes of angle. It should be noted that although the term "mil-radian" implies a relationship to the radian, the mil is not exactly equal to an angle of a single one thousandth of a radian, which would be about 0.057 degree or about 3.42 minutes of angle. The "mil-dot" system, based upon the mil, is in wide use in scope reticle marking, but does not provide a direct measure for determining the distance to a target without first having at least a general idea of the target size, and then performing a mathematical calculation involving these factors. Confusingly, the US Army and the US Marine Corps do not agree on these conversions exactly (see, e.g., Refs 5 and 6), which means that depending on how the shooter is equipped, the shooter's calculations using these conversions may change slightly.

The angular measurement known as the "minute of angle," or MOA is used to measure the height or distance subtended by an angle of one minute, or one sixtieth of one degree. At a range of one hundred yards, this subtended angle spans slightly less than 1.05 inches, or about 10.47 inches at one thousand yards range. It will be seen that the distance subtended by the MOA is substantially less than that subtended by the mil at any given distance, i.e. thirty six inches for one mil at one thousand yards but only 10.47 inches for one MOA at that range. Thus, shooters have developed a rather elaborate set of procedures to calculate required changes to sights (often referred to as "clicks") based on a required adjustment in a bullet's point of impact (e.g., as measured in "inches" or "minutes").

Sight adjustment and ranging methods have been featured in a number of patents Assigned to Horus Vision, LLC, including U.S. Pat. Nos. 6,453,595 and 6,681,512, each entitled "Gunsight and Reticle therefore" by D. J. Sammut and, more recently, U.S. Pat. No. 7,832,137, entitled "Apparatus and Method for Calculating Aiming Point Information" by Sammut et al. These patents describe several embodiments of the Horus Vision™ reticles, which are used in conjunction with a series of calculations to provide predicted vertical corrections (or holdovers) for estimated ranges and lateral corrections (or windage adjustments), where a shooter calculates holdover and windage adjustments separately, and then selects a corresponding aiming point on the reticle.

In addition to the general knowledge of the field of the present invention described above, the applicant is also aware of certain foreign references which relate generally to the invention. Japanese Patent Publication No. 55-36,823 published on Mar. 14, 1980 to Raito Koki Seisakusho KK describes (according to the drawings and English abstract) a variable power rifle scope having a variable distance between two horizontally disposed reticle lines, depending upon the optical power selected. The distance may be adjusted to subtend a known span or dimension at the target, with the distance being displayed numerically on a circumferential external adjustment ring. A prism transmits the distance setting displayed on the external ring to the eyepiece of the scope, for viewing by the marksman.

General & Specialized Nomenclature

In order to provide a more structured background and a system of nomenclature, we refer again to FIGS. 1A-1F. FIG. 1A illustrates a projectile weapon system 4 including a rifle 6 and a telescopic rifle sight or projectile weapon aiming system 10. Telescopic rifle sight or rifle scope 10 are illustrated in the standard configuration where the rifle's barrel terminates distally in an open lumen or muzzle and rifle scope 10 is mounted upon rifle 6 in a configuration which allows the rifle system 4 to be "zeroed" or adjusted such that a user or shooter sees a Point of Aim ("POA") in substantial alignment with the rifle's Center of Impact ("COI") when shooting or firing a selected projectile 26 at a selected target 28.

FIG. 1B schematically illustrates exemplary internal components for telescopic rifle sight or rifle scope 10. The scope 10 generally includes a distal objective lens 12 opposing a proximal ocular or eyepiece lens 14 at the ends of a rigid and substantially tubular body or housing, with a reticle screen or glass 16 disposed there-between. Variable power (e.g., 5-15 magnification) scopes also include an erector lens 18 and an axially adjustable magnification power adjustment (or "zoom") lens 20, with some means for adjusting the relative position of the zoom lens 20 to adjust the magnification power as desired, e.g. a circumferential adjustment ring 22 which threads the zoom lens 20 toward or away from the erector lens 18. Variable power scopes, as well as other types of telescopic sight devices, also often include a transverse position control 24 for transversely adjusting the reticle screen 16 to position an aiming point or center of the aim point field thereon (or adjusting the alignment of the scope 10 with the firearm 6), to adjust vertically for elevation (or bullet drop) as desired. Scopes also conventionally include a transverse windage adjustment for horizontal reticle screen control as well (not shown).

While an exemplary conventional variable power scope 10 is used in the illustrations, fixed power scopes (e.g., 10×, such as the M3A scope) are often used. Such fixed power scopes have the advantages of economy, simplicity, and durability, in that they eliminate at least one lens and a positional adjustment for that lens. Such a fixed power scope may be suitable for many marksmen who generally shoot at relatively consistent ranges and targets.

Variable power scopes include two focal planes. The reticle screen or glass 16 used in connection with the reticles of the present invention is preferably positioned at the first or front focal plane ("FP1") between the distal objective lens 12 and erector lens 18, in order that the reticle thereon will change scale correspondingly with changes in magnification as the power of the scope is adjusted. This results in reticle divisions subtending the same apparent target size or angle, regardless of the magnification of the scope. In other words, a target subtending two reticle divisions at a relatively low magnification adjustment, will still subtend two reticle divisions when the power is adjusted, to a higher magnification, at a given distance from the target. The FP1 reticle location is often preferred by military and police marksmen using reticle systems with "mil-dot" divisions in variable power firearm scopes.

Alternatively, reticle screen 16 may be placed at a second or rear focal plane between the zoom lens 20 and proximal eyepiece 14, if so desired. Such a second focal plane reticle will remain at the same apparent size regardless of the magnification adjustment to the scope, which has the advantage of providing a full field of view to the reticle at all times. However, the reticle divisions will not consistently subtend the same apparent target size with changes in magnification, when the reticle is positioned at the second focal plane in a variable power scope.

FIG. 1C illustrates an earlier revision of applicant's DTAC™ rifle scope reticle, and provides a detailed view of an exemplary elevation and windage aim point field 30, with the accompanying horizontal and vertical angular measurement stadia 31. The aim point field 30 must be located on the scope reticle 16, as the marksman uses the aim point field 30 for aiming at the target as viewed through the scope and its reticle. Aim point field 30 comprises at least a horizontal line or crosshair 32 and a substantially vertical line or crosshair 34, which in the case of the field 30 is represented by a line of substantially vertical dots. A true vertical reference line (not shown) on aim point field 30 would vertical crosshair of the field 30, if so desired. It is noted that the substantially vertical central aiming dot line 34 is skewed somewhat to the right of a true vertical reference line (not shown) to compensate for gyroscopic precession or "spin drift" of the bullet in its trajectory. Most rifle barrels manufactured in the U.S. have "right hand twist" rifling which spirals to the right, or clockwise, from the proximal chamber to the distal muzzle of the rifle's barrel. This imparts a corresponding clockwise gyroscopically stabilizing spin to the fired bullet. As the fired bullet travels an arcuate trajectory in its ballistic flight between the rifle's muzzle and the target, the longitudinal axis of the bullet will deflect angularly to follow that arcuate trajectory. The spin of the bullet results in gyroscopic precession ninety degrees to the arcuate trajectory, causing the bullet to deflect to the right (for right hand twist barrels). This effect is seen most clearly at relatively long ranges, where there is substantial arc to the trajectory of the bullet, as shown in FIG. 1E. The offset or skewing of the vertical aiming dot line 34 to the right, in use, results in the marksman correspondingly moving the alignment slightly to the left in order to position one of the dots of the line 34 on the target (assuming no windage correction). This has the effect of correcting for the rightward deflection of the bullet due to gyroscopic precession.

The horizontal crosshair 32 and central aiming dot line 34 define a single aim point 38 at their intersection. The multiple aim point field 30 is formed of a series of horizontal rows which are seen in FIG. 1C to be exactly parallel to horizontal crosshair 32 and provide angled columns which are generally vertical (but spreading as they descend) to provide left side columns and right side columns of aiming dots (which may be small circles or other shapes, in order to minimize the obscuration of the target). It will be noted that the first and second uppermost horizontal rows actually comprise only a single dot each (including 38), as they provide relatively close-in aiming points for targets at only one hundred and two hundred yards, respectively. FIG. 1C's aim point field 30 is configured for a rifle and scope system which has initially been "zeroed" (i.e., adjusted to exactly compensate for the drop of the bullet during its flight) at a distance of two hundred yards, as evidenced by the primary horizontal crosshair 32. Thus, a marksman aiming at a closer target must lower his aim point to one of the dots slightly above the horizontal crosshair 32, as relatively little drop occurs to the bullet in such a relatively short flight.

Most of the horizontal rows in FIG. 1C's aim point field 30 are numbered along the left edge of the aim point field to indicate the range in hundreds of yards for an accurate shot using the dots of that particular row (e.g., "3" for 300 yards and "4" for 400 yards). The spacing between each horizontal row gradually increases as the range becomes longer and longer. This is due to the slowing of the bullet and increase in vertical speed due to the acceleration of gravity during the bullet's flight, (e.g., as illustrated in FIG. 1E). The alignment and spacing of the horizontal rows compensates for these factors at the selected ranges. In a similar manner, the angled, generally vertical columns spread as they extend downwardly to greater and greater ranges. These generally vertical columns are intended to provide aim points which compensate for windage, i.e. the lateral drift of a bullet due to any crosswind component. A crosswind will have an ever greater effect upon the path of a bullet with longer and longer range or distance. The scope reticle of FIG. 1C includes approximate "lead" indicators "W" (for a target moving at a slow, walking speed) and "R" (farther from the central aim point 38, for running targets).

In order to use the Tubb™ DTAC™ elevation and windage aim point field 30, the marksman must have a reasonably close estimate or measurement of the range to the target. This can be provided by means of the evenly spaced horizontal and vertical angular measurement stadia 31 disposed upon aim point field 30. The stadia 31 comprise a vertical row of stadia alignment markings and a horizontal row of such markings disposed along the horizontal reference line or crosshair 32. Each adjacent stadia mark, e.g. vertical marks and horizontal marks are evenly spaced from one another and subtend precisely the same angle therebetween, e.g. one mil, or a tangent of 0.001. Other angular definitions may be used as desired, e.g. the minute of angle or MOA system discussed above. The DTAC™ stadia system 31 is used by estimating some dimension of the target, or of an object close to the target. Each of the stadia markings comprises a small triangular shape, and provides a precise, specific alignment line, to reduce errors in subtended angle estimation, and therefore in estimating the distance to the target.

FIG. 1D illustrates a rifle scope reticle which is similar in many respects to the reticle of FIG. 1C and applicant's previous DTAC™ Reticle, as described and illustrated in applicant's own U.S. Pat. No. 7,325,353, in the prior art. FIG. 1D provides a detailed view of an exemplary elevation and windage aim point field 50, with the accompanying horizontal and vertical angular measurement stadia 100. The aim point field 50 must be located on the scope reticle 16, as the marksman uses the aim point field 50 for aiming at the target as viewed through the scope and its reticle. The aim point field 50 comprises at least one horizontal line or crosshair 52 and a substantially vertical central aiming dot line or crosshair 54, which in the case of the field 50 is represented by a line of substantially or nearly vertical dots. A true vertical reference line 56 is shown on the aim point field 50 of FIG. 1D, and may comprise the vertical crosshair of the reticle aim point field 50, if so desired.

It will be noted that the substantially vertical central aiming dot line 54 is skewed somewhat to the right of the true vertical reference line 56. As above, this is to compensate for gyroscopic precession or "spin drift" of a spin-stabilized bullet or projectile in its trajectory. The flying bullet's clockwise spin results in gyroscopic precession which generates a force that is transverse or normal (i.e., ninety degrees) to the arcuate trajectory, causing the bullet to deflect to the right. As above, the lateral offset or skewing of substantially vertical central aiming dot line to the right causes the user, shooter or marksman to aim or moving the alignment slightly to the left in order to position one of the aiming dots of the central line 54 on the target (assuming no windage correction).

FIG. 1D shows how horizontal crosshair 52 and substantially vertical central aiming dot line 54 define a single aim point 58 at their intersection. The multiple aim point 50 is formed of a series of horizontal rows which are exactly parallel to horizontal crosshair 52 (60*a*, 60*b*, 60*c*, etc.) and angled but generally vertical (spreading as they descend) to provide left side columns 62*a*, 62*b*, 62*c*, etc. and right side columns 64*a*, 64*b*, 64*c*, etc. of aiming dots (which may be small circles or other shapes, in order to minimize the obscuration of the target). It will be noted that the two uppermost horizontal rows 60*a* and 60*b* actually comprise only a single dot each, as they provide relatively close aiming points at only one hundred and two hundred yards, respectively. FIG. 1D's aim point field 50 is configured for a rifle and scope system (e.g., 4) which has been "zeroed" (i.e., adjusted to exactly compensate for the drop of the bullet during its flight) at a distance of three hundred yards, as evidenced by the primary horizontal crosshair 52. Thus, a marksman aiming at a closer target must lower his aim point to one of the dots 60*a* or 60*b* slightly above the horizontal crosshair 52, as relatively little drop occurs to the bullet in such a relatively short flight.

In FIG. 1D, most of the horizontal rows, e.g. rows 60*d*, 60*e*, 60*f*, 60*g*, down to row 60*n*, are numbered to indicate the range in hundreds of yards for an accurate shot using the dots of that particular row. The row 60*i* has a horizontal mark to indicate a range of one thousand yards. It will be noted that the spacing between each horizontal row 60*c*, 60*d*, 60*e*, 60*f*, etc., gradually increases as the range becomes longer and longer. This is due to the slowing of the bullet and increase in vertical speed due to the acceleration of gravity during its flight. The alignment and spacing of the horizontal rows nearly compensates for these factors, such that the vertical impact point of the bullet will be more nearly accurate at the selected range. In a similar manner, the generally vertical columns 62*a*, 62*b*, 64*a*, 64*b*, etc., spread as they extend downwardly to greater and greater ranges. These generally vertical columns are provided as an aiming aid permitting the shooter to compensate for windage, i.e. the lateral drift of a bullet due to any crosswind component. A crosswind will have an ever greater effect upon the path of a bullet with longer and longer range or distance, so the vertical columns spread with greater ranges or distances, with the two inner columns 62*a*, 64*a* closest to the central column 54 being spaced to provide correction for a five mile per hour crosswind component, while the next two adjacent columns 62*b*, 64*b* providing an estimated correction for a ten mile per hour crosswind component. Long range, high wind aim point estimation is known to the most difficult problem among experienced marksman, even if the wind is relatively steady over the entire flight path of the bullet.

Both of the reticles discussed above represent significant aids for precision shooting over long ranges, such as the ranges depicted in FIG. 1E, (which duplicates the information in FIGS. 3-25 of Ref 5). As noted above, FIG. 1E is a trajectory chart taken from a U.S. Gov't publication which illustrates the trajectory and Center of Impact ("COI") of a selected 7.62×51 (or 7.62 NATO) projectile fired from an M24 SWS rifle for sight adjustment or "zero" settings from 300 meters to 1000 meters. This chart was originally developed as a training aid for military marksmen (e.g., snipers) and illustrates the "zero wind" trajectory for the US M118 7.62 NATO (173gr FMJBT) projectile. The chart is intended to illustrate the arcuate trajectory of the bullet, in flight, and shows the relationship between a "line of sight" and the bullet's trajectory between the shooter's position and a POA or target, for eight different "zero" or sight adjustment ranges, namely, 300M, 400M, 500M, 600M, 700M, 800M, 900M, and 1000M. As illustrated in FIG. 1E, if a shooter is "zeroed" for a target at 300M and shoots a target at 300M, then the highest point of flight in the bullet's trajectory is 6.2 inches and the bullet will strike a target at 400M 14 inches low. This is to be contrasted with a much longer range shot. For example, as illustrated in FIG. 1E, if a shooter is "zeroed" for a target at 900M and shoots a target at 900M, then the highest point of flight in the bullet's trajectory is 96.6 inches (over 8 feet) and the bullet will strike a target at 1000M (or 1.0 KM) 14 inches low. For a target at 1000M the highest point of flight in the bullet's trajectory is 129 inches (almost 11 feet) above the line of sight, and, at these ranges, the bullet's trajectory is clearly well above the line of sight for a significant distance, and the bullet's time of flight ("TOF") is long enough that the time for the any cross wind to act on the bullet is a more significant factor.

FIG. 1F is another trajectory chart which illustrates the effect of shooting uphill or downhill at a ballistically significant angle above or below horizontal, a practice known as "Angle Firing." FIG. 1F illustrates the trajectory or path of a projectile 26 aimed from a rifle 4 at a distant, downhill Point of Aim ("POA"), namely target 28. The bullet's path to the target is an arcuate or parabolic trajectory which is mostly above a "Line of Sight" ("LOS") 29 defined between the rifle 4 and the target 28 and the Line of Sight distance may be measured (e.g., with a laser rangefinder) to provide an "LOS Range".

In the illustrated example, shooter and rifle 4 are above the target 28 by an elevation difference of "Y" (e.g. in yards or meters) and shooting downhill at a resultant "Slope Angle" 27, and the horizontal range or distance "X" covered by the projectile (e.g. in yards or meters) is known to be given by the following equation:

$$X=\cos(\text{Slope Angle})\times(\text{LOS Range}) \quad \text{(Eq. 1)}$$

The horizontal or "cosine" range X is always less than the LOS Range and so the bullet's ballistic "drop" over the angled trajectory is less than would be for a shot fired across level ground (where X equals LOS range), and the relationship described in eq. 1 is true whether the target 28 is uphill or downhill (as shown) from the shooter. The Slope Angle's ballistic effect must be accounted for when making precise long range shots and many accessories have been developed to help Angle Firing shooters in the field measure a Slope Angle 27 and then compute the cosine range when developing their firing solution.

The above described systems are now in use in scope reticles, but these prior art systems have been discovered to include subtle but significant errors arising from recently observed external ballistic phenomena, and the observed error has been significant (e.g., exceeding one MOA) at ranges well within the operationally significant military or police sniping range limits (e.g., 1000 yards). The prior art systems often require the marksman or shooter to bring a companion (e.g., a coach or spotter) who may be required to bring additional optics for observation and measurement and may also be required to bring along transportable computer-like devices such as a Personal Digital Assistant ("PDA") or a smart phone (e.g., an iPhone™ or a Blackberry™ programmed with an appropriate software application or "app") for solving ballistics problems while in the field.

These prior art systems also require the marksman or their companion to engage in too many evaluations and calculations while in the field, and even for experienced long-range shooters, those evaluations and calculations usually take up a significant amount of time. If the marksman is engaged in military or police tactical or sniping operations, lost time when aiming may be extremely critical, (e.g., as noted in Refs 5 and 6).

None of the above cited references or patents, alone or in combination, address the combined atmospheric and ballistic problems identified by the applicant of the present invention or provide an adequately workable and time-efficient way of developing an accurate firing solution, while in the field. Thus, there is an unmet need for a rapid, accurate and effective rifle sight or projectile weapon aiming system and method for more precisely estimating a correct point of aim when shooting or engaging targets at long distances, especially in windy conditions.

SUMMARY OF THE INVENTION

Accordingly, it is an object of the present invention to overcome the above mentioned difficulties by providing alternative systems and methods to compensating for a gyroscopically stabilized projectile's ballistic behavior while developing a field expedient firing solution, and estimating a correct Point of Aim ("POA") when shooting or engaging targets at long distances. For users trained to adjust the windage component of aim, the reticle of the present invention includes a plurality of crosswind-jump compensated MIL or MOA spaced indicia defined in nearly horizontal, sloped wind-dot arrays spaced vertically apart for designated range increments.

The applicant has engaged in a rigorous study of precision shooting and external ballistics and observed what initially appeared to be external ballistics anomalies when engaged in carefully controlled experiments in precise shooting at long range. The anomalies were observed to vary with environmental or atmospheric conditions, especially crosswinds. The variations in the anomalies were observed to be repeatable, and so a precise evaluation of the anomalies was undertaken and it was discovered that all of the long range reticles presently employed in the prior art systems are essentially wrong.

A dynamic targeting system is configured with projectile and weapon-system specific aiming indicia in a displayed reticle which is used with a method permitting a user or shooter to quickly determine, in the field, aiming variations required for varying ammunition. The refined aiming method and reticle of the present invention allows a more precise estimate of external ballistic behavior for a given gyroscopically stabilized projectile when a given set of environmental or atmospheric conditions are observed to be momentarily present. Expressed most plainly, the reticle of the present invention differs from prior art long range reticles in two significant and easily perceived ways:

first, the reticle and system of the present invention is configured to compensate for atmospheric-condition-dependent Crosswind Jump, and so the reticle's lateral or windage aim point adjustment axes are not horizontal, meaning that they are not simply horizontal straight lines which are perpendicular to a reticle's vertical straight line crosshair; and second, the reticle and system of the present invention is configured to compensate for atmospheric-condition-dependent Dissimilar Wind Drift, and so the reticle's arrayed aim point indicators on each windage adjustment axis are not spaced evenly or symmetrically about the vertical crosshair, meaning that a given wind speed's full value windage offset indicator on the left side of the vertical crosshair is not spaced from the vertical crosshair at the same lateral distance as the corresponding given wind speed's full value windage offset indicator on the right side of the vertical crosshair.

Apart from the Tubb™ DTAC™ reticle discussed above, the reticles of the prior art have a perfectly vertical crosshair or post intended to be seen (through the riflescope) as being exactly perpendicular to a straight horizontal or horizon reference crosshair that is parallel to the horizon when the riflescope is held level with no angular variation from vertical (e.g., due to "rifle cant"). Those prior art reticles also include a plurality of "secondary horizontal crosshairs" (e.g., 24 in FIG. 2 of Sammut's U.S. Pat. No. 6,453,595). The secondary horizontal crosshairs are typically divided with evenly spaced indicia on both sides of the vertical crosshair (e.g., 26 in FIG. 2 of Sammut's U.S. Pat. No. 6,453,595 or as shown in FIG. 3 of this applicant's U.S. Pat. No. 7,325,353). These prior art reticles represent a prediction of where a bullet will strike a target, and that prior art prediction includes an assumption or estimation that for a crosswind velocity of a given magnitude (e.g., 10 mph) the desired aiming windage offset to the left is going to be identical to and symmetrical with a windage offset to the right, and that assumption is plainly, provably wrong, for reasons supported in the more arcane technical literature on ballistics and explained below.

Another assumption built into the prior art reticles pertains to the predicted effect on elevation arising from increasing windage adjustments, because the prior art reticles effectively predict that no change in elevation (i.e., vertical holdover) should be made, no matter how much windage adjustment is needed. This second assumption is demonstrated by the fact that the prior art reticles resemble segments of vertical squares and have straight and parallel "secondary horizontal crosshairs" (e.g., 24 in FIG. 2 of Sammut's U.S. Pat. No. 6,453,595 or as shown in FIG. 3 of this applicant's U.S. Pat. No. 7,325,353), and that assumption is also plainly, provably wrong.

The applicant of the present invention first questioned and then disproved and discarded these assumptions, choosing instead to empirically observe, record and plot the actual ballistic performance for a series of carefully controlled shots at selected ranges, and the plotted Center of Impact ("COI") observations have been used to develop an improved method and reticle system which provides a more accurate predictor of the effects of observed atmospheric and environmental conditions on a bullet's external ballistics, especially at longer ranges. The applicant's discoveries are combined into a reticle which provides easy to use and accurate estimations of the external ballistic effects of (a) spin drift, (b) crosswind jump (or aeronautical jump) and (c) dissimilar wind drift. The aiming system of the present invention also provides a very rapid method and apparatus to compensate for uphill-downhill bullet drop differences when Angle Firing (e.g., firing at ballistically significant slope angles).

The rifle sight or projectile weapon aiming system reticle of the present invention preferably includes a two-dimensional array of aiming dots or indicia which predict the COI for shots fired using the selected or nominal projectile, in wind, when aiming at a target or POA having a measured range. The array of aiming indicia includes a curved, nearly vertical crosshair axis and an array of lateral indicia defining a horizontal crosshair which intersect to define a central or primary aiming point. The two dimensions defining the array of aiming indicia are (1) Distance (e.g., expressed in yards or meters) and (2) Velocity (e.g., expressed in miles per hour (mph) or kilometers per hour (kph)). This means the user visually navigates the aim point field and describes the desired POA or "Hold Point" within that two dimensional field as being, for example "702 yards (for aiming elevation hold-over) and 10 MPH right wind" (for aiming windage hold into wind from the right). The reticle of the present invention also includes a plurality of sloped, linear secondary windage adjustment axes arrayed beneath the horizontal crosshair. The secondary windage adjustment axes are not horizontal lines, meaning that they are not secondary horizontal crosshairs each being perpendicular to a vertical crosshair. Instead, each secondary windage axis defines an angled or sloped array of windage offset adjustment indicia or aim points. If a secondary windage axis line were drawn left to right through all of the windage offset adjustment indicia corresponding to a selected range (e.g., 800 yards), that secondary windage axis line would slope downwardly from horizontal at a small angle (e.g., five to ten degrees), for a rifle barrel with right-hand twist rifling and a right-spinning projectile.

In addition, the windage offset adjustment indicia for given velocity increments on each secondary windage adjustment axis are not symmetrical about the no-wind nearly vertical axis or crosshair, meaning that selected windage offset adjustment indicator for a 5 mile per hour ("MPH") crosswind on the left side of the vertical axis or crosshair is not spaced from the vertical crosshair at the same lateral distance as the corresponding 5 MPH windage offset adjustment indicator on the right side of the vertical crosshair. Instead, the reticle and method of the present invention define differing lateral or windage offsets for (a) wind from the left and (b) wind from the right for any rifle. Those windage offsets refer to the curved elevation adjustment axis which diverges laterally from a vertical crosshair. The elevation adjustment axis defines the diverging array of elevation offset adjustment indicia for selected ranges (e.g., 300 to 1600 yards, in 100 yard increments). An elevation offset adjustment axis line could be drawn through all of the elevation offset adjustment indicia (corresponding to no wind) to define only the predicted effect of spin drift and precession, as described in this applicant's U.S. Pat. No. 7,325,353.

In accordance with the present invention, a reticle system and aiming method provide a two-dimensional array of aiming indicia showing predicted Center of Impact (or "COI") for a user's projectile and the user expresses the firing solution solely in dimensions of distance and crosswind-jump corrected windage offset (in Mils or MOA). The reticle system and aiming method of the present invention account for previously ill-defined interactions between ballistic and environmental, atmospheric effects and provide a comprehensive and dynamically adaptable system to provide a firing or aiming solution which can be used rapidly by a marksman in the field.

The reticle embodiment is called the Mil-MOA Dynamic Targeting Reticle (or "Mil-MOA DTR") and this embodiment is unique in many ways, most fundamentally because the reticle is configured to be seen by the user or shooter as being superimposed on the aiming area including the target or desired POA and the predicted COI for the user's projectile is described as a two-dimensional firing solution expressed in (1) range (e.g., yards or meters) and (2) crosswind-jump corrected windage offset (in Mils or MOA) rather than the prior art's confusing vertical and lateral angles (e.g., vertical and horizontal estimates of minutes of angle or MILS for a given POA). Additionally the Mil-MOA DTR provides automatic correction for the projectile's atmospheric condition dependent spin drift and crosswind jump, none of which are provided by prior art reticles. As a direct result of these unique capabilities, the user or shooter can develop precise crosswind-jump corrected long range firing solutions faster than with other reticles.

The Mil-MOA DTR reticle automatically does much to ease the computation burden on the user, marksman or shooter who has been trained to adjust the windage component of aim, the reticle of the present invention includes a plurality of crosswind-jump compensated MIL or MOA spaced indicia defined in nearly horizontal, sloped wind-dot arrays spaced vertically apart for designated range increments. If the shooter's Muzzle Velocity and Air Density (e.g., Density Altitude) match the selected nominal or baseline values and the shooter is shooting on a flat or nearly flat range, all the shooter has to do is measure, estimate or "call" the range in yards (or meters) and call the wind in MPH (or KPH), then aim by placing the selected "Hold Point" (on or between selected aiming dot(s)) upon the center of the target or POA and release the shot. The reticle embodiments of the present invention provide a rapid point-and-shoot firing solution or Hold Point for targets located out to the maximum range of the shooter's projectile.

The above and still further objects, features and advantages of the present invention will become apparent upon consideration of the following detailed description of a specific embodiment thereof, particularly when taken in conjunction with the accompanying drawings, wherein like reference numerals in the various figures are utilized to designate like components.

BRIEF DESCRIPTION OF THE DRAWINGS

FIGS. 6A and 6B illustrate transportable placards summarizing selected ballistics correction factors in first and second tables for use with any projectile weapon including a rifle scope having a standard mil-dot reticle, for a specific ammunition, in accordance with the method of the present invention.

DETAILED DESCRIPTION

A first embodiment of applicant's reticle as shown in FIGS. 2-19 (e.g. 200, 300 or DTR reticle 700) is configured for use in a novel aiming system providing a two-dimensional array of aiming indicia showing many predicted Center of Impact (or "COI") references for a user's projectile (e.g., 26) and when using the embodiments illustrated in FIGS. 2-20, the user expresses the firing solution or Hold Point for a selected target solely in dimensions of distance and velocity. The reticle system of the present invention is configured to be superimposed on an Aiming Area viewed by the user (e.g., through riflescope 10). The Aiming Area includes at least one selected Target (e.g. 8) or Point of Aim ("POA"). The user determines the effective range to the Target and estimates the wind's effect to select an aiming Hold Point for the user's projectile. The "Hold Point" or firing solution is expressed as one point corresponding to (1) an identified effective range (e.g., yards or meters) and (2) an effective crosswind velocity (e.g., in MPH). Additionally, applicant's reticle aiming array (e.g. 150, 350 or 750) provides automatic correction for the projectile's atmospheric condition dependent spin drift, crosswind jump and dissimilar wind drift, as discussed in more detail below.

The reticle of the present invention automatically does much to ease the computation burden on the user, marksman or shooter. If the projectile's Muzzle Velocity and the local environment match a selected reticle's nominal, main or baseline NAV values and the shooter is shooting on a flat or nearly flat range, all the shooter has to do is estimate or "call" the range in yards (or meters) and call the wind in MPH (or KPH), then aim by placing the called or selected Hold Point on or between selected aiming dot(s) upon the target or POA and release the shot. For an experienced user, the reticles of FIGS. 2, 5, 7, 8, 9A, 17 and 18 provide point-and-shoot firing solutions or aiming Hold Points for targets or POAs out to the maximum range of the shooter's weapon system. The user or shooter may require a rapid and accurate firing solution, and applicant's reticle enables the user to practice a rapid method for developing a firing solution or aiming Hold Point for one or more targets or POAs in a dynamic or changing shooting environment.

Figure 1A:
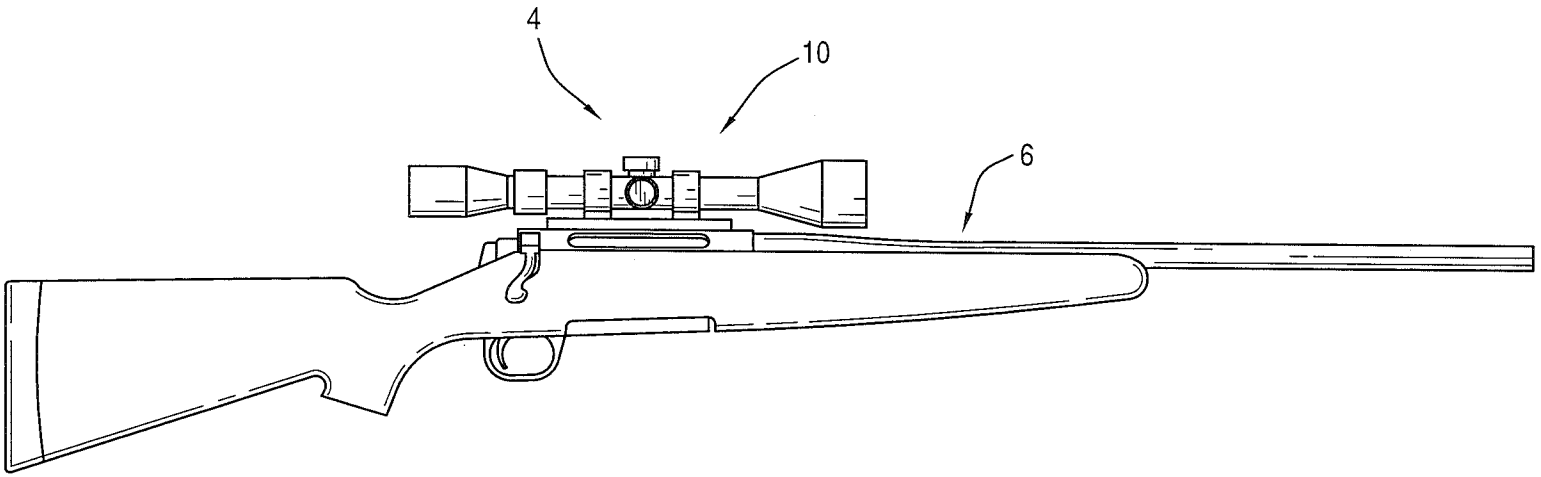
FIG. 1A PRIOR ART
FIG. 1A illustrates a typical rifle with a rifle scope, or more generally, a sight or projectile weapon aiming system.

Referring again to FIGS. 1A-1E. FIG. 1A's exemplary projectile weapon system 4 is typical of those used by marksmen and includes a rifle 6 and a telescopic rifle sight (or projectile weapon aiming system) 10. Typically, the rifle's tubular rifled barrel terminates distally in an open lumen or muzzle and rifle scope 10 is mounted upon rifle 6 in a configuration which allows the rifle system 4 to be adjusted such that a user or shooter sees an Aiming Area having a target or Point of Aim ("POA"). When aiming, the user sees a two dimensional image of the Aiming Area and projectile weapon system 4 must be oriented toward the Aiming Area and held in a carefully selected alignment so that the user sees the firing solution or Hold Point (and thus the predicted Center of Impact ("COI") for the projectile) superimposed on the selected target or POA.

Figure 1B:
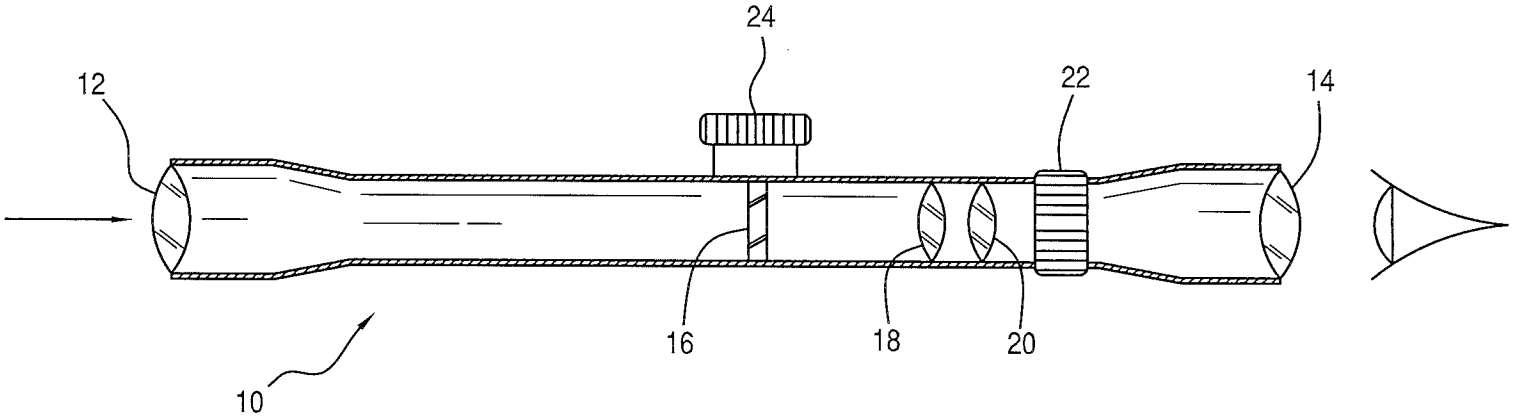
FIG. 1B PRIOR ART
FIG. 1B illustrates a schematic view in cross section of the basic internal elements of a typical rifle scope such as the rifle scope of FIG. 1A.
Figure 1C:
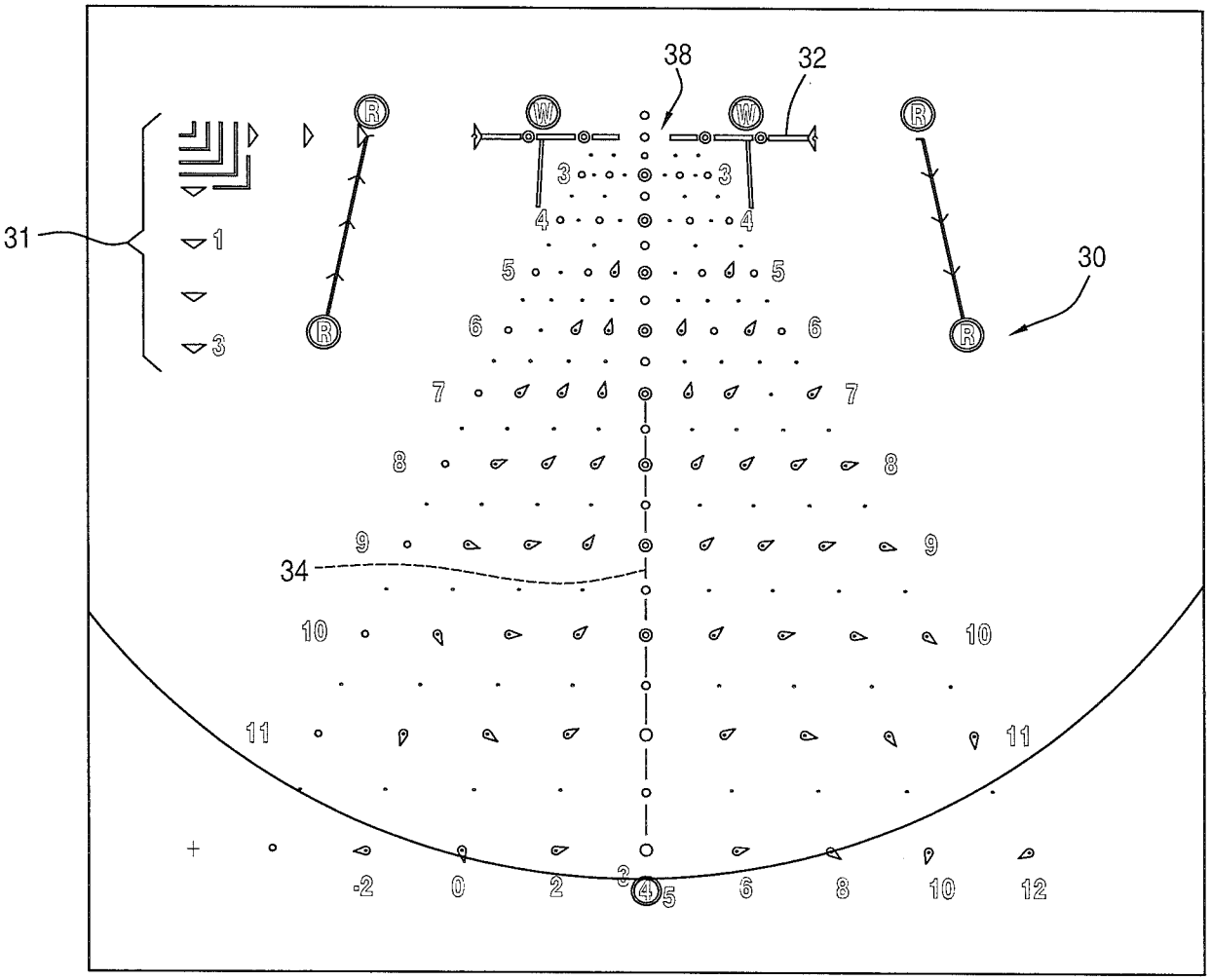
FIG. 1C PRIOR ART
FIG. 1C illustrates a rifle scope reticle for use in the rifle scope of FIGS. 1A and 1B, and having an earlier revision of applicant's DTAC™ reticle elevation and windage aim point field, as seen in the prior art.
Figure 1D:
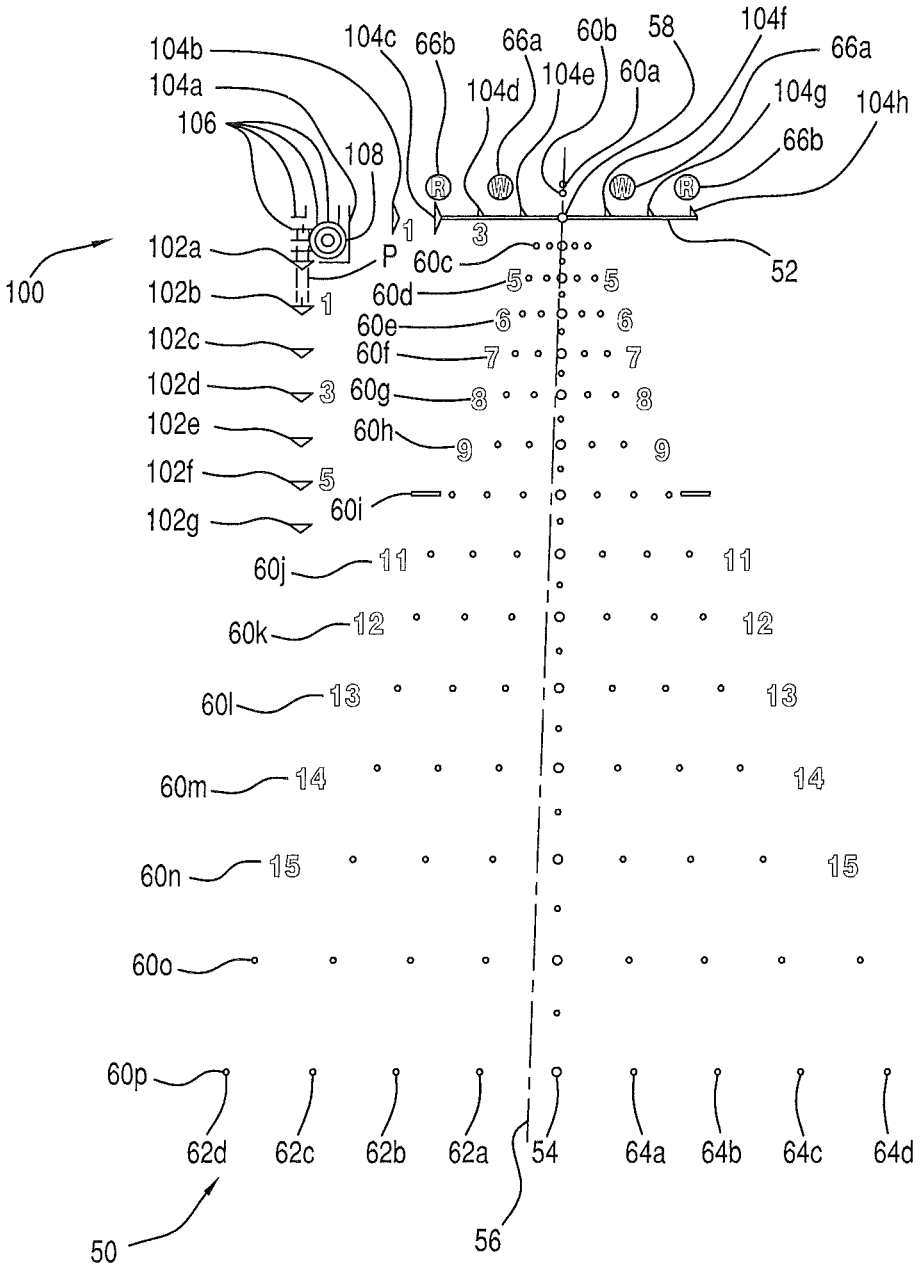
FIG. 1D PRIOR ART
FIG. 1D illustrates a rifle scope reticle for use in the rifle scope of FIGS. 1A and 1B, and applicant's previous DTAC™ Reticle, as described and illustrated in applicant's own U.S. Pat. No. 7,325,353.

FIG. 1B schematically illustrates exemplary internal components for telescopic rifle sight or projectile weapon aiming system 10, with which the reticle and system of the present invention may also be used. As noted above, rifle scope 10 generally includes a distal objective lens 12 opposing a proximal ocular or eyepiece lens 14 at the ends of a rigid and substantially tubular body or housing, with a reticle screen or glass 16 disposed there-between. Variable power (e.g., 5-15 magnification) scopes also include an erector lens 18 and an axially adjustable magnification power adjustment (or "zoom") lens 20, with some means for adjusting the relative position of the zoom lens 20 to adjust the magnification power as desired, e.g. a circumferential adjustment ring 22 which threads the zoom lens 20 toward or away from the erector lens 18. Variable power scopes, as well as other types of telescopic sight devices, also often include a transverse position control 24 for transversely adjusting the reticle screen 16 to position an aiming point or center of the aim point field thereon (or adjusting the alignment of the scope 10 with the firearm 6), to adjust vertically for elevation (or bullet drop) as desired. Scopes also conventionally include a transverse windage adjustment for horizontal reticle screen control as well (not shown).

While an exemplary conventional variable power scope 10 is used in the illustrations, it will be understood that the reticle and system of the present invention may be used with other types of sighting systems or scopes in lieu of the variable power scope 10. For example, fixed power scopes are often used by many hunters and target shooters. Such fixed power scopes have the advantages of economy, simplicity, and durability, in that they eliminate at least one lens and a positional adjustment for that lens. Such a fixed power scope may be suitable for many marksmen who generally shoot at relatively consistent ranges and targets. More recently, digital electronic scopes have been developed, which operate using the same general principles as digital electronic cameras. The ballistic effect compensating reticle (e.g. 150, 350 or DTR reticle 750) and aim compensation method for rifle sights or projectile weapon aiming systems of the present invention (and as set forth in the appended claims) may be employed with these other types of sighting systems or scopes, as well as with the variable power scope 10 of FIGS. 1A and 1B.

While variable power scopes typically include two focal planes, the reticle screen or glass 16 used in connection with the reticles of the present invention is preferably positioned at the first or front focal plane ("FP1") between the distal objective lens 12 and erector lens 18, in order that the reticle thereon (e.g. 150, 350 or DTR reticle 750) will change scale correspondingly with changes in magnification as the power of the scope is adjusted. This results in reticle divisions subtending the same apparent target size or angle, regardless of the magnification of the scope. In other words, a target subtending two reticle divisions at a relatively low magnification adjustment, will still subtend two reticle divisions when the power is adjusted, to a higher magnification, at a given distance from the target. This reticle location is preferred for the present system when used in combination with a variable power firearm scope.

Alternatively, reticle screen 16 may be placed at a second or rear focal plane between the zoom lens 20 and proximal eyepiece 14, if so desired. Such a second focal plane reticle will remain at the same apparent size regardless of the magnification adjustment to the scope, which has the advantage of providing a full field of view to the reticle at all times. However, the reticle divisions will not consistently subtend the same apparent target size with changes in magnification, when the reticle is positioned at the second focal plane in a variable power scope. Accordingly, it is preferred that the present system be used with first focal plane reticles in variable power scopes, due to the difficulty in using such a second focal plane reticle in a variable power scope.

Figure 1E:
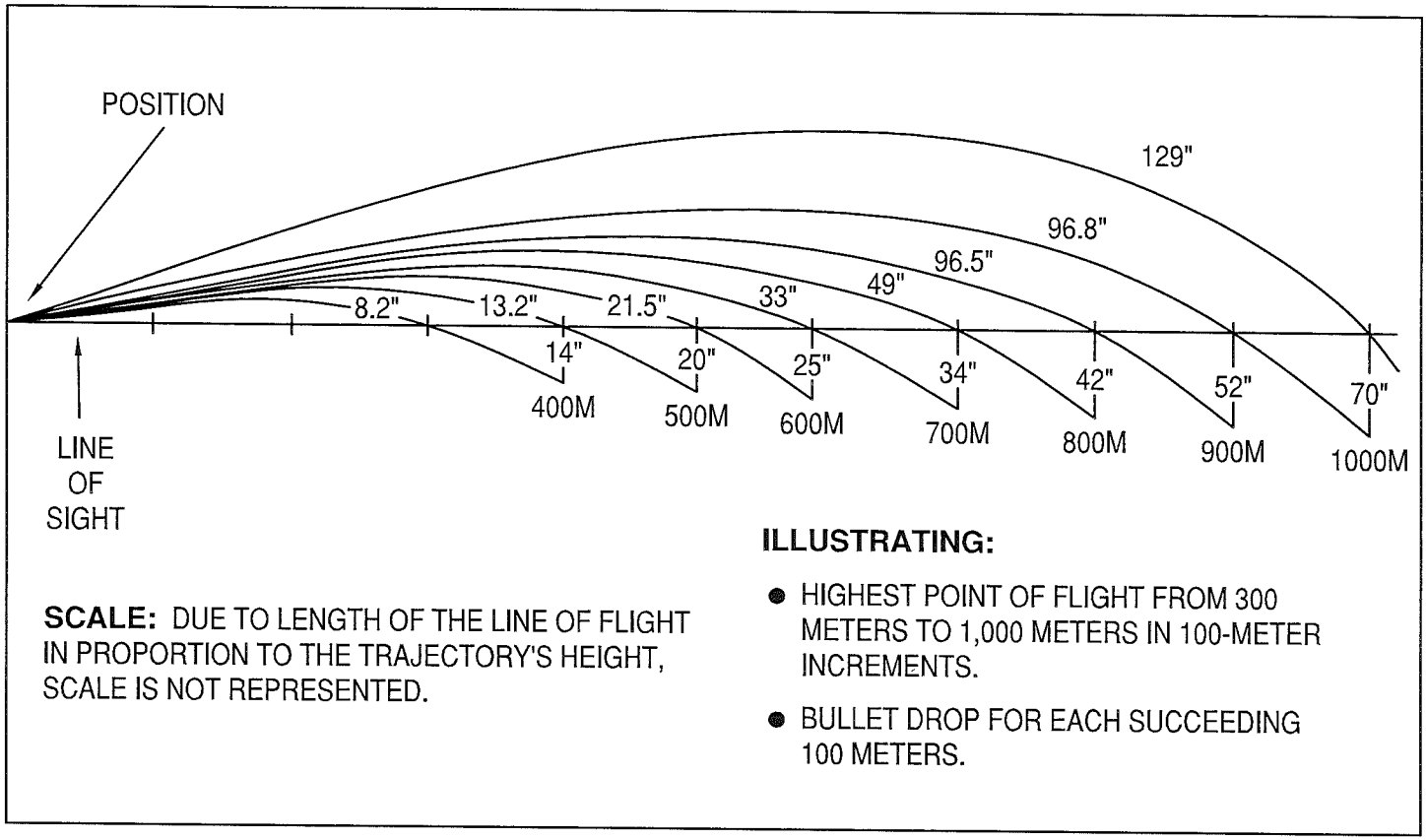
FIG. 1E is a chart taken from a U.S. Gov't publication which illustrates the trajectories of a selected 7.62 NATO projectile for sight adjustment or "zero" settings for Points of Aim ("PDAs") or targets arrayed along a Line of Sight ("LOS") from 300 meters to 1000 meters, as found in the prior art.

As noted above, the applicant's prior art DTAC™ reticles (shown in FIGS. 1C and 1D) provided improved aids to precision shooting over long ranges, such as the ranges depicted in FIG. 1E. But more was needed. FIG. 1E is a trajectory chart originally developed as a training aid for military marksmen (e.g., snipers) and illustrates the "zero wind" trajectory for the selected projectile. The chart was intended to illustrate the arcuate trajectory of the bullet, in flight, along with a Center of Impact ("COI") for each range and shows the relationship between a Line Of Sight ("LOS") and the bullet's trajectory between the shooter's position and a target or POA, for the illustrated "zero" or sight adjustment ranges (e.g., 300M, 400M, 500M, 600M, 700M, 800M, 900M, and 1000M). As illustrated in FIG. 1E, if a shooter is "zeroed" for a target or POA at 300M and shoots at that 300M target, then the highest point of flight in the bullet's trajectory is 6.2 inches and the bullet's COI or strike on the target or POA at 400M 14 inches low. This is to be contrasted with a much longer range shot. For example, as illustrated in FIG. 1E, if a shooter is "zeroed" for a target at 900M and shoots a target at 900M, then the highest point of flight in the bullet's trajectory is 96.6 inches (over 8 feet!) and the bullet will strike a target or POA at 1000M (or 1.0 KM) 14 inches low. For a target at 1000M the highest point of flight in the bullet's trajectory is 129 inches (almost 11 feet!) above the line of sight, and, at these ranges, the bullet's trajectory is clearly well above the line of sight for a significant distance, and the bullet's time of flight ("TOF") is long enough that the time for the any cross wind to act on the bullet is a more significant factor. The applicant observed that crosswinds at elevations so far above the line of sight vary significantly from the winds closer to the line of sight (and thus above the earth's surface). In the study of fluid dynamics, scientists, engineers and technicians differentiate between fluid flow near "boundary layers" (such as the earth) and fluid flow which is unaffected by static boundaries and thus provides "laminar" or non-turbulent flow.

The ballistic effect compensating system and reticles of the present invention (e.g. 150, 350 or DTR reticle 750) are configured to aid the shooter by provided long-range aim points which predict the effects of the combined ballistic and atmospheric effects, and the inter-relationship of these external ballistic effects as observed and recorded by the applicant have been plotted to provide predicted COIs at designated ranges and for designated wind offsets, as illustrated in the reticles (e.g. 150, 350 or DTR reticle 750) of the present invention.

The reticles and method of present invention as illustrated in FIGS. 2-18 comprises a new multiple nomograph system for solving ranging and ballistic problems in firearms, and are adapted particularly for use with hand held firearms (e.g., such as rifle 4 or the standard military rifles such as the M40, the M24 or the M110) having magnifying rifle scope sights. The embodiment illustrated in FIG. 5 includes an aim point field 150 with a horizontal crosshair 152 comprising a linear horizontal array of aiming and measuring indicia. The ballistic effect compensating system and the reticle 200 of FIGS. 2-5 is configured for use with any projectile weapon, and especially with a sight such as rifle scope 10 configured for developing rapid and accurate firing solutions in the field for long TOF and long trajectory shots, even in cross winds. The aiming method and reticle of the present invention are usable with or without newly developed Range Cards (described below) or pre-programmed transportable computing devices. The reticle and aiming method of the embodiment of FIGS. 2-5 is adapted to predict the effects of newly discovered combined ballistic and atmospheric effects that have an inter-relationship observed by the applicant and plotted in reticle aim point field 150, in accordance with the present invention.

The reticle illustrated in FIGS. 2-5 comprises a new multiple nomograph system 200 for solving ranging and ballistic problems in firearms, and is adapted particularly for use with hand held firearms or weapons systems (e.g., 4 or the standard military rifles such as the M40, the M24 or the M110) having magnifying rifle scope sights (e.g., 10). The present system, as illustrated in FIGS. 2-5 includes reticle aim point field 150 which differs from prior art long range reticles in that sloped windage adjustment axes (e.g., 160A) are not horizontal, meaning that they are not simply range compensated horizontal aiming aids which are parallel to horizontal crosshair 152 and so are not perpendicular to either vertical reference crosshair 156 or substantially vertical central aiming dot line 154.

Figure 3:
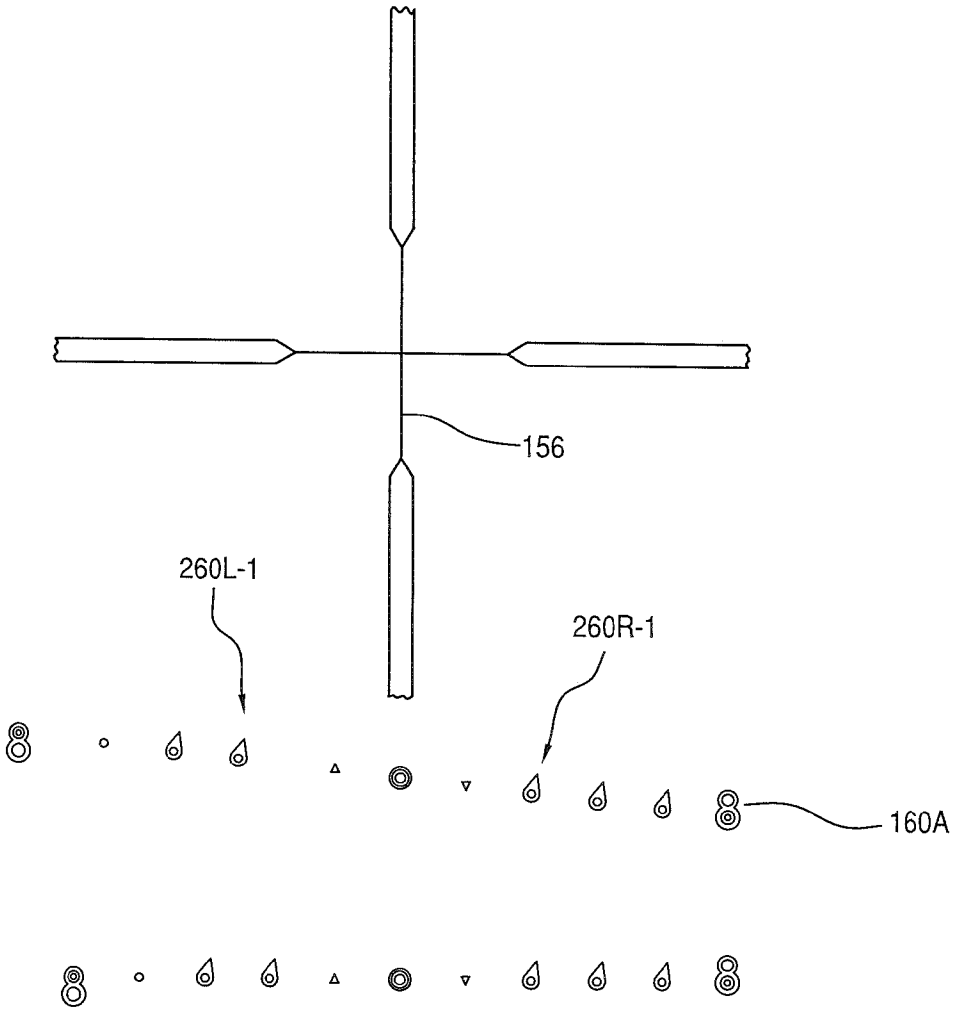
FIG. 3 illustrates a ballistic effect compensating system and aim compensation method for rifle sights or projectile weapon aiming systems which is readily adapted for use with any projectile weapon, and especially with a rifle scope such as that illustrated in FIGS. 1A and 1B, in accordance with the present invention.
Figure 4:
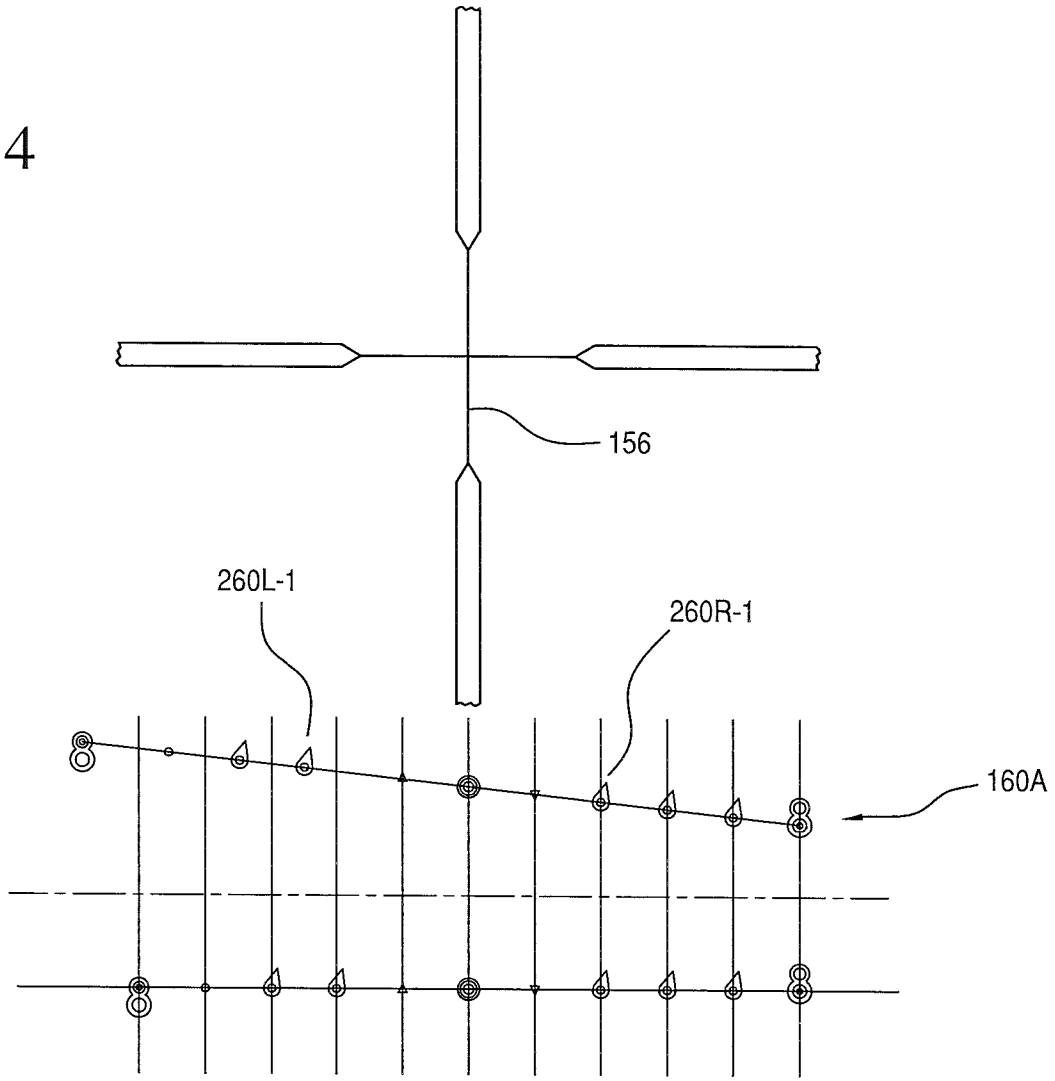
FIG. 4 further illustrates the ballistic effect compensating system and aim compensation method of FIG. 3, in accordance with the present invention.

The diagrams of FIGS. 3 and 4 are provided to illustrate how the downrange (e.g., 800 yard) wind dots in aim point field 150 have been configured or plotted to aid the shooter by illustrating the inter-relationship of the external ballistic effects observed and recorded by the applicant as part of the development work for the new reticle of the present invention. In reticle aim point field 150, the windage aim point indicia (e.g., 260L-1, as best seen in FIGS. 3 and 4) on each windage adjustment axis are not symmetrical about the vertical crosshair 156, meaning that a full value windage offset indicator (e.g. 260L-1) on the left side of vertical crosshair 156 is not spaced from vertical crosshair 156 at the same distance as the corresponding full value windage offset indicator (e.g. 260R-1) on the right side of the vertical crosshair, for a given wind velocity offset (e.g., 10 mph).

Experimental Approach and Prototype Development

As noted above, reticle system 200 and the method of the present invention are used to predict the ballistic performance of specific ammunition fired from a specific rifle system (e.g., 4 or the standard military rifles such as the M40, the M24 or the M110) when shooting in specified baseline or nominal environmental conditions. Reticle system 200 can be used in varying environmental conditions with a range of other ammunition by using pre-defined Hold Point correction criteria. The data for the reticle aim point field 150 shown in FIGS. 2 and 5 was generated using a Tubb 2000™ rifle with .284 Winchester ammunition specially prepared for long distance precision shooting. The rifle was fitted with a RH twist barrel (twist rate 1:9) for the results illustrated in FIGS. 2-5. A second set of experiments conducted with a LH twist barrel (also 1:9) confirmed that the slope of the windage axes was equal magnitude but reversed when using a LH twist barrel, meaning that the windage axes rise (from right to left) at about a 5 degree angle and the substantially vertical central aiming dot line or elevation axis (illustrating the effect of spin drift) diverges to the left of a vertical crosshair (e.g., 156).

Thus, reticle aim point field or aiming indicia array 150 comprises a two-dimensional array of aiming dots or indicia which predict the COI for shots fired using the selected or nominal projectile, in wind, when aiming at a target or POA having a measured range. Aim point field or aiming indicia array 150 includes a curved, nearly vertical crosshair axis 154 and a primary array of lateral indicia 152 defining a horizontal crosshair which intersect to define a central or primary aiming point 154. The two dimensions defining aim point field's array of aiming indicia 150 are (1) Distance (expressed in yards) and (2) Velocity (expressed in miles per hour (mph)). This means the user visually navigates aim point field 150 and describes a desired firing solution or aiming "Hold Point" 180 (see FIG. 2) within that two dimensional field as being, for example, "702 yards (for aiming elevation hold-over) and 10 MPH right wind" (for aiming windage hold into wind from the right).

Figure 2:
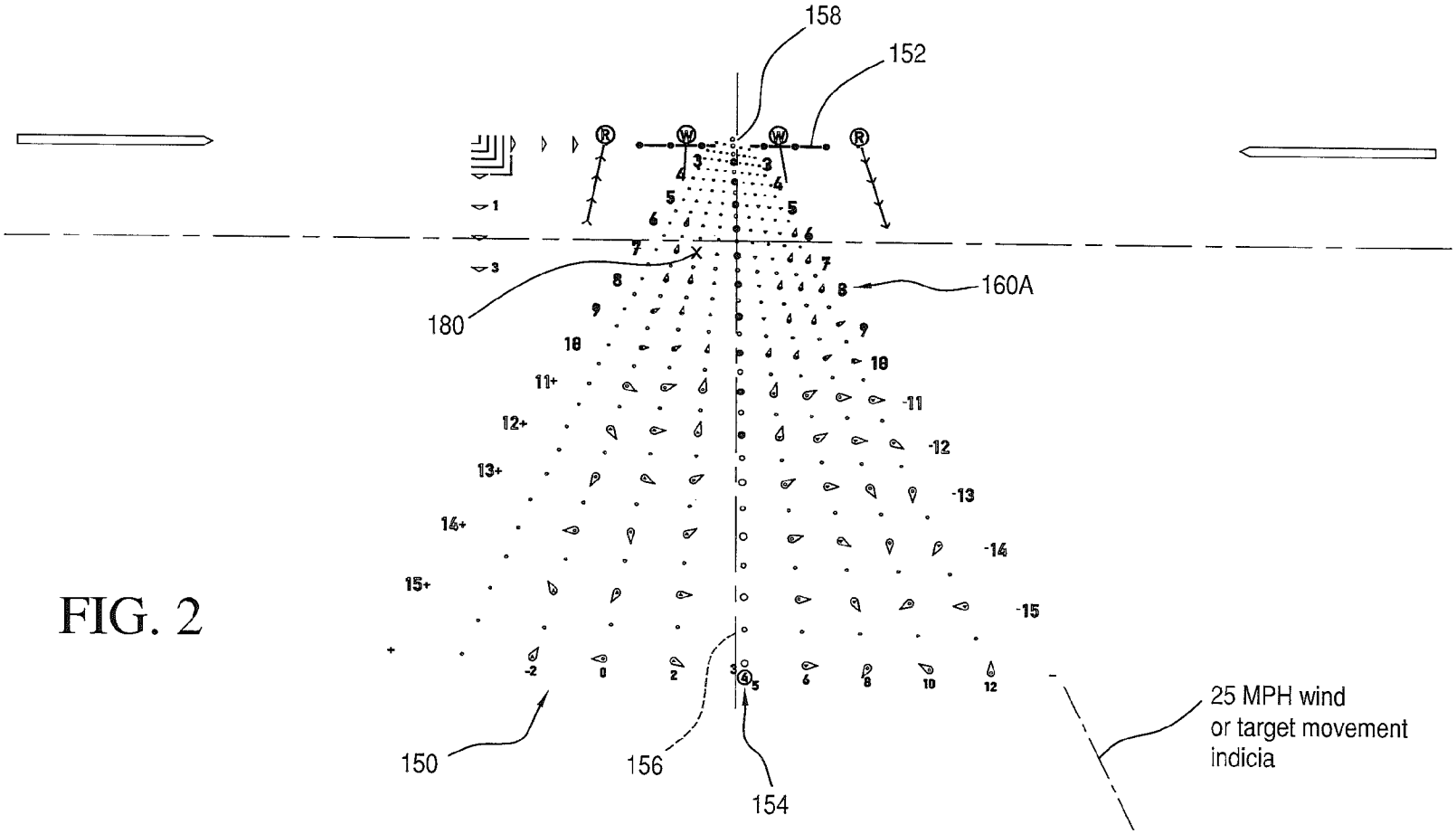
FIG. 2 illustrates a ballistic effect compensating system or reticle for use with an aim compensation method for rifle sights or projectile weapon aiming systems which is readily adapted for use with any projectile weapon, and especially with a rifle scope such as that illustrated in FIGS. 1A and 1B, in accordance with the method of the present invention.

The reticle of FIG. 2 preferably includes an aim point field 150 with a vertical reference or crosshair 156 and a horizontal crosshair 152 which intersect at a right angle and also includes a plurality of secondary windage adjustment axes (e.g., 160A) arrayed beneath horizontal crosshair 152. The windage adjustment axes (e.g., 160A) are angled downwardly at a shallow angle (e.g., five degrees, for a typical RH twist barrel), meaning that they are not secondary horizontal crosshairs each being perpendicular to the vertical crosshair 156. Instead, each windage axis defines an angled or sloped array of windage offset adjustment indicia (e.g., 260L-1 and 260R-1). If a windage axis line were drawn through all of the windage offset adjustment indicia corresponding to a selected range (e.g., 800 yards), that windage axis line would slope downwardly from horizontal at a small angle (e.g., five degrees), as illustrated in FIGS. 2, 3 and 4). In aim point field 150, at the 800 yard reference windage axis 160A, the right-most windage offset adjustment indicator (adjacent the "8" on the right) is one MOA below a true horizontal crosshair line and the left-most windage offset adjustment indicator (adjacent the "8" on the left) is one MOA above that true horizontal crosshair line. The effect of that slope is best seen by comparing FIGS. 3 and 4.

Figure 5:
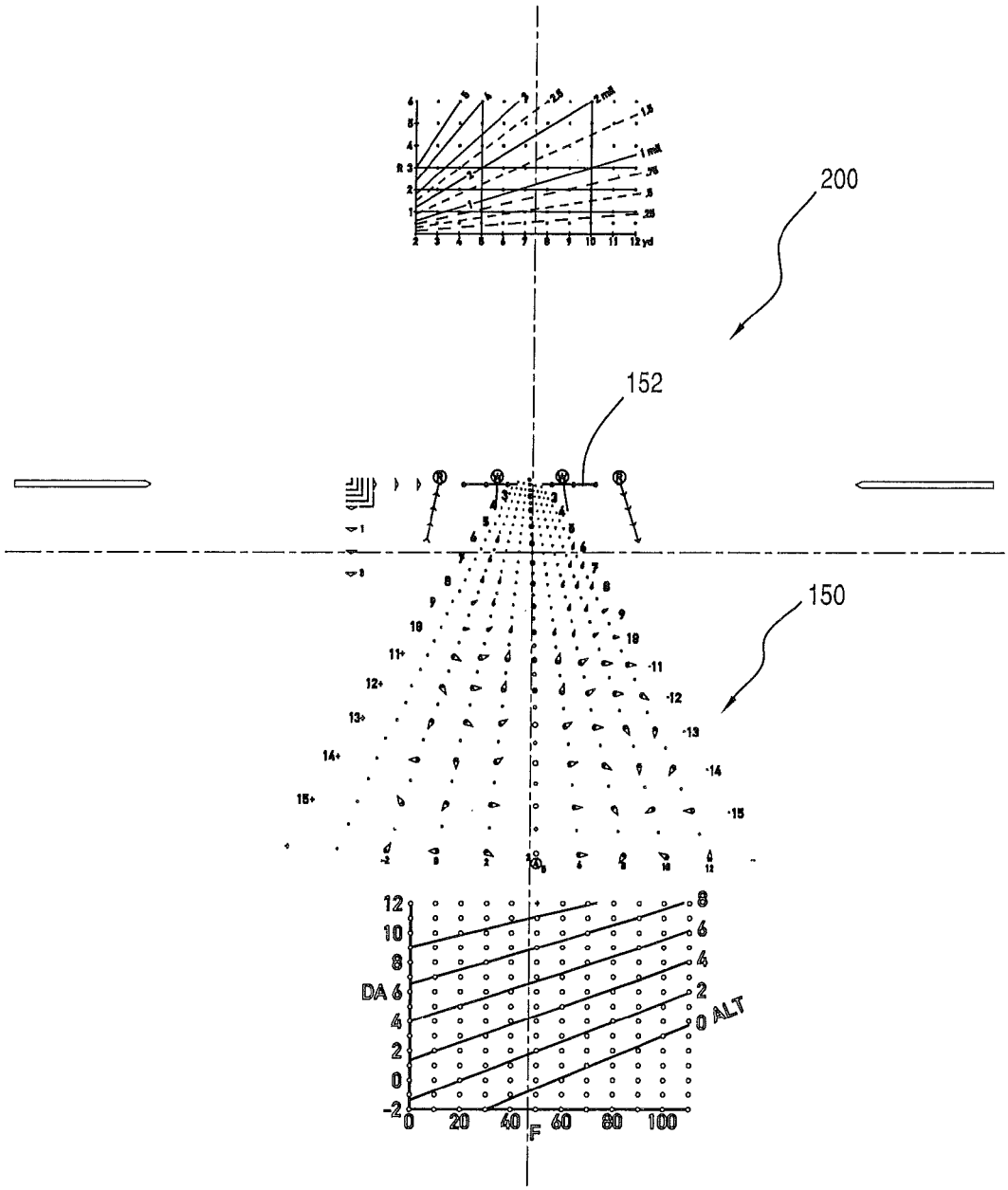
FIG. 5 illustrates a multi-nomograph embodiment of the ballistic effect compensating system and aim compensation method of FIGS. 2, 3 & 4, in accordance with the present invention.

As noted above, in order to plot observed COIs for projectiles affected by dissimilar wind drift, the windage offset adjustment indicia on each windage adjustment axis are not symmetrical about the vertical crosshair 156 or symmetrical around the array of elevation indicia or nearly vertical central aiming dot line 154. The nearly vertical central aiming dot line 154 provides a "no wind zero" for selected ranges (e.g., 100 to more than 1500 yards, as seen in FIGS. 2 and 5), and 10 mph windage offset adjustment indicator on the left side of substantially vertical central aiming dot line 354 is not spaced from central aiming dot line 154 at the same lateral distance as the corresponding (i.e., 10 mph) windage offset adjustment indicator on the right side of the vertical crosshair. Instead, the reticle and method of the present invention define differing windage offsets for (a) wind from the left (e.g. 260L-1) and (b) wind from the right (e.g. 260R-1). Again, those windage offsets refer to elevation adjustment axis 154 which diverges laterally from vertical crosshair 156. The elevation adjustment axis or central aiming dot line 154 defines the diverging array of elevation offset adjustment indicia for selected ranges (e.g., in 100 yard increments).

The projectile weapon aiming system reticle illustrated in FIG. 2 is configured to be seen by the user or shooter as being superimposed on an aiming area including the target or desired POA and the predicted COI for the user's projectile is described as a two-dimensional firing solution or Hold Point 180 expressed solely in (1) range (e.g., yards or meters) and (2) crosswind velocity (e.g., in MPH), when firing a known baseline or nominal projectile at a known baseline or nominal velocity, in a baseline or nominal environment having a known atmospheric density and over a Line of Sight ("LOS") trajectory which is substantially level. Additionally, reticle 200 and aim point field 150 provide graphic and computing indicia allowing the user to quickly correct the aiming Hold Point when required. Reticle 200 thus provides a visual prediction of the projectile's atmospheric condition dependent spin drift, crosswind jump and dissimilar crosswind drift, while travelling to the projectile's COI for a given target.

The external ballistic effects observed by the applicant are not anticipated in prior art reticles or aiming aids, but applicant's research into the scientific literature has provided some interesting insights. A scientific text entitled "Rifle Accuracy Facts" by H. R. Vaughn, and at pages 195-197, describes a correlation between gyroscopic stability and wind drift. An excerpt from another scientific text entitled "Modern Exterior Ballistics" by R. L. McCoy (with appended errata published after the author's death), at pages 267-272, describes a USAF scientific inquiry into what was called "Aerodynamic Jump" due to crosswind and experiments in aircraft.

Applicant's experiments have been evaluated in light of this literature and, as a result, applicant has developed a model for two external ballistics mechanisms which appear to be at work. The first mechanism is now characterized, for purposes of the system and method of the present invention, as "Crosswind Jump" wherein the elevation-hold or adjustment direction (up or down) varies, depending on whether the shooter is compensating for left crosswind (270°) or right crosswind (90°), and the present invention's adaptation to these effects is illustrated in FIGS. 2-5. Historically, aerial gunnery, an observed ballistic effect on a spin stabilized projectile's trajectory was observed from the effect of a transverse wind force. For example, when a right-hand spin is applied to a bullet in a rifled barrel, the emerging projectile is spinning rapidly about its own central axis, and when that bullet encounters a transverse or lateral crosswind from the right, the ballistic effect of that cross wind includes a small but measurable vertical or "jump" component, in addition to the expected lateral offset. Wind from the left causes an equal "drop." Military testing showed this in an extreme example. A 0.50 caliber M2 machine gun was fired from one aircraft directed toward a target being towed by another aircraft. Both aircraft were traveling on parallel paths (side by side) at a speed of 450 knots. At a distance of 400 feet (133 yards) the amount of vertical impact change was 40 inches! 450 knots is an extreme crosswind, but this effect is significant when firing a rifle in a left wind versus a right wind. These observations were used in the design of the B-17s K-13 machine gun sights. (From Modern Exterior Ballistics by Robert L. McCoy.)

The second mechanism (dubbed "Dissimilar Wind Drift" for purposes of the system and method of the present invention) was observed as notably distinct lateral offsets for windage, depending on whether a cross-wind was observed as left wind (270°) or right wind (90°). In long range precision marksmanship, the ballistic effect called "wind drift" is a lateral offset in flight path (compared to a "no-wind" trajectory) due to transverse wind forces bearing on the bullet during flight. Gyroscopically stabilized bullet trajectories have been observed to exhibit differing lateral offsets for transverse left and right winds of a given magnitude (e.g., for a 10 mph full value or true, steady wind). More plainly, the COIs for a right wind differ in a small but significant way from the COIs for a left wind for a gyroscopically stabilized bullet fired with a right hand or clockwise spin. A barrel with a right-hand rifling twist will drift a bullet laterally more in a right wind than in a left wind. The opposite is true for a rifle using a left-hand twist barrel. The vast majority of rifles in use have right-hand twist barrels. Referring now to FIGS. 3 and 4, the lateral offset for aimpoint indicia 260L-1 corresponds to a left wind (270°) at 10 mph and is spaced laterally farther from vertical crosshair 156 than the lateral offset for aimpoint indicia 260R-1 which corresponds to a right wind (90°) at 10 mph. FIGS. 3 and 4 provide easy to see examples of the effect illustrated by the windage offsets in the reticles of the present invention (e.g. 200, 300 or DTR reticle 700).

Referring now to FIGS. 6A and 6B, the aiming system and method of the present invention can also be used with traditional (e.g., mil-dot or MOA) reticles, permitting a shooter to compensate for a projectile's ballistic behavior while developing a firing solution. This would require some time consuming calculations, but a correction factor table is illustrated in FIG. 6A for use with a rifle firing a Superior Shooting System's 6XC Cartridge having a muzzle velocity of 2980 fps. FIG. 6A illustrates opposing sides of a two-sided placard 270 summarizing selected ballistics correction factors in a first and second tables for use with any projectile weapon including a rifle scope having a standard mil-dot reticle, for a specific cartridge, in accordance with the method of the present invention. This table is printable onto a portable card. For a right hand twist rifle with a 6XC projectile having gyroscopic stability of 1.75-2, the data reproduced in this table illustrates the Crosswind Jump effect which is believed to be proportional to true crosswind velocity acting on the projectile (using, e.g., 6 MPH increments for ¼ MOA). The second effect (Dissimilar Wind Drift) is reflected in the correction factors shown in the four columns on the left (one would initially consult the 10 mph crosswind reference). The spin drift effect is accounted for by dialing (left wind) in the yard line columns. The correction factor table illustrated in FIG. 6B is for use with a rifle firing the USGI M118LR Cartridge having a muzzle velocity of 2550 fps. FIG. 6B illustrates a placard 271 summarizing selected ballistics correction factors in a tables for use with any projectile weapon including a rifle scope having a standard mil-dot or MOA reticle, for M118LR, in accordance with the method of the present invention. Table 271 is printable onto a portable card which the shooter can use with a rifle scope having a traditional mil-dot or MOA reticle. For a right hand twist rifle with a SMK 175 Gr projectile having gyroscopic stability of 1.75-2, the data reproduced in this table illustrates the Crosswind Jump effect which is believed to be proportional to true crosswind velocity acting on the projectile (using, e.g., 5 MPH increments for ¼ MOA).

The marksman or shooter may bring along a personal or transportable computer-like device (not shown) such as a personal digital assistant ("PDA") or a smart phone (e.g., an iPhone™ or a Blackberry™) and that shooter's transportable computer-like device may be readily programmed with a software application (or "app") which has been programmed with the correction factors for the shooter' weapon system (e.g., using the correction factors of FIGS. 6A and 6B) and is thereby enabled to rapidly develop an accurate first round firing solution for selected ammunition when in the field.

Applicant's reticle system (e.g., 200, 300 or 700) permits the shooter to express and correct the aim point selection and the firing solution in range (e.g., yards) and crosswind velocity (MPH) rather than angles (minutes of angle or MILS). Additionally, the reticle aim point field (e.g., 150, 350 or 750) provides automatic correction for spin drift, crosswind jump and dissimilar crosswind drift. As a direct result of these unique capabilities, the shooter can develop precise long range firing solutions and determine aiming Hold Points faster than with any other reticle. The design goal was to create a telescopic sighting system that encompasses the following attributes:

1. A system that is very quick to use and allows for shots from point blank range to well beyond 1000 yards. Time element was a huge factor in this design. Time is what wins most engagements.

2. A system that does not require an auxiliary computer or data book which takes the shooter's attention away from the target and whose failure or loss would leave the shooter stranded.

3. A system that accommodates changing atmospheric conditions, allowing its use in any reasonable geographic location.

4. A system that provides the means to actually determine target range in yards, not just measure it in MILS or MOA.

5. A system that requires fewer mathematic calculations by the user.

6. A system that uses miles per hour (mph) for windage—no MILS or MOA conversion needed (call in mph, hold in mph).

7. A system that accounts for spin drift thus giving the user a true No Wind Zero at each central axis aiming dot.

8. A system that accounts for crosswind jump (lift) of the bullet as it undergoes crosswind deflection.

9. A system that accounts for dissimilar wind drift (DWD) (a right-hand wind will drift a right spinning bullet further than a left-hand wind).

10. A system that allows effective elevation hold points with no external corrections under all atmospheric conditions.

11. A system that allows the user to quickly and easily adapt to changes in ammunition or rifle system velocity or ammunition ballistic ("BC") properties by using DA correction factors which permit the user to make corrections quickly in units of distance (e.g., yards or meters) to find elevation hold points with no external corrections under all atmospheric conditions.

12. A system that allows rapid application of angle firing corrections denominated in distance units (e.g., yards or meters) for rapid correction of elevation hold points under all atmospheric conditions.

Meeting these goals was accomplished by employing two concepts:

(1) Providing a family of reticles which accommodate bullets with a specific ballistic coefficients ("BC") and muzzle velocities under any atmospheric conditions, and (2) Providing graphs in the reticle to facilitate most ranging and ballistic computations. This allows the user to make accurate compensations for varying shooting conditions without looking away from the scope. Graphs are powerful tools to display reference data and perform "no math" computations.

Figure 7:
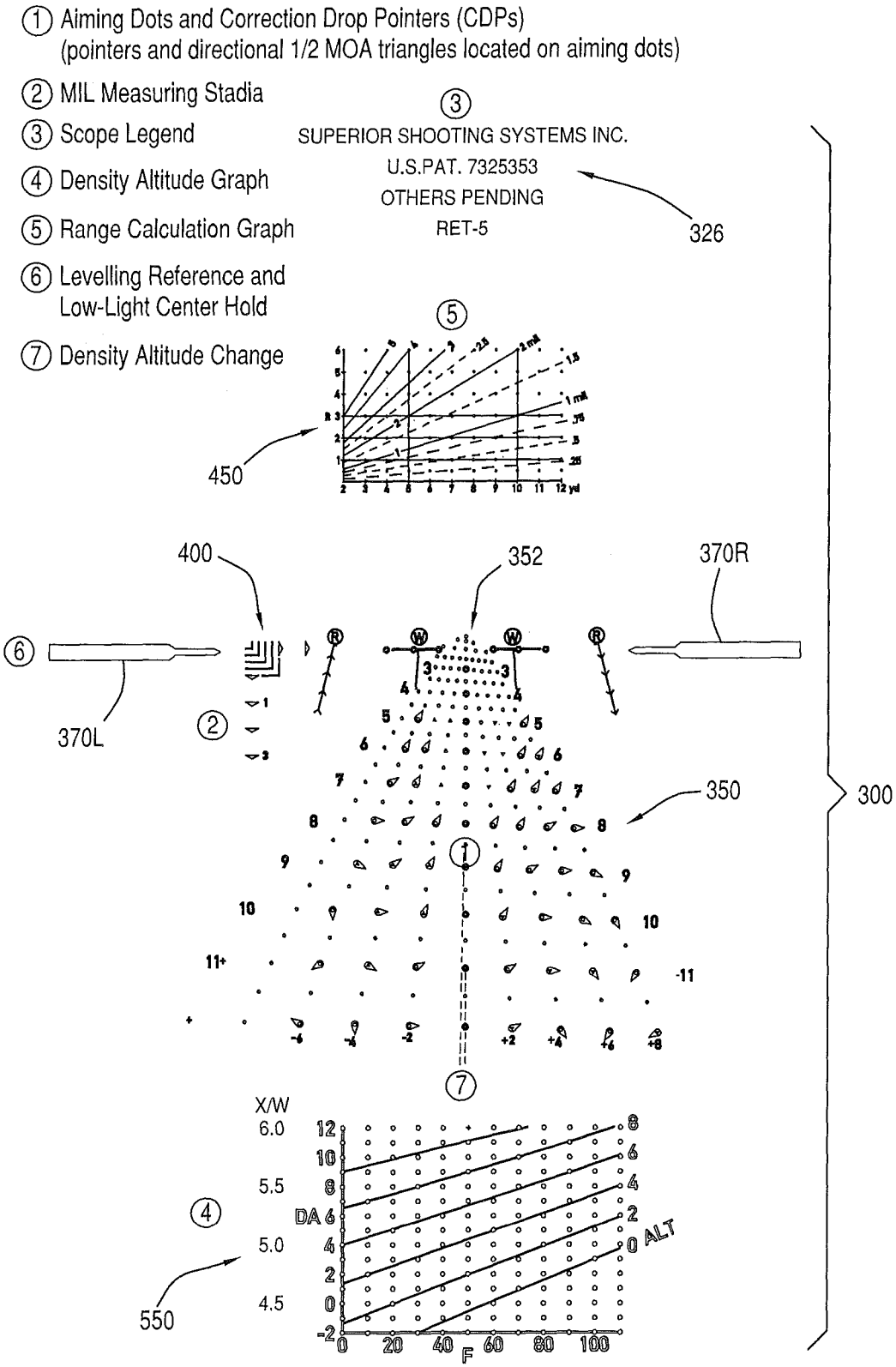
FIG. 7 illustrates a multiple nomograph ballistic effect compensating system or reticle for use with an aim compensation method for rifle sights or projectile weapon aiming systems which is readily adapted for use with any projectile weapon, and especially with a rifle scope such as that illustrated in FIGS. 1A and 1B, when firing a selected ammunition such as USGI M118LR 7.62 NATO long range ammunition, in accordance with the present invention.
Figure 8:
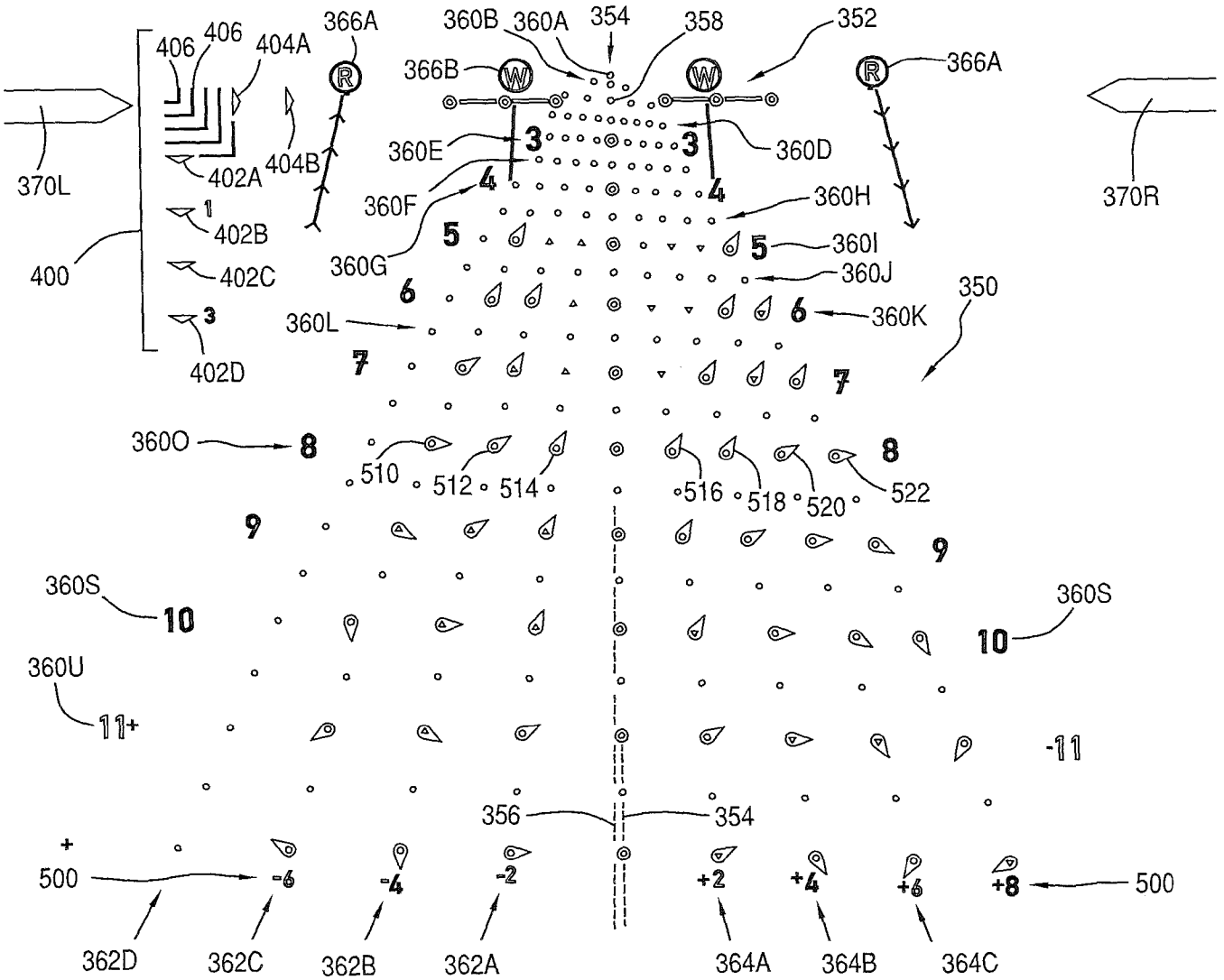
FIG. 8 illustrates the aim point field and horizontal crosshair aiming indicia array for the ballistic effect compensating system and reticle of FIG. 7, in accordance with the present invention.

The reticle and system of the present invention can also be used with the popular M118LR .308 caliber ammunition which is typically provides a muzzle velocity of 2565 FPS when fired from standard military rifles such as the M40, the M24 or the M110. Turning now to FIGS. 7 and 8, another embodiment of the reticle system and the method of the present invention 300 is configured for use in predict the COI for that Nominal or baseline ammunition fired from a specific rifle system (e.g., rifle 4, a US Army M24 or a USMC M40 variant). Reticle system 300 can also be used with a range of other ammunition by using pre-defined correction criteria, as set forth below. The data for the reticle aim point field 350 shown in FIGS. 7 and 8 was generated using a rifle was fitted with a RH twist barrel.

Reticle system 300 is similar in some respects to the reticle 200 of FIGS. 2-5. FIG. 7 illustrates a proximal, shooter's eye or objective lens view showing a scope legend 326 which preferably provides easily perceived indicia with information on the Nominal weapon system and ammunition as well as other NAV data for application when practicing the method of the present invention, as described below. Reticle system 300 preferably also includes a range calculation nomograph 450 as well as an air density or density altitude calculation nomograph 550. Reticle system 300 provides a two-dimensional array 350 of aiming indicia showing predicted Center of Impact (or "COI") for a user's projectile and the user expresses the firing solution solely in dimensions of distance and velocity. Reticle 300 is configured to be seen by the user or shooter as being superimposed on the aiming area including the target or desired POA and the predicted COI for the user's projectile is described as a two-dimensional firing solution expressed in (1) range (e.g., yards or meters) and (2) crosswind velocity (e.g., in MPH) and provides automatic correction for the projectile's atmospheric condition dependent spin drift, crosswind jump and dissimilar crosswind drift. If the shooter's Muzzle Velocity and Air Density (e.g., Density Altitude) match the selected nominal or baseline NAV values and the shooter is shooting on a flat or nearly flat range, all the shooter has to do is measure, estimate or "call" the range in yards (or meters) and call the wind in MPH (or KPH), then aim by placing the selected "Hold Point" (on or between selected aiming dot(s)) upon the center of the target or POA and release the shot. The reticle embodiments of the present invention provide a rapid point-and-shoot firing solution or Hold Point for targets located out to the maximum range of the shooter's projectile.

FIG. 8 provides a detailed view of an exemplary elevation and windage aim point field 350, with the accompanying horizontal and vertical angular measurement stadia 400 included proximate the horizontal crosshair aiming indicia array 352. The aim point field 350 is preferably incorporated in an adjustable scope reticle screen (e.g., such as 16), as the marksman uses the aim point field 350 for aiming at the target as viewed through the scope and its reticle. The aim point field 350 comprises at least the first horizontal line or crosshair 352 and a substantially vertical central aiming dot line or crosshair 354, which in the case of the field 350 is represented by a line of substantially or nearly vertical dots. A true vertical reference line 356 is shown on the aim point field 350 of FIG. 8, and may optionally comprise the vertical crosshair of the reticle aim point field 50, if so desired. As noted above, the array 350 of aiming indicia illustrate the predicted Center of Impact (or "COI") for a user's projectile and the user expresses the aimed Hold Point or firing solution solely in dimensions of distance (e.g., in yards) and velocity (e.g., in mph).

It will be noted that the substantially or nearly vertical central aiming dot line 354 is curved or skewed somewhat to the right of the true vertical reference line 356. As above, this deflection of the "no wind" indicia is to compensate for gyroscopic precession or "spin drift" of a spin-stabilized bullet or projectile in its trajectory. The exemplary (e.g., M24, M40 or M110) variant rifle barrels have "right twist" inwardly projecting rifling which spirals to the right, or clockwise, from the proximal chamber to the distal muzzle of the barrel. The rifling imparts a corresponding clockwise gyroscopically stabilizing spin to the standard M118LR 175 Grain Sierra Match King bullet (not shown). As the projectile or bullet travels an arcuate trajectory in its distal or down range ballistic flight between the muzzle and the target, the longitudinal axis of the bullet will deflect angularly to follow that arcuate trajectory. As noted above, the flying bullet's clockwise spin results in gyroscopic precession which generates a force that is transverse or normal (i.e., ninety degrees) to the arcuate trajectory, causing the bullet to deflect to the right. This effect is seen most clearly at relatively long ranges, where there is substantial arc to the trajectory of the bullet (e.g., as illustrated in FIG. 1E). The lateral offset or skewing of substantially vertical central aiming dot line to the right causes the user, shooter or marksman to aim or moving the alignment slightly to the left in order to position one of the aiming dots of the central line 354 on the target (assuming no windage correction). This has the effect of more nearly correcting for the rightward deflection of the bullet due to gyroscopic precession.

FIG. 8 also illustrates that horizontal crosshair aiming mark indicia array 352 and substantially vertical central aiming dot line 354 define a single aim point 358 at their intersection. The multiple aim point field 350, as shown, is formed of a series of sloped and non-horizontal secondary rows of windage aiming indicia which are not parallel to horizontal crosshair 352 (e.g., 360A, 360B, etc.) The secondary row aiming indicia are laterally spaced at intervals to provide aim points corresponding to selected crosswind velocities (e.g., 5 mph, 10 mph, 15 mph, 20 mph and 25 mph). The windage aiming indicia for each selected crosswind velocity are aligned along axes which are inwardly angled but generally vertical (spreading as they descend) to provide left side columns 362A, 362B, 362C, etc. and right side columns 364A, 364B, 364C, etc. The left side columns and right side columns comprise aiming indicia or aiming dots (which may be small circles or other shapes, in order to minimize the obscuration of the target). It will be noted that the uppermost horizontal row 360A actually comprises only a single dot each, and provides a relatively close aiming point (e.g., for close-in zeroing) at only one hundred yards. The aim point field 350 is configured for a rifle and scope system (e.g., 4) which has been "zeroed" (i.e., adjusted to exactly compensate for the drop of the bullet during its flight) at aim point 358, corresponding to a distance of two hundred yards, as evidenced by the primary horizontal crosshair array 352. Thus, a marksman aiming at a closer target must lower his aim to place his Hold Point slightly above the horizontal crosshair 352 (e.g., 360A or 360B), as relatively little drop occurs to the bullet in such a relatively short flight.

In FIG. 8, most of the horizontal rows, (e.g. rows 360E, 360F, 360G, down to row 360U, are numbered to indicate the range in hundreds of yards for an accurate shot using the indicia or dots of that particular row, designating ranges of 100 yards, 150 yards (for row 360B), 200 yards, 250 yards, 300 yards (row 360E), etc. The row 360S has a mark "10" to indicate a range of one thousand yards. It will be noted that the spacing between each horizontal row (e.g., 360A, 360B . . . 360S, 360U), gradually increases as the range to the target becomes longer and longer. This is due to the slowing of the bullet and increase in vertical speed due to the acceleration of gravity during its flight. The alignment and spacing of the horizontal rows more effectively compensates for these factors, such that the COI and particularly the vertical impact point of the bullet will be more accurately predicted at any selected range. After row 360U, for 1100 yards, the rows are no longer numbered, as a reminder that beyond 1100 Yards, it is estimated that the M118LR projectile has slowed into the transonic or subsonic speed range, where accuracy is likely to diminish in an unpredictable manner.

The nearly vertical columns 362A, 362B, 364A, 364B, etc., spread as they extend downwardly to greater and greater ranges, but not symmetrically, due to the external ballistics factors including Crosswind Jump and Dissimilar Crosswind Drift, as discussed above. These nearly vertical columns define aligned angled columns or axes of aim points configured to provide an aiming aid permitting the shooter to compensate for windage, i.e. the lateral drift of a bullet due to any crosswind component. As noted above, downrange crosswinds will have an ever greater effect upon the path of a bullet with longer ranges. Accordingly, the vertical columns spread wider, laterally, at greater ranges or distances, with the two inner columns 362A and 364A being closest to the column of central aiming dots 354 and being spaced to provide correction for a five mile per hour crosswind component, the next two adjacent columns 362B, 364B providing correction for a ten mile per hour crosswind component, etc.

In addition, when shooting at a moving target, the Hold Point must be corrected to provide with a "lead," somewhat analogous to the lateral correction required for windage. The present scope reticle includes approximate lead indicators 366B (for slower walking speed, indicated by the "W") and 366A (farther from the central aim point 358 for running targets, indicated by the "R"). These lead indicators 366A and 366B are approximate, with the exact lead depending upon the velocity component of the target normal to the bullet trajectory and the distance of the target from the shooter's position.

As above, in order to use the elevation and windage aim point field 350 of FIGS. 7 and 8, the marksman must have a reasonably close estimate or measurement of the range to the target. An estimate is provided by means of the evenly spaced horizontal and vertical angular measurement stadia 400 disposed upon aim point field 350. The stadia 400 comprise a vertical row of stadia alignment markings 402A, 402B, etc., and a horizontal row of such markings 404A, 404B, etc. It will be noted that the horizontal markings 404A, etc. are proximate to and disposed along the horizontal reference line or crosshair 352, but this is not required; the horizontal marks could be placed at any convenient location on reticle 300. Each adjacent mark, e.g. vertical marks 402A, 402B, etc. and horizontal marks 404A, 404B, etc., are evenly spaced from one another and subtend precisely the same angle therebetween, e.g. one mil, or a tangent of 0.001. Other angular definition may be used as desired, e.g. the Minute of Angle ("MOA") system discussed in the Related Art further above. Any system for defining relatively small angles may be used, so long as the same system is used consistently for both the stadia 400 and the distance v. angular measurement nomograph 450.

Figure 10:
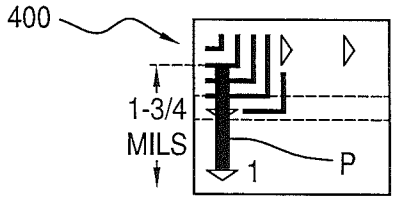
FIG. 10 illustrates an example for using the Mil Stadia range estimation graphic in the reticle of FIGS. 7 and 8 for the projectile weapon aiming system Reticle and aim compensation method of the present invention.
Figure 11:
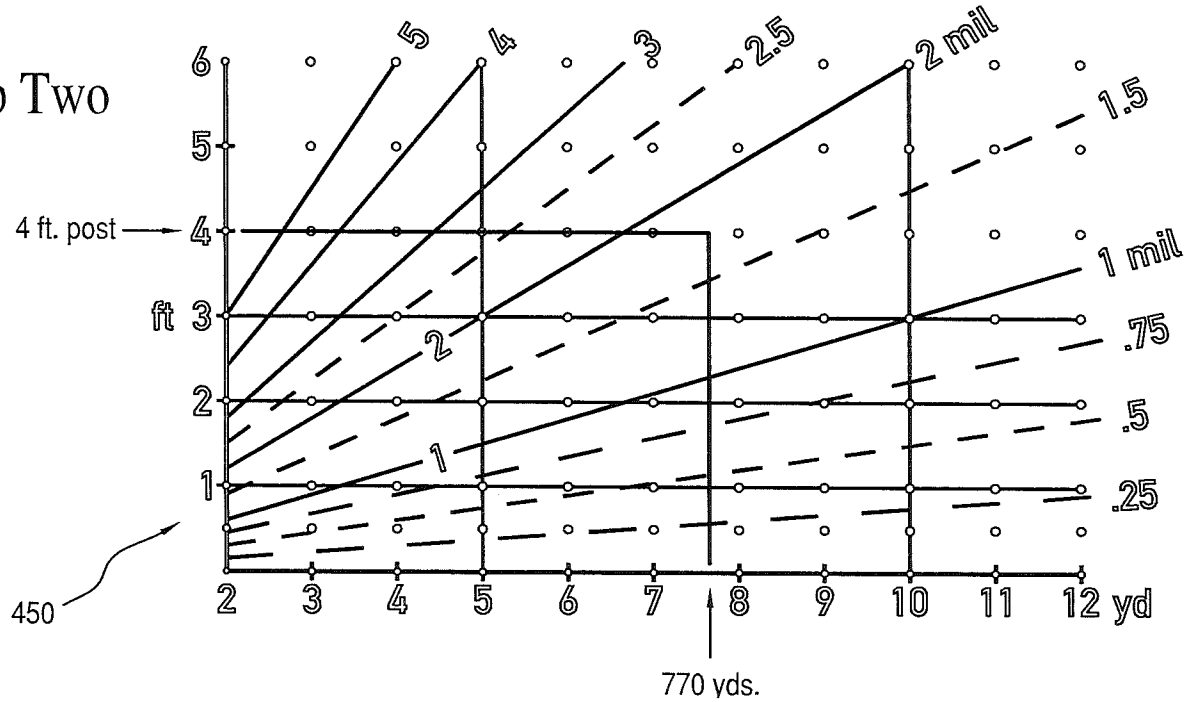
FIG. 11 illustrates the visual method calculating range using the range calculation graph to range the object shown in FIG. 10, when using the reticle of FIGS. 7 and 8, in accordance with the present invention.

Referring to FIGS. 10 and 11, the stadia system 400 is used by estimating some dimension of the target, or of an object close to the target. For example, a shooter or hunter may note that the game being sought (e.g., a Coyote) is standing near a fence line having a series of wood fence posts. The hunter knows or recognizes that the posts are about four feet tall, from prior experience. (Alternatively, he could estimate some dimension of the game, e.g. height, length, etc., but larger dimensions, e.g. the height of the fence post, are easier to gauge.) The hunter places the top of a post P (shown in broken lines along the vertical marks 402A, 402B) within the fractional mil marks 406 of the stadia 400, and adjusts the alignment of the firearm and scope vertically to place the base of the post P upon a convenient integer alignment mark, e.g. the second mark 402B. The hunter then knows that the post P subtends an angular span of one and three quarter mils, with the base of the post P resting upon the one mil mark 402B and the top of the post extending to the third of the quarter mil marks 406. The horizontal mil marks 404A, etc., along with the central aim point 358 positioned between the two horizontal marks are used similarly for determining a horizontal angle subtended by an object.

It should be noted that each of the stadia markings 402 and 404 comprises a small triangular shape, rather than a circular dot or the like, as is conventional in scope reticle markings. The polygonal stadia markings of the present system place one linear side of the polygon (preferably a relatively flat triangle) normal to the axis of the stadia markings, e.g. the horizontal crosshair 352. This provides a precise, specific alignment line, i.e. the base of the triangular mark, for alignment with the right end or the bottom of the target or adjacent object, depending upon whether the length or the height of the object is being ranged. Conventional round circles or dots are subject to different procedures by different shooters, with some shooters aligning the base or end of the object with the center of the dot, as they would with the sighting field, and others aligning the edge of the object with one side of the dot. It will be apparent that this can lead to errors in subtended angle estimation, and therefore in estimating the distance to the target.

Referring back to FIG. 8, the bottom of aim point field 350 includes a density correction graphic indicia array 500 comprising a plurality of density altitude adjustment change factors (e.g., "−2" for column 362A, "−4" for column 362B, "−6" for column 362C, "+2" for column 364A, and "+4" for column 364B, and these are for use with the tear-drop shaped Correction Drop Pointers (e.g., 510, 512, 514, 516, 518, 520, 522, as seen aligned along the 800 Yard array of windage aiming points 360-0). Each of the density correction drop pointers (e.g., 510, 512, etc) provides a clock-hour-hand like pointer which corresponds to an imaginary clock face on the aim point field 350 to designate whole numbers of MOA correction values. Aim point field 350 also includes aim points having correction pointers with an interior triangle graphic inside the correction drop pointer (e.g., 518) indicating the direction for an added ½ or 0.5 MOA correction on the hold (e.g., when pointing down, dial down or hold low by ½ MOA).

Figure 9A:
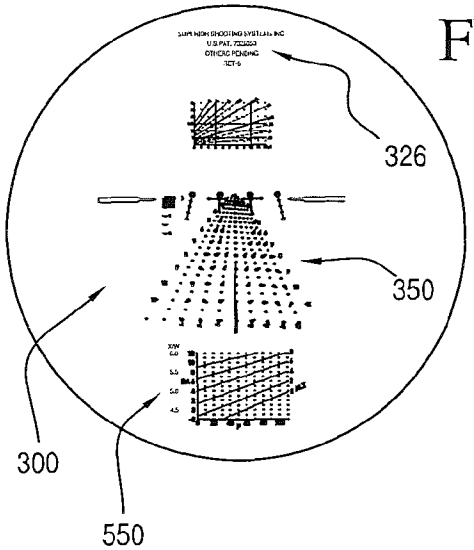
FIG. 9A illustrates the position and orientation and graphic details of the Air Density calculation nomograph included as part of reticle system of FIG. 7, when viewed at the lowest magnification setting, in accordance with the present invention.
Figure 9B:
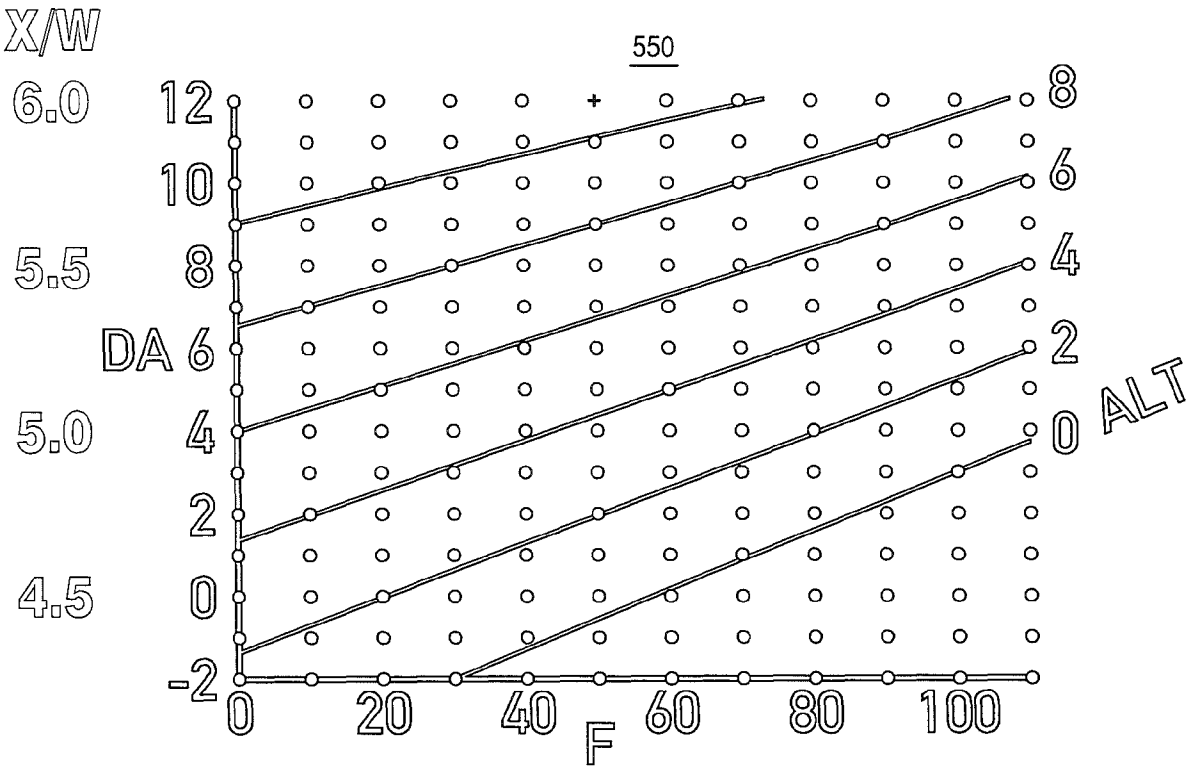
FIG. 9B illustrates orientation and graphic details of the Air Density calculation nomograph of FIGS. 7, and 9A, in accordance with the present invention.

Reticle 300 of FIG. 8 represents a much improved aid to precision shooting over long ranges, such as the ranges depicted in FIG. 1E, where air density plays an increasingly significant role in accurate aiming. Air density affects drag on the projectile, and lower altitudes have denser atmosphere. At a given altitude or elevation above sea level, the atmosphere's density decreases with increasing temperature. FIGS. 9A and 9B illustrate the position, orientation and graphic details of the Density Altitude calculation nomograph 550 included as part of reticle system 300. The crosswind (XW) values to the left of the DA graph indicate the wind hold (dot or triangle) value at the corresponding DA for the shooter's location. For example, X/W value "5" is 5 mph at 4000 DA or 4K DA. X/W value "5.5" is 5.5 mph at 8000 DA or 8K DA (adding ½ mph to the wind hold). X/W value "4.5" is 4.5 mph at 2000 DA or 2K DA (subtracting ½ mph from the wind hold). The mph rows of correction drop pointers in aim point field 350 are used to find corresponding corrections for varying rifle and ammunition velocities. Velocity variations for selected types of ammunition can be accounted for by selecting an appropriate DA number.

DA represents "Density Altitude" and variations in ammunition velocity can be integrated into the aim point correction method by selecting a lower or higher DA correction number, and this part of the applicant's new method is referred to as "DA Adaptability". This means that family of reticles having a given Nominal DA for use with a Nominal ammunition defines an NAV or baseline configuration. A reticle system (e.g., 300 having a selected NAV is readily used when firing a number of different bullets. This particular example is for the USGI M118LR ammunition, which is a .308, 175 gr. Sierra™ Match King™ bullet, modeled for use with a rifle having scope 2.5 inches over bore centerline and a 100 yard zero. It has been discovered that the bullet's flight path will match the reticle at the following NAV or baseline combinations of muzzle velocities and air densities:

2 k DA=2625 FPS and 43.8 MOA at 1100 yards
3 k DA=2600 FPS and 43.8 MOA at 1100 yards
4 k DA=2565 FPS and 43.6 MOA at 1100 yards
5 k DA=2550 FPS and 43.7 MOA at 1100 yards
6 k DA=2525 FPS and 43.7 MOA at 1100 yards 1100 yard come-ups were used since this bullet is still above the transonic region. Thus, the reticle's density correction graphic indicia array 500 can be used with Density Altitude Graph 550 to provide the user with a convenient method to adjust or correct the selected aim point for a given firing solution when firing using different types of ammunition or in varying atmospheric conditions with varying air densities.

Figure 1F:
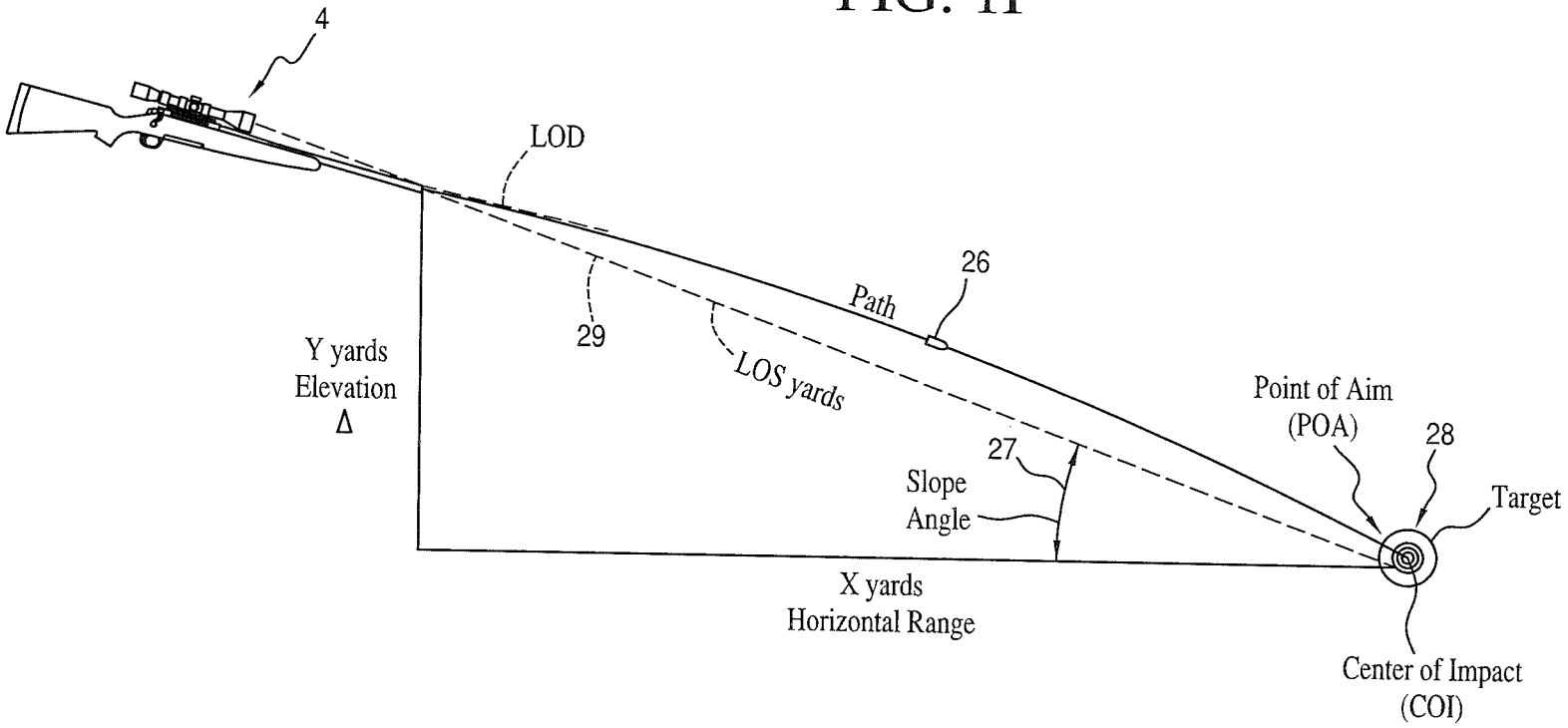
FIG. 1F is an Angle Firing trajectory chart which illustrates the trajectory of a selected projectile fired downwardly along a sloped or angled Line of Sight at a POA or target found at a lower elevation.

The reticle system of the present invention also includes two methods for compensating in the Angle Firing situation illustrated in FIG. 1F. Angle Firing is shooting uphill or downhill at a ballistically significant angle above or below a horizontal or level reference. As noted above, in uphill or downhill Angle Firing, the length or distance covered by the "cosine" or purely horizontal range component (corresponding to the adjacent side of a right triangle formed by a target, a shooter and a vertical reference point above or below the shooter). For example, if shooter and rifle are above the target by an elevation difference of "Y" (e.g. in yards or meters) and shooting downhill at a resultant "Slope Angle", then the horizontal range or distance "X" covered by the projectile (e.g. in yards or meters) is given by:

$$X=\cos(\text{Slope Angle})\times(\text{LOS Range}) \quad \text{(Eq. 1)}$$

The horizontal or "cosine" range X is always less than the LOS Range and so the bullet's ballistic "drop" over the angled trajectory is less than would be for a shot fired across level ground (where X equals LOS Range), and the relationship described in eq. 1 is true whether the target is uphill or downhill from the shooter.

Figures 12, 13:
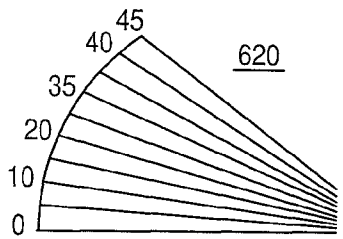
FIGS. 12 and 13 illustrate first and second sides of a transportable placard having an uphill-downhill slope angle graphic estimator for cosine range computation and summarizing selected ballistics correction factors in a table for use with a projectile weapon including a rifle scope having a standard mil-dot reticle, for a specific cartridge, in accordance with the method of the present invention.

In accordance with the method and system of the present invention, each user is provided with a placard or card 600 for each scope which defines the changes to the Hold Point for use in Reticle 300 at 100 yard intervals. When the user sets up their rifle system, they chronograph their rifle and pick the Density Altitude which matches rifle velocity. Handloaders have the option of loading to that velocity to match the main reticle value. These conditions which result in a bullet path that matches the reticle is referred to throughout as the Nominal, NAV or baseline conditions. The scope legend, viewed by zooming back to the minimum magnification, shows the model and revision number of the reticle from which can be determined the NAV conditions which match the reticle. FIGS. 12 and 13 illustrate two sides of a transportable placard 600 having an angle firing graphic estimator 620 for cosine range computation and summarizing selected ballistics correction factors in a table for use with any projectile weapon including a rifle scope having the Reticle System of the present invention (e.g., 300) or a standard mil-dot reticle, for a specific cartridge, in accordance with the method of the present invention. Placard 600 has tables with Angle Firing threshold ranges (e.g., between 300 and 1500 yards and an angle estimating graphic 620 has a radial array of angled lines designating reference angles from zero degrees to 45 degrees for use in estimating an Angle Firing Slope Angle (e.g., 27).

In accordance with the method of the present invention, if a target is within a selected Angle Firing threshold range (e.g., between 300 and 1000 yards, then the angle estimating graphic 620 is viewed and compared to the Slope Angle (e.g., 27). The shooter or user estimates slope angle and then consults placard 600 to determine the ballistically significant Horizontal Range or Cosine range "X". The user then corrects the previous aiming Hold Point or firing solution by using the Horizontal Range from the table, so, for example, if the Hold Point was 702 yards (which may be rounded to 700) and the Slope Angle is estimated to be 40 degrees, the user can easily determine that the effective Hold Point range should be estimated at 560 Yards.

Figure 14:
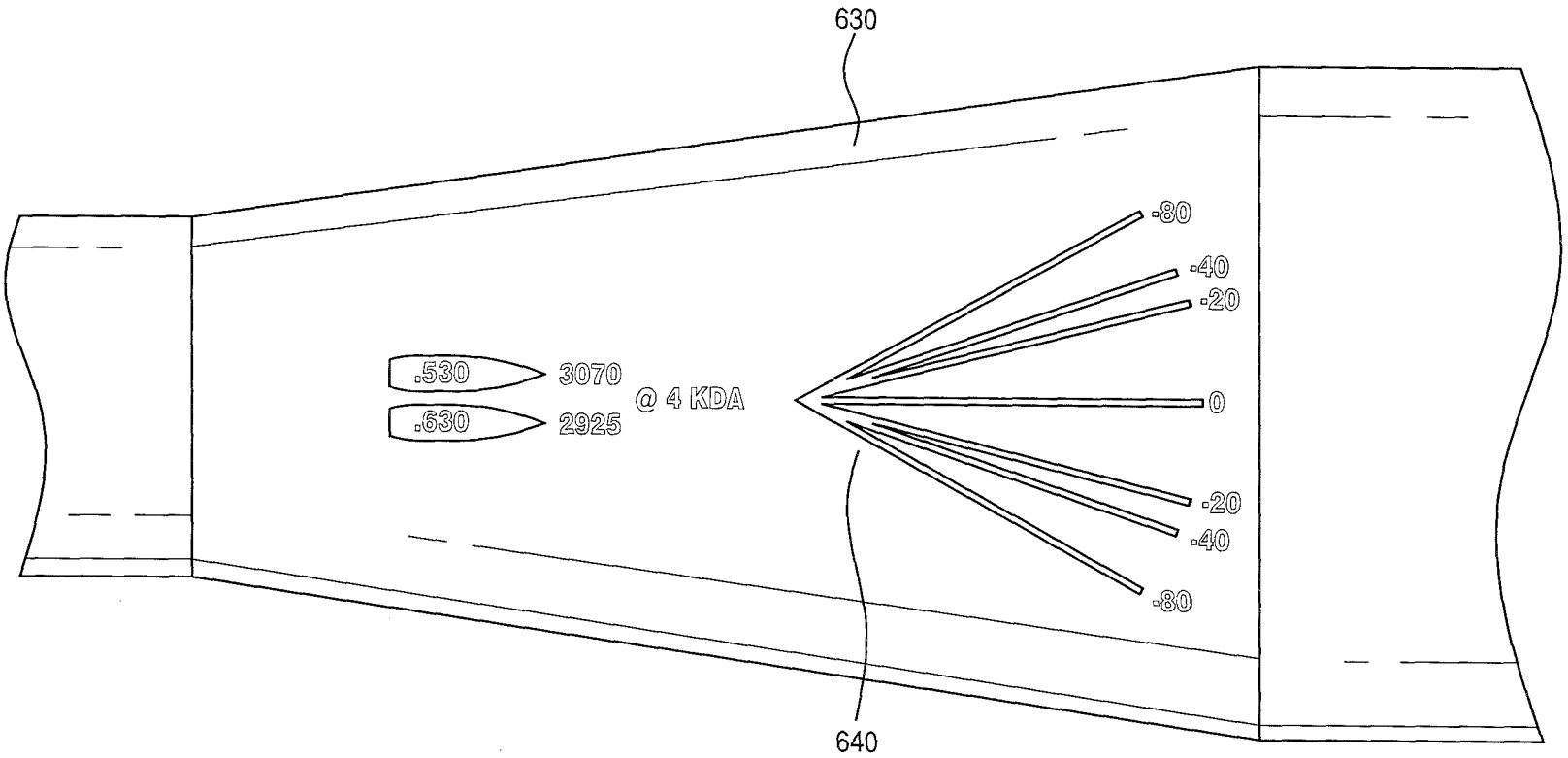
FIG. 14 illustrates the right side of a riflescope having an Angle Firing graphic with selected Hold Closer Distance indicia for selected slope angles, for use with a projectile weapon using a specific cartridge, in accordance with the method of the present invention.
Figure 15:
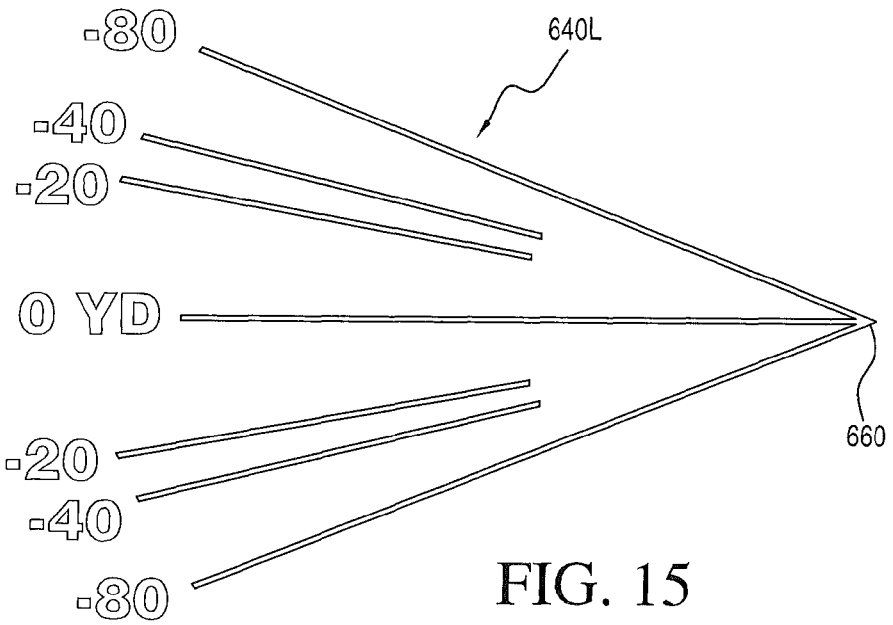
FIG. 15 illustrates a left side Angle Firing graphic with selected Hold Closer Distance indicia for selected slope angles, for use with a projectile weapon using a specific cartridge, in accordance with the method of the present invention.
Figure 16:
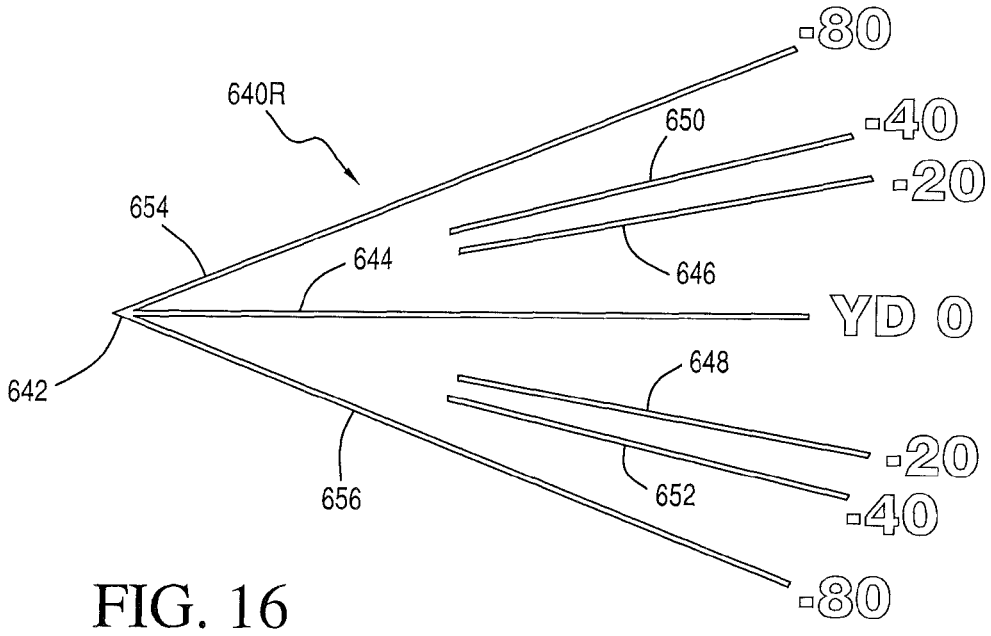
FIG. 16 illustrates a right side Angle Firing graphic with selected Hold Closer Distance indicia for selected slope angles, for use with a projectile weapon using a specific cartridge, in accordance with the method of the present invention.

A second, quicker method is also made available when using the system of the present invention. FIGS. 14-16 illustrates a method and another set of graphic aids for use in rapidly developing an aiming Hold Point in an Angle Firing situation which does not require a separate estimate of slope angle 27. FIG. 14 illustrates a rifle scope 630 having an right side external sidewall surface upon which is printed a right side Hold Closer Distance graphic 640 comprising an array of seven linear sighting lines which intersect at and project radially away from a proximal origin. A central, distally projecting reference line is aligned to be substantially parallel with the rifle scope's central axis and is marked "0" for "hold closer" distance. A first pair of angled sighting lines at a selected angle (e.g., 15 degrees) on opposing sides of reference line "0" are the inner upper and lower hold closer sighting lines marked "20" for "hold closer" distance. A second pair of angled sighting lines outside of the first angled sighting lines on opposing sides of reference line "0" project at a greater angle (e.g., 20 degrees) than the first pair of angled sighting lines and are the medial hold closer sighting lines marked "40" for "hold closer" distance. A third pair of outer angled sighting lines outside of the medial angled sighting lines on opposing sides of reference line "0" project at a greater angle (e.g., 30 degrees) than the medial pair of angled sighting lines and are the outer hold closer sighting lines marked "80" for "hold closer" distance. In each case, the hold closer distance marking corresponds to a distance having units which match the units in the user's reticle (e.g., 200, 300 or 700).

FIG. 16 also illustrates a right side Hold Closer Distance graphic 640A comprising an array of seven linear sighting lines aligned on axes which intersect at and project radially away from a proximal origin 642. Right side graphic 640R could be affixed to the right side of a Rifle scope or firearm stock. Right side graphic 640R comprises a central, distally projecting reference line 644 is aligned to be substantially parallel with the rifle scope's central axis and is marked "0" for "hold closer" distance. A first pair of angled (e.g., 15 degrees) sighting lines on opposing sides of reference line "0" are the inner upper 646 and lower 648 hold closer sighting lines marked "20" for "hold closer" distance. A second pair of angled sighting lines 650, 652 are arrayed outside of the first angled sighting lines 646, 648 on opposing sides of reference line "0" and project at a greater angle (e.g., 20 degrees) than the first pair of angled sighting lines and are the medial hold closer sighting lines marked "40" for "hold closer" distance. A third pair of outer angled sighting lines 654, 656 arrayed outside of the medial angled sighting lines on opposing sides of reference line "0" project at a greater angle (e.g., 30 degrees) than the medial pair of angled sighting lines and are the outer hold closer sighting lines marked "80" for "hold closer" distance. Here again, the hold closer distance marking corresponds to a distance having units which match the units in the user's reticle (e.g., 200, 300 or 700).

FIG. 15 illustrates a similar graphic aid configured as a left right side Hold Closer Distance graphic 640L comprising an array of seven linear sighting lines having axes which intersect at and project radially away from a proximal origin 660. Left side graphic 640L could be affixed to the left side of a Rifle scope or firearm stock. As above, a central, distally projecting reference line is aligned to be substantially parallel with the rifle scope's central axis and is marked "0" for "hold closer" distance. A first pair of angled (e.g., 15 degrees) sighting lines on opposing sides of reference line "0" are the inner upper and lower hold closer sighting lines marked "20" for "hold closer" distance. A second pair of angled (e.g., 20 degrees) sighting lines outside of the first angled sighting lines on opposing sides of reference line "0" project at a greater angle than the first pair of angled sighting lines and are the medial hold closer sighting lines marked "40" for "hold closer" distance. A third pair of outer angled sighting lines outside of the medial angled sighting lines on opposing sides of reference line "0" project at a greater angle (e.g., 30 degrees) than the medial pair of angled sighting lines and are the outer hold closer sighting lines marked "80" for "hold closer" distance. As above, the sighting line's markings (e.g., 20, 40 or 80) indicate a distance or range (e.g., in yards or meters) which may be subtracted from a Measured or LOS range or from a DA adjusted hold point elevation selection, defined in the same distance or range units (e.g., in yards or meters) as the units in the user's reticle (e.g., 200, 300 or 700).

As noted above, the reticles of the present invention are configured for use in nominal or NAV conditions, including a substantially level Line of Sight to the target. An initial aiming Hold Point (e.g., 180) is selected and that Hold Point has a range component (e.g., 702 Yards). In the method of the present invention, when angle firing, the user first determines whether the range to the target is enough to make the Slope Angle Ballistically Significant (e.g., is slope angle 27 large enough?) For each Reticle system, the Nominal or NAV ammunition's ballistic performance is evaluated and the user is instructed that Angle Firing need not be considered at any range below the minimum range in the selected Angle Firing threshold range (e.g., between 300 and 1000 yards). If the target is beyond the minimum range, the user may quickly and easily sight along a selected Hold Closer Distance graphic (e.g., 640R) while looking along the Line of Sight to the Target and determine which of the Hold Closer Sighting Lines (e.g., 654*m* marked "80") most nearly points to the horizon or is most nearly level. The user then corrects the previous aiming Hold Point or firing solution by simply "Holding closer" by 80 yards or subtracting the identified Hold Closer Reference (e.g., 80) from the Hold Point, so, for example, if the Hold Point elevation or range was 702 yards (which may be rounded to 700) and the center reference line 644 pointed along the Line of Sight to the target showed the upper reference line 654 was most nearly pointed at the horizon, the user can easily determine that the Hold Point should be reduced by 80 Yards to very quickly provide an estimated Effective Hold Point of 620 Yards.

Figure 17:
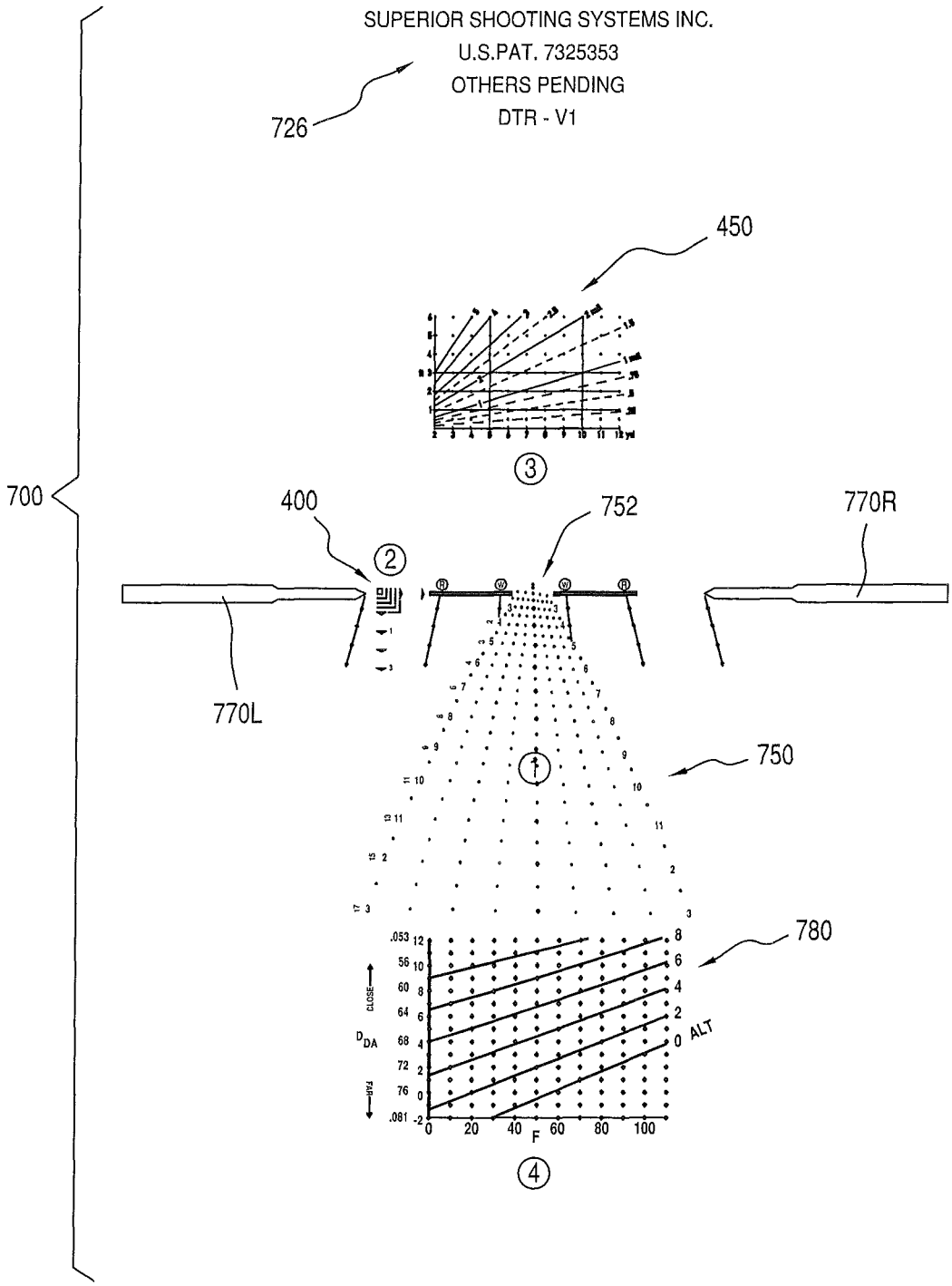
FIG. 17 illustrates another multiple nomograph ballistic effect compensating system or reticle for use with an aim compensation method for rifle sights or projectile weapon aiming systems which is readily adapted for use with any projectile weapon, and especially with a rifle scope such as that illustrated in FIGS. 1A and 1B, when firing a selected ammunition such as USGI M118LR long range ammunition, in accordance with the present invention.
Figure 18:
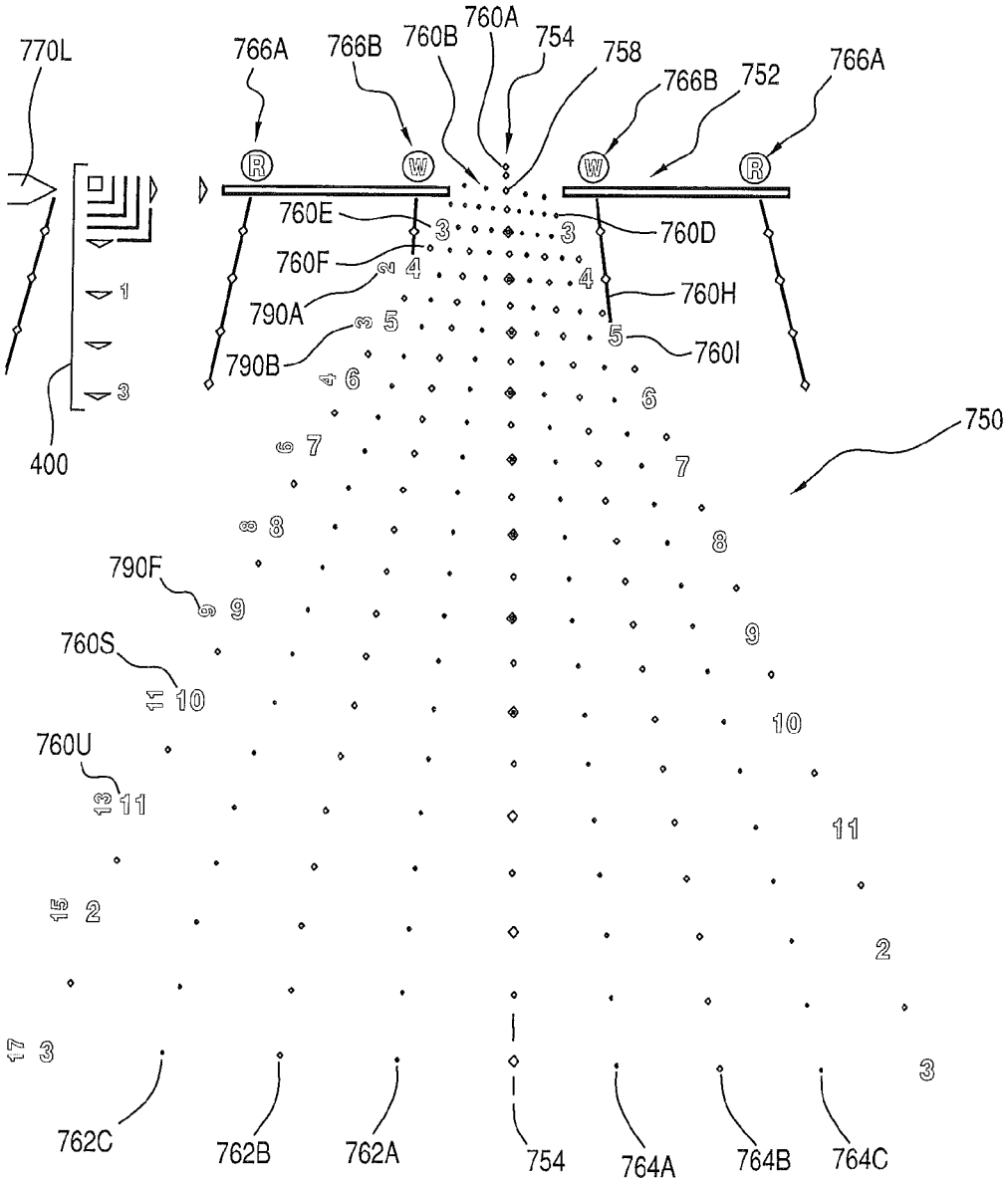
FIG. 18 illustrates enlarged detail for the aim point field and horizontal crosshair aiming indicia array for the ballistic effect compensating system and reticle of FIG. 17, in accordance with the present invention.
Figure 19:
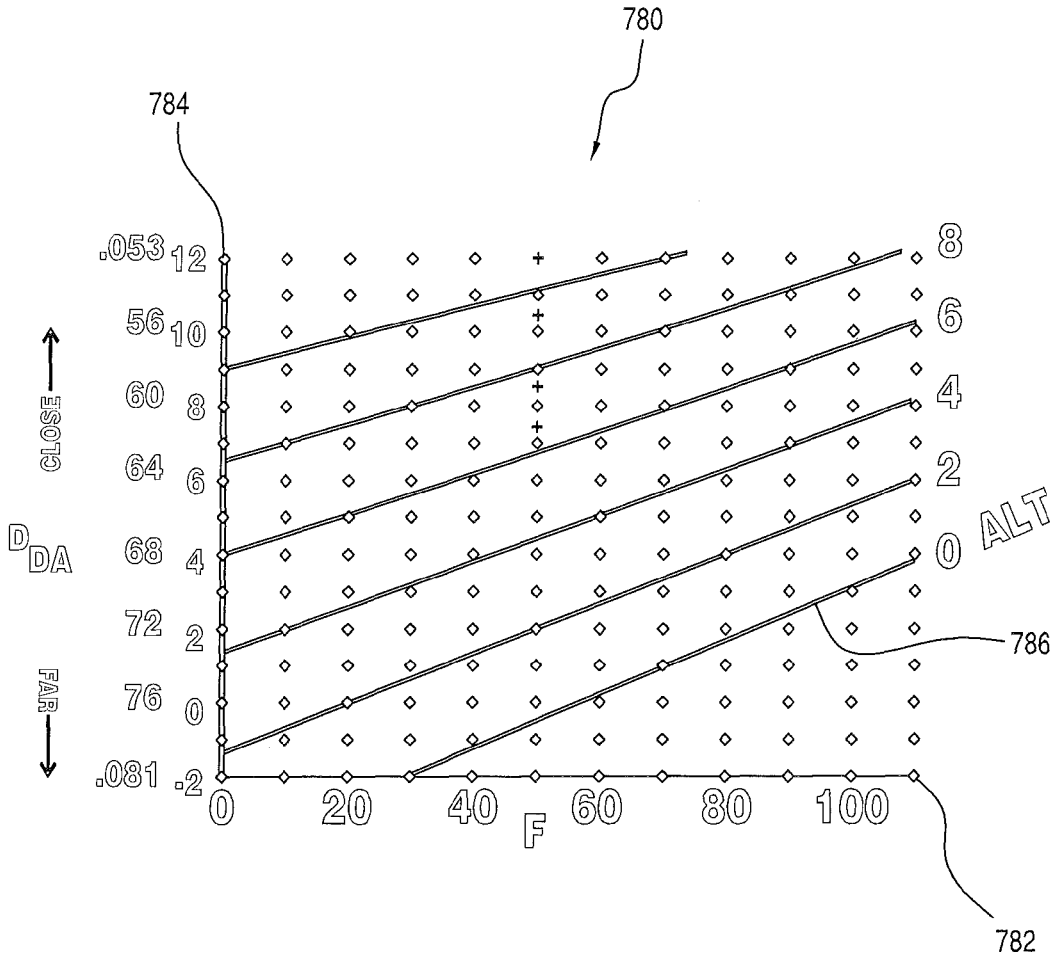
FIG. 19 illustrates enlarged detail for the Air Density Graph of FIG. 17 which enables an adequate estimation of the air density in either of two units, DA (Density Altitude) and Du (Density Unit), in accordance with the present invention.

FIGS. 17, 18 and 19 illustrate another reticle system embodiment 700 providing a two-dimensional array of aiming indicia showing predicted Center of Impact (or "COI") for a user's projectile and, as above, in use, the user expresses the Hold Point or firing solution solely in dimensions of distance and velocity. Reticle system 700 is called the Dynamic Targeting Reticle (or "DTR") and this embodiment is also configured to be seen by the user or shooter as being superimposed on the aiming area including the target or desired POA and the predicted COI for the user's projectile. The DTR reticle automatically does much to ease the computation burden on the user, marksman or shooter. If the shooter's Nominal or NAV Muzzle Velocity and Air Density (e.g., Density Altitude) match the NAV or baseline values and the shooter is shooting on a flat or nearly flat range, all the shooter has to do is measure, estimate or "call" the range in yards (or meters) and call the wind in MPH (or KPH), then aim by placing the selected "Hold Point" (on or between selected aiming dot(s)) upon the center of the target or POA and release the shot. The reticle embodiments of the present invention provide a rapid point-and-shoot firing solution or Hold Point for targets located out to the maximum range of the shooter's projectile.

Turning now to FIGS. 17 and 18, reticle system 700 is configured for use in predict the COI for that Nominal, NAV or baseline ammunition fired from a specific rifle system (e.g., rifle 4, a US Army M24, a USMC M40 or an M110 variant). Reticle system 300 can also be used with a range of other ammunition by using pre-defined correction criteria, as set forth below. The data for the reticle aim point field 750 shown in FIGS. 17 and 18 was generated using a rifle was fitted with a RH twist barrel.

Reticle system 700 is similar in some respects to the reticle 300 of FIGS. 7-8. FIG. 17 illustrates a proximal, shooter's eye or objective lens view showing a scope legend 726 which preferably provides easily perceived indicia with information on the Nominal weapon system and ammunition as well as other NAV data for application when practicing the method of the present invention, as described below. Reticle system 700 preferably also includes the range calculation nomograph 450 as well as an air density or density altitude calculation nomograph 780. Reticle system 700 provides a two-dimensional array 750 of aiming indicia showing predicted Center of Impact (or "COI") for a user's projectile and the user expresses the firing solution solely in dimensions of distance and velocity. Reticle 700 is configured to be seen by the user or shooter as being superimposed on the aiming area including the target or desired POA and the predicted COI for the user's projectile is described as a two-dimensional firing solution expressing elevation in range (e.g., yards or meters) and (2) windage in crosswind velocity (e.g., in MPH) and provides automatic correction for the projectile's atmospheric condition dependent spin drift, crosswind jump and dissimilar crosswind drift. If the shooter's Muzzle Velocity and Air Density (e.g., Density Altitude) match the selected nominal or baseline NAV values and the shooter is shooting on a flat or nearly flat range, all the shooter has to do is measure, estimate or "call" the range in yards (or meters) and call the wind in MPH (or KPH), then aim by placing the selected "Hold Point" (on or between selected aiming dot(s)) upon the center of the target or POA and release the shot. The reticle embodiments of the present invention provide a rapid point-and-shoot firing solution or Hold Point for targets located out to the maximum range of the shooter's projectile.

FIG. 18 provides a detailed view of an exemplary elevation and windage aim point field 750, with the accompanying horizontal and vertical angular measurement stadia 400 included proximate the horizontal crosshair aiming indicia array 752. The aim point field 750 is preferably incorporated in an adjustable scope reticle screen (e.g., such as 16), as the marksman uses the aim point field 750 for aiming at the target as viewed through the scope and its reticle. The aim point field 750 comprises at least the first horizontal line or crosshair 752 and a substantially vertical central aiming dot line or crosshair 754, which in the case of the field 750 is represented by a line of substantially or nearly vertical dots. An optional true vertical reference line (not shown) on the aim point field 750 may optionally comprise a vertical crosshair depending perpendicularly from horizontal array 753 from central aim point 758, if so desired. As noted above, the array 750 of aiming indicia illustrate the predicted Center of Impact (or "COI") for a user's projectile and the user expresses the aimed Hold Point or firing solution solely in dimensions of distance (e.g., in yards) and velocity (e.g., in mph).

It will be noted that the substantially or nearly vertical central aiming dot line or axis 754 is curved or skewed somewhat to the right of the true vertical reference line (not shown). As above, this deflection of the "no wind" indicia axis 754 is to compensate for gyroscopic precession or "spin drift" of a spin-stabilized bullet or projectile in its trajectory. The exemplary (e.g., M24, M40 or M110) variant rifle barrels have "right twist" inwardly projecting rifling which spirals to the right, or clockwise, from the proximal chamber to the distal muzzle of the barrel. The rifling imparts a corresponding clockwise gyroscopically stabilizing spin to the standard M118LR 175 Grain Sierra Match King ("SMK") bullet (not shown). As noted above, the flying bullet's clockwise spin results in gyroscopic precession which generates a force that is transverse or normal (i.e., ninety degrees) to the arcuate trajectory, causing the bullet to deflect to the right. This effect is seen most clearly at relatively long ranges, where there is substantial arc to the trajectory of the bullet (e.g., as illustrated in FIG. 1E). The lateral offset or skewing of substantially vertical central aiming dot line to the right causes the user, shooter or marksman to aim or moving the alignment slightly to the left in order to position one of the aiming dots of the central line 754 on the target (assuming no windage correction). This has the effect of more nearly correcting for the rightward deflection of the bullet due to gyroscopic precession.

FIG. 18 also illustrates that horizontal crosshair aiming mark indicia array 752 and substantially vertical central aiming dot line 754 define the single central aim point 758 at their intersection. The multiple aim point field 750, as shown, is formed of a series of sloped and non-horizontal secondary rows of windage aiming indicia which are not parallel to horizontal crosshair 752 (e.g., 760A, 760B, etc.) The secondary row aiming indicia are laterally spaced at intervals to provide aim points corresponding to selected crosswind velocities (e.g., 5 mph, 10 mph, 15 mph and 20 mph). The windage aiming indicia for each selected crosswind velocity are aligned along axes which are inwardly angled but generally vertical (spreading as they descend) to provide left side columns 762A, 762B, 762C, etc, and right side columns 764A, 764B, 764C, etc. The left side columns and right side columns comprise aiming indicia or aiming dots (which may be small circles or other shapes, in order to minimize the obscuration of the target). It will be noted that the uppermost horizontal row 760A actually comprises only a single dot each, and provides a relatively close aiming point (e.g., for close-in zeroing) at one hundred yards. The aim point field 750 is configured for a rifle and scope system (e.g., 4) which has been "zeroed" (i.e., adjusted to exactly compensate for the drop of the bullet during its flight) at aim point 758, corresponding to a distance of two hundred yards, as evidenced by the primary horizontal crosshair array 752. Thus, a marksman aiming at a closer target must lower his aim to place his Hold Point slightly above the horizontal crosshair 752 (e.g., 760A or 760B), as relatively little drop occurs to the bullet in such a relatively short flight.

In FIG. 18, most of the horizontal rows, (e.g. rows 760E, 760F, 760G, down to row 760U, are numbered to indicate the range in hundreds of yards for an accurate shot using the indicia or dots of that particular row, designating ranges of 100 yards, 150 yards (for row 760B), 200 yards, 250 yards, 300 yards (row 760E), etc. The row 760S has a mark "10" to indicate a range of one thousand yards. It will be noted that the spacing between each horizontal row (e.g., 760A, 760B . . . 760S, 760U), gradually increases as the range to the target becomes longer and longer. This is due to the slowing of the bullet and increase in vertical speed due to the acceleration of gravity during its flight. The alignment and spacing of the horizontal rows more effectively compensates for these factors, such that the COI and particularly the vertical impact point of the bullet will be more accurately predicted at any selected range. After row 760U, for 1100 yards, the rows are numbered differently, as a visual reminder that beyond 1100 Yards, it is estimated that the M118LR projectile has slowed into the transonic or subsonic speed range, where accuracy is likely to diminish in an unpredictable manner.

The nearly vertical columns 762A, 762B, 764A, 764B, etc., spread as they extend downwardly to greater and greater ranges, but not symmetrically, due to the external ballistics factors including Crosswind Jump and Dissimilar Crosswind Drift, as discussed above. These nearly vertical columns define aligned angled columns or axes of aim points configured to provide an aiming aid permitting the shooter to compensate for windage, i.e. the lateral drift of a bullet due to any crosswind component. As noted above, downrange crosswinds will have an ever greater effect upon the path of a bullet with longer ranges. Accordingly, the vertical columns spread wider, laterally, at greater ranges or distances, with the two inner columns 762A and 764A being closest to the column of central aiming dots 754 and being spaced to provide correction for a five mile per hour crosswind component, the next two adjacent columns 7628, 764B providing correction for a ten mile per hour crosswind component, etc.

As noted above, when shooting at a moving target, the Hold Point must be corrected to provide with a "lead," somewhat analogous to the lateral correction required for windage. Thus reticle 700 has approximate lead indicators 766B (for slower walking speed, indicated by the "W") and 766A (farther from the central aim point 758 for running targets, indicated by the "R"). These lead indicators 766A and 766B are approximate, with the exact lead depending upon the velocity component of the target normal to the bullet trajectory and the distance of the target from the shooter's position.

As above, in order to use the elevation and windage aim point field 750 of FIGS. 17 and 18, the marksman must have a reasonably close estimate or measurement of the range to the target. An estimate is provided by means of the evenly spaced horizontal and vertical angular measurement stadia 400 disposed upon aim point field 750. Any system for defining relatively small angles may be used, so long as the same system is used consistently for both the stadia 400 and the distance v. angular measurement nomograph 450.

FIG. 19 illustrates enlarged detail for the Air Density Graph 780 incorporated in Reticle 700. Air Density graph 780 is a two axis nomograph having a horizontal scale 782 graduated in temperature indicia (e.g., 0 degrees F. to 110 degrees F. and a vertical scale 784 graduated in Air Density indicia in two types of units, DA (Density Altitude) and Du (Density Unit). A plurality (e.g., six) of angled altitude lines 786 are drawn for every 2000 feet of elevation from sea level to 10,000 feet above sea level. The density of sea level air at 59° F. (0 KDA) is shown as 76 Du and density of air at 4,000 ft. and 43° F. is shown as 4 KDA or 68 Du, in accordance with the present invention. Air Density Graph 780 is located below the aiming dots in Reticle 700 and is visible when the user zooms back to minimum power. To use Air Density graph 780, the user locates the current temperature along the bottom axis (in degrees Fahrenheit) then looks straight UP until seeing the current or local geographical elevation above sea level (SL) as depicted by the angled altitude lines 786, so the user just interpolates to estimate the local elevation. Next, the user looks straight across to the left axis 784 to read the air density in either density altitude (DA, thousands of feet) or in true density in pounds per cubic foot of air, Du. In the early mornings the air will be more dense because the air temperature is lower. Then as the temperature increases the Density Altitude will increase, while true air density will decrease. The air density should be determined prior to getting ready to shoot and should be monitored throughout the day. As a general rule, for every 15 degrees temperature=+/−1 KDA move in Air Density.

DTR Reticle 700 thus includes an especially easy way to correct for differing environmental (e.g., Air Density) and operational (e.g., differing Ammunition) circumstances. As best seen in FIG. 18, along the left angled edge of the aiming dot field 750, just outside of selected range indicators, there are a series of numbers oriented 90 degrees counter clockwise, and these are the Density or ADC Correction numbers (or "ADC#") 790A, 7908, . . . 790F, etc). Each ADC# indicates an air density correction factor to be applied when the shooter needs to account for a momentary local Air Density condition differing from the Nominal or NAV conditions for the user's reticle system (e.g., 700). Here again, we note that for reticle system 700, a set of velocity-based assigned or baseline system and environmental characteristics are identified. In DTR reticle 700 the reticle system is designed to predict the COI for a nominal or baseline projectile (e.g., a .308 175Gr Sierra® Match King™ BTHP bullet) fired from a rifle providing a nominal or baseline muzzle velocity (e.g., 2575 FPS) for use at a nominal or baseline Density Altitude (e.g., 4K DA), and the user can easily account for variations in muzzle velocity for a given projectile by assigning a new nominal or baseline DA (e.g., for 2600 FPS, 3K DA provides nearly the same predicted COI at 1100 yards).

Returning to the Air Density graph 780 and ADC Correction numbers (or "ADC#") 790A, 790B, . . . 790F, etc), a user can make changes during an engagement which will compensate for changes in air density due to, for example, changing temperatures. If the local air density is substantially different than the NAV for which the user's rifle system is configured, the bullet path will not match the reticle; the point of impact will be higher in less dense air and lower in heavier air. The reticle provides Air Density Corrections (ADCs 790A, 790B, etc) that are easy to use. The ADCs are range-dependent density corrections located immediately to the left of the range numbers on the left side of the reticle. They stand out visually because they are sideways (i.e., rotated clockwise 90 degrees). Each ADC value (790A, 790B, etc) is the compensation in yards for the error caused by the air being one thousand feet of Density Altitude from the Nominal Assignment. The ADC value (which is a distance, e.g., in yards) is then either added to or subtracted from the Horizontal Range (or LOS Range) in order to determine the corrected Effective Hold Point. In use, for a 1 KDA difference, the correction is found by subtracting the ADC value from the LOS Range if the local air is less dense than Nominal to determine the corrected Effective Hold Point. Conversely, if the local air is more dense than Nominal, the correction is found by adding the ADC to the LOS Range to determine the corrected Effective Hold Point.

In accordance with the method of the present invention, generally, Air Density Correction uses the range dependent factor ("ADC#") to calculate a corrected Hold Point or single point designating a corrected aiming or firing solution within a reticle system's two dimensional array of aiming indicia (e.g., 750 elevation in yards and left or right windage in mph). The ADC correction is used to change the original Hold Point which compensates for changes from Nominal conditions arising from a differing Air Density or a difference in the selected projectile's ballistic performance. For example, when a current local air density ("CDA") is less than a Reticle system's Nominal air density ("NDA") by a ballistically significant magnitude, the elevation of the Hold Point "YD" is corrected by reducing the elevation estimate, to compensate for reduced drag and bullet drop in the local environment's thinner atmosphere. The Effective or Density Corrected Hold Point is calculated from the following equation:

$$YD=(NDA-CDA)\times ADC\# \quad \text{(Eq. 2)}$$

Reticle system 700 can also be used with other Ammunition, by using an estimating method called "Density Adaptability" which describes the practice of using DA equivalent changes in ballistic performance to select unique Effective Hold Points when using ammunition that is not the Nominal (or NAV) ammunition for a given Reticle System. If, for example, a user changes from a Nominal ammunition (e.g., US M118LR) to another ammunition (e.g., US M80), a new DA value (e.g. 4 DA) is assigned to the new ammunition at a new nominal velocity (e.g., 2740 FPS) as well. If the new ammunition's ballistic performance dictates that the new projectile will slow to transonic velocities at a shorter range than for the NAV ammunition, then a shorter the Maximum range for the DA adaptive Hold Point is identified (e.g., 900 yards) and, when aiming, the Hold Point is corrected to provide a new DA Adaptive Effective Hold Point which allows the user to characterize changed ammunition performance as equivalent to a changed local environment's ballistic effect.

Experienced long range marksmen and persons having skill in the art of external ballistics as applied to long range precision shooting will recognize that the present invention makes available a novel ballistic effect compensating reticle system (e.g., 200, 300 or 700) for rifle sights or projectile weapon aiming systems adapted to provide a field expedient firing solution for a selected projectile, comprising: (a) a multiple point elevation and windage aim point field (e.g., 150, 350 or 750) including a primary aiming mark (e.g., 158, 358 or 758) indicating a primary aiming point adapted to be sighted-in at a first selected range (e.g., 200 yards); (b) the aim point field including a nearly vertical array of secondary aiming marks (e.g., 154, 354 or 754) spaced progressively increasing incremental distances below the primary aiming point and indicating corresponding secondary aiming points along a curving, nearly vertical axis intersecting the primary aiming mark, the secondary aiming points positioned to compensate for ballistic drop at preselected regular incremental ranges beyond the first selected range for the selected projectile having pre-defined ballistic characteristics; and (c) the aim point field also includes a first array of windage aiming marks (e.g., 260L-1 and 260 R-1) spaced apart along a secondary non-horizontal axis 160A intersecting a first selected secondary aiming point (e.g., corresponding to a selected range); (d) where the first array of windage aiming marks includes a first windage aiming mark spaced apart to the left of the vertical axis (260L-1) at a first windage offset distance from the vertical axis selected to compensate for right-to-left crosswind of a preselected first incremental velocity at the range of said first selected secondary aiming point, and a second windage aiming mark (260R-1) spaced apart to the right of the vertical axis at a second windage offset distance from the vertical axis selected to compensate for left-to-right crosswind of said preselected first incremental velocity at said range of said first selected secondary aiming point; (e) wherein said first array of windage aiming marks define a sloped row of windage aiming points (e.g., as best seen in FIG. 4) having a slope which is a function of the direction and velocity of said projectile's stabilizing spin or a rifle barrel's rifling twist rate and direction, thus compensating for said projectile's crosswind jump; and (f) the reticle thereby facilitating aiming compensation for ballistics and windage for two crosswind directions at a first preselected incremental crosswind velocities, at a first preselected incremental range corresponding to said first selected secondary aiming point.

In the illustrated embodiments, the ballistic effect compensating reticle (e.g., 200, 300 or 700) has several arrays of windage aiming marks which define a sloped row of windage aiming points having a negative slope which is a function of the right-hand spin direction for the projectile's stabilizing spin or a rifle barrel's right-hand twist rifling, thus compensating for the projectile's crosswind jump and providing a more accurate "no wind zero" for any range for which the projectile remains supersonic (meaning that the projectile's velocity has not slowed into the transonic velocity range).

The ballistic effect compensating reticle (e.g., 200, 300 or 700) has each secondary aiming point intersected by a secondary array of windage aiming marks (e.g., 360E or 760E) defining a sloped row of windage aiming points having a slope which is a function of the direction and velocity of said projectile's stabilizing spin or a rifle barrel's rifling twist rate and direction, and that sloped row of windage aiming points are spaced for facilitating aiming compensation for ballistics and windage for two or more preselected incremental crosswind velocities (e.g., 5, 10, 15, 20 and 25 mph), at the range of the corresponding secondary aiming point (e.g., 300 yards for windage aiming mark array 360E). In the illustrated embodiment, each sloped row of windage aiming points includes windage aiming marks positioned to compensate for leftward and rightward crosswinds of 10 miles per hour and 20 miles per hour at the range of the secondary aiming point corresponding to said sloped row of windage aiming points, and at least one of the sloped row of windage aiming points is bounded by laterally spaced distance indicators.

Preferably, at least one of secondary arrays of windage aiming marks (e.g., 760I) is proximate an Air Density or projectile ballistic characteristic adjustment indicator (e.g., 790B) such that ADC density correction indicia (e.g., ADC Value "3") and the air density or projectile ballistic characteristic adjustment indicia is an Density Altitude (DA) correction indicator (permitting use of Equation 2, supra).

Generally, the ballistic effect compensating reticle (e.g., 200, 300 or 700) defines a nearly vertical array of secondary aiming marks (e.g., 154, 354 or 754) indicating corresponding secondary aiming points along a curving, nearly vertical axis are curved in a direction that is a function of the direction of said projectile's stabilizing spin or a rifle barrel's rifling direction, thus compensating for spin drift. The primary aiming mark (e.g., 358) is formed by an intersection of a primary horizontal sight line (e.g., 352) and the nearly vertical array of secondary aiming marks indicating corresponding secondary aiming points along the curving, nearly vertical axis. The primary horizontal sight line includes preferably a bold, widened portion (370L and 370R) located radially outward from the primary aiming point, the widened portion having an innermost pointed end located proximal of the primary aiming point. The ballistic effect compensating reticle preferably also has a set of windage aiming marks spaced apart along the primary horizontal sight line 352 to the left and right of the primary aiming point to compensate for target speeds corresponding to selected leftward and rightward velocities, at the first selected range.

Ballistic effect compensating reticle aim point field (e.g., 150, 350 or 750) preferably also includes a second array of windage aiming marks spaced apart along a second non-horizontal axis intersecting a second selected secondary aiming point; and the second array of windage aiming marks includes a third windage aiming mark spaced apart to the left of the vertical axis at a third windage offset distance from the vertical axis selected to compensate for right-to-left crosswind of the preselected first incremental velocity (e.g., 10 mph) at the range of said second selected secondary aiming point (e.g., 800 yards), and a fourth windage aiming mark spaced apart to the right of the vertical axis at a fourth windage offset distance from the vertical axis selected to compensate for left-to-right crosswind of the same preselected first incremental velocity at the same range, and the second array of windage aiming marks define another sloped row of windage aiming points having a slope which is also a function of the direction and velocity of said projectile's stabilizing spin or a rifle barrel's rifling twist rate and direction, thus compensating for the projectile's crosswind jump. In addition, the ballistic effect compensating reticle's aim point field also includes a third array of windage aiming marks spaced apart along a third non-horizontal axis intersecting a third selected secondary aiming point, where the third array of windage aiming marks includes a fifth windage aiming mark spaced apart to the left of the vertical axis at a fifth windage offset distance from the vertical axis selected to compensate for right-to-left crosswind of the preselected first incremental velocity at the range of said third selected secondary aiming point, and a sixth windage aiming mark spaced apart to the right of the vertical axis at a sixth windage offset distance from the vertical axis selected to compensate for left-to-right crosswind of said preselected first incremental velocity at said range of said third selected secondary aiming point; herein said second array of windage aiming marks define another sloped row of windage aiming points having a slope which is also a function of the direction and velocity of said projectile's stabilizing spin or a rifle barrel's rifling twist rate and direction, thus compensating for crosswind jump.

The ballistic effect compensating reticle (e.g., 200, 300 or 700) may also have the aim point field's first array of windage aiming marks spaced apart along the second non-horizontal axis to include a third windage aiming mark spaced apart to the left of the vertical axis at a third windage offset distance from the first windage aiming mark selected to compensate for right-to-left crosswind of twice the preselected first incremental velocity at the range of said second selected secondary aiming point, and have a fourth windage aiming mark spaced apart to the right of the vertical axis at a fourth windage offset distance from the second windage aiming mark selected to compensate for left-to-right crosswind of twice said preselected first incremental velocity at said range of said selected secondary aiming point. Thus the third windage offset distance is greater than or lesser than the fourth windage offset distance, where the windage offset distances are a function of or are determined by the direction and velocity of the projectile's stabilizing spin or a rifle barrel's rifling twist rate and direction, thus compensating for the projectile's Dissimilar Wind Drift. The ballistic effect compensating reticle has the third windage offset distance configured to be greater than the fourth windage offset distance, and the windage offset distances are a function of or are determined by the projectile's right hand stabilizing spin or a rifle barrel's rifling right-twist direction, thus compensating for said projectile's Dissimilar Wind Drift.

Broadly speaking, the ballistic effect compensating reticle system (e.g., 200, 300 or 700) has an aim point field configured to predict a COI and compensate for the selected projectile's ballistic behavior while developing a field expedient firing solution or Hold Point expressed two-dimensional terms of: (a) range or distance, used to orient a field expedient aim point vertically among the secondary aiming marks in said vertical array, and (b) windage or relative velocity, used to orient said aim point laterally among a selected array of windage hold points.

The ballistic effect aim compensation method for use when firing a selected projectile from a selected rifle or projectile weapon (e.g., 4) and developing a field expedient firing solution, comprises: (a) providing a ballistic effect compensating reticle system (e.g., 200 or 300) comprising a multiple point elevation and windage aim point field (e.g., 150 or 350) including a primary aiming mark intersecting a nearly vertical array of secondary aiming marks spaced along a curving, nearly vertical axis, the secondary aiming points positioned to compensate for ballistic drop at preselected regular incremental ranges beyond the first selected range for the selected projectile having pre-defined ballistic characteristics; and said aim point field also including a first array of windage aiming marks spaced apart along a secondary non-horizontal axis intersecting a first selected secondary aiming point; wherein said first array of windage aiming marks define a sloped row of windage aiming points having a slope which is a function of the direction and velocity of said projectile's stabilizing spin or a rifle barrel's rifling twist rate and direction, thus compensating for said projectile's crosswind jump; (b) based on at least the selected projectile, identifying said projectile's associated nominal Air Density ballistic characteristics; (c) determining a range to a target, based on the range to the target and the nominal air density ballistic characteristics of the selected projectile, determining a yardage equivalent aiming adjustment for the projectile weapon; (d) determining a windage hold point, based on any crosswind sensed or perceived, and (e) aiming the rifle or projectile weapon using said yardage equivalent aiming adjustment for elevation hold-off and said windage hold point.

The ballistic effect aim compensation method of the present invention includes providing ballistic compensation information as a function of and indexed according to an atmospheric condition such as density altitude for presentation to a user of a firearm, and then associating said ballistic compensation information with a firearm scope reticle feature to enable a user to compensate for existing density altitude levels to select one or more aiming points displayed on the firearm scope reticle (e.g., 200, 300 or 700). The ballistic compensation information is preferably encoded into markings (e.g., indicia array 750) disposed on the reticle of the scope via an encoding scheme, and the ballistic compensation information is preferably graphed, or tabulated into markings disposed on the reticle of the scope. In the illustrated embodiments, the ballistic compensation information comprises density altitude determination data and a ballistic correction chart indexed by density altitude.

The ballistic effect aim compensation system to adjust the point of aim of a projectile firing weapon or instrument firing a selected projectile under varying atmospheric and wind conditions (e.g. with a reticle such as 200, 300 or 700) includes a plurality of predicted COIs or aiming points configured or disposed upon said reticle, said plurality of aiming points positioned for proper aim at various predetermined range-distances and wind conditions and including at least a first array of windage aiming marks spaced apart along a non-horizontal axis (e.g., array 360-0 for 800 yards), wherein said first array of windage aiming marks define a sloped row of windage aiming points having a slope which is a function of the direction and velocity of the selected projectile's stabilizing spin or a rifle barrel's rifling twist rate and direction, thus compensating for said selected projectile's crosswind jump; and where all of said predetermined range-distances and wind conditions are based upon a baseline atmospheric condition.

The aim compensation system (e.g. with a reticle such as 200, 300 or 700) preferably includes a means for determining existing density altitude characteristics (such as DA graph 550 or 780) either disposed on the reticle or external to the reticle (e.g., such as Kestrel™ transportable weather meter); and also includes ballistic compensation information indexed by density altitude criteria configured to be provided to a user or marksman such that the user can compensate or adjust an aim point to account for an atmospheric difference between the baseline atmospheric condition and an actual atmospheric condition; wherein the ballistic compensation information is based on and indexed according to density altitude to characterize the actual atmospheric condition.

Preferably, the ballistic compensation information is encoded into the plurality of aiming points disposed upon the reticle, as in the embodiments illustrated FIGS. 7 and 8 or FIGS. 17 and 18. Preferably, the reticle also includes ballistic compensation indicia disposed upon the reticle and ballistic compensation information is encoded into the indicia (as shown in FIGS. 8 and 18), or alternatively, the ballistic compensation information can be positioned external to the reticle, on transportable placards such as placard 600. The ballistic compensation information may also be encoded into the plurality of aiming points disposed upon said reticle (e.g., such as Correction Drop Pointers 510, 512), where the encoding is done via display of an density correction encoding scheme that comprises an array of range-specific density correction pointers being displayed on the reticle at selected ranges.

Figure 20:
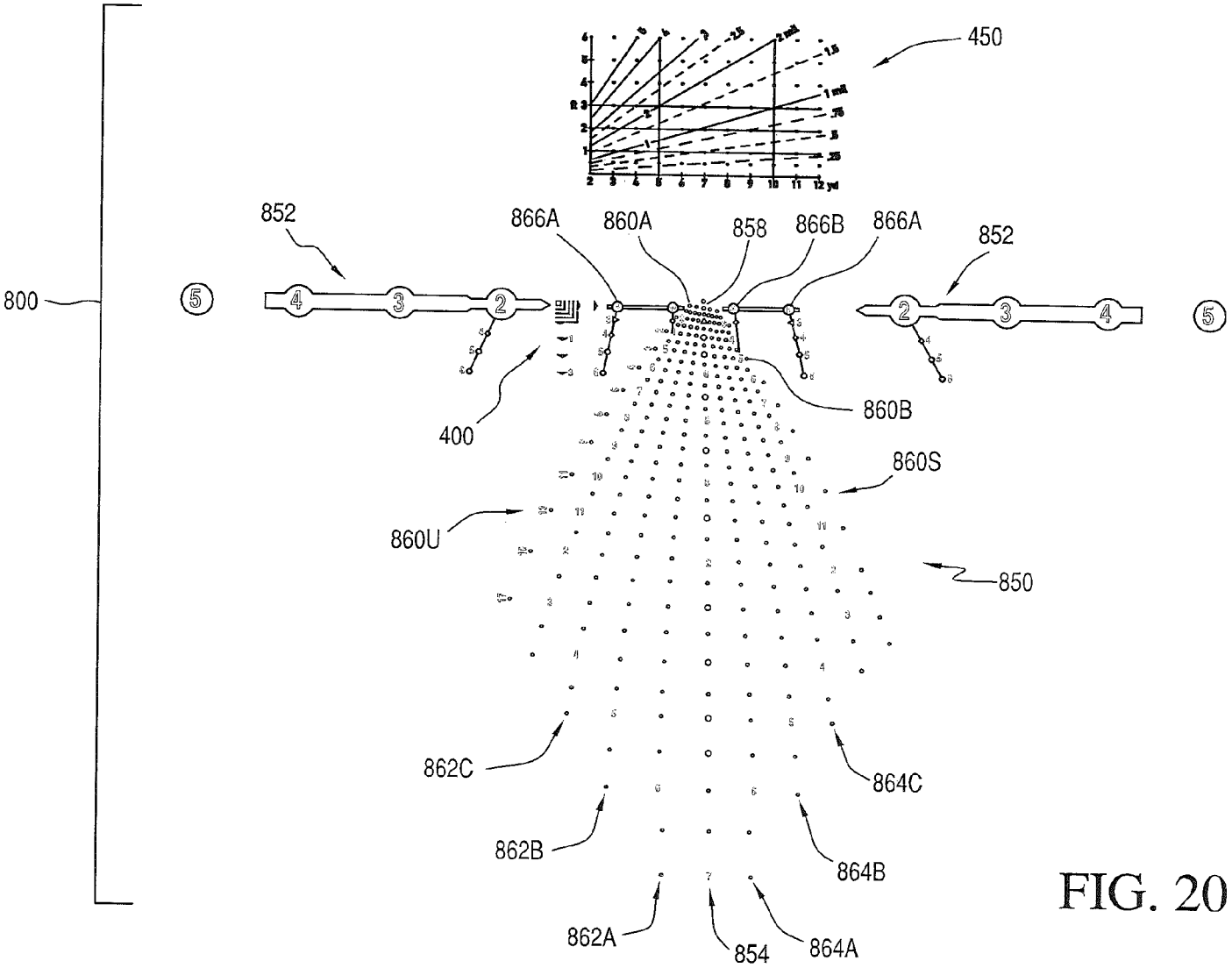
FIG. 20 illustrates enlarged detail for a new embodiment of the aim point field and horizontal crosshair aiming indicia array for use with the ballistic effect compensating system of the present invention.

Turning now to FIG. 20, another embodiment for a reticle 800 has an aim point field 850 and horizontal crosshair aiming indicia array 852 is configured for use when engaging targets travelling at higher speeds.

FIG. 20 illustrates a multi-nomograph reticle 800 and provides a detailed view of an exemplary elevation and windage aim point field 850, with the accompanying horizontal and vertical angular measurement stadia 400 included proximate the horizontal crosshair aiming indicia array 852. The aim point field 850 is preferably incorporated in an adjustable scope reticle screen (e.g., such as 16), as the marksman uses the aim point field 850 for aiming at the target as viewed through the scope and its reticle. The aim point field 850 comprises at least the first horizontal line or crosshair 852 and a substantially vertical central aiming dot line or crosshair 854, which in the case of the field 850 is represented by a line of substantially or nearly vertical dots. An optional true vertical reference line (not shown) on the aim point field 850 may optionally comprise a vertical crosshair depending perpendicularly from horizontal array 852 from central aim point 858, if so desired. As noted above, the array 850 of aiming indicia illustrate the predicted Center of Impact (or "COI") for a user's projectile and the user expresses the aimed Hold Point or firing solution solely in dimensions of distance (e.g., in yards) and velocity (e.g., in mph).

It will be noted that the substantially or nearly vertical central aiming dot line or axis 854 is curved or skewed somewhat to the right of the true vertical reference line (not shown). As above, this deflection of the "no wind" indicia axis 854 is to compensate for gyroscopic precession or "spin drift" of a spin-stabilized bullet or projectile in its trajectory. The exemplary (e.g., M24, M40 or M110) variant rifle barrels have "right twist" inwardly projecting rifling which spirals to the right, or clockwise, from the proximal chamber to the distal muzzle of the barrel. The rifling imparts a corresponding clockwise gyroscopically stabilizing spin to the standard M118LR 175 Grain Sierra Match King ("SMK") bullet (not shown). As noted above, the flying bullet's clockwise spin results in gyroscopic precession which generates a force that is transverse or normal (i.e., ninety degrees) to the arcuate trajectory, causing the bullet to deflect to the right. This effect is seen most clearly at relatively long ranges, where there is substantial arc to the trajectory of the bullet (e.g., as illustrated in FIG. 1E). The lateral offset or skewing of substantially vertical central aiming dot line to the right causes the user, shooter or marksman to aim or moving the alignment slightly to the left in order to position one of the aiming dots of the central line 854 on the target (assuming no windage correction). This has the effect of more nearly correcting for the rightward deflection of the bullet due to gyroscopic precession.

FIG. 20 also illustrates that horizontal crosshair aiming mark indicia array 852 and substantially vertical central aiming dot line 854 define the single central aim point 858 at their intersection. The multiple aim point field 850, as shown, is formed of a series of sloped and non-horizontal secondary rows of windage aiming indicia which are not parallel to horizontal crosshair array 852 (e.g., 860A, 860B, etc.) The secondary row aiming indicia are laterally spaced at intervals to provide aim points corresponding to selected crosswind velocities (e.g., 5 mph, 10 mph, 15 mph and 20 mph). The windage aiming indicia for each selected crosswind velocity are aligned along axes which are inwardly angled but generally vertical (spreading as they descend) to provide left side columns 862A, 862B, 862C, etc. and right side columns 864A, 864B, 864C, etc. The left side columns and right side columns comprise aiming indicia or aiming dots (which may be small circles or other shapes, in order to minimize the obscuration of the target). It will be noted that the uppermost horizontal row above 860A actually comprises only a single dot each, and provides a relatively close aiming point (e.g., for close-in zeroing, at one hundred yards). The aim point field 850 is configured for a rifle and scope system (e.g., 4) which has been "zeroed" (i.e., adjusted to exactly compensate for the drop of the bullet during its flight) at aim point 858, corresponding to a selected distance (e.g., two hundred yards), as evidenced by the primary horizontal crosshair array 852. Thus, a marksman aiming at a closer target must lower his aim to place his Hold Point slightly above the horizontal crosshair 852 (e.g., above 860A), as relatively little drop occurs to the bullet in such a relatively short flight.

In FIG. 20, most of the horizontal rows, (e.g. rows 860B) are numbered to indicate the range in selected range or distance increments (e.g., multiples of hundreds of yards) for an accurate shot using the indicia or dots of that particular row, designating ranges of e.g., 500 yards. The row 860S has a mark "10" to indicate a range of one thousand yards. It will be noted that the spacing between each horizontal row gradually increases as the range to the target becomes longer and longer. This is due to the slowing of the bullet and increase in vertical speed due to the acceleration of gravity during its flight. The alignment and spacing of the horizontal rows more effectively compensates for these factors, such that the COI and particularly the vertical impact point of the bullet will be more accurately predicted at any selected range. After a selected row (e.g., 860U, for 1100 yards), the rows may be numbered differently, as a visual reminder that beyond 1100 Yards, it is estimated that the M118LR projectile has slowed into the transonic or subsonic speed range, where accuracy is likely to diminish in an unpredictable manner.

The nearly vertical columns 862A, 8628, 864A, 8648, etc., spread as they extend downwardly to greater and greater ranges, but not symmetrically, due to the external ballistics factors including Crosswind Jump and Dissimilar Crosswind Drift, as discussed above. These nearly vertical columns define aligned angled columns or axes of aim points configured to provide an aiming aid permitting the shooter to compensate for windage, i.e. the lateral drift of a bullet due to any crosswind component. As noted above, downrange crosswinds will have an ever greater effect upon the path of a bullet with longer ranges. Accordingly, the vertical columns spread wider, laterally, at greater ranges or distances, with the two inner columns 862A and 864A being closest to the column of central aiming dots 854 and being spaced to provide correction for a five mile per hour crosswind component, the next two adjacent columns 862B, 8648 providing correction for a ten mile per hour crosswind component, etc.

As noted above, when shooting at a moving target, the Hold Point must be corrected to provide with a "lead," somewhat analogous to the lateral correction required for windage. Thus reticle 800 has approximate lead indicators 866B (for slower walking speed, indicated by the "W") and 866A (farther from the central aim point 858 for running targets, indicated by the "R"). These lead indicators 866A and 866B are approximate, with the exact lead depending upon the velocity component of the target normal to the bullet trajectory and the distance of the target from the shooter's position. Higher estimated speeds require larger leads, and so horizontal array 852 also includes laterally spaced mirror-image indicia with "2" indicating the estimated lead for a target travelling at 20 mph, "3" indicating the estimated lead for a target travelling at 30 mph, "4" indicating the estimated lead for a target travelling at 40 mph, and "5" indicating the estimated lead for a target travelling at 50 mph.

As above, in order to use the elevation and windage aim point field 850 of FIG. 20, the marksman must have a reasonably close estimate or measurement of the range to the target. An estimate is provided by means of the evenly spaced horizontal and vertical angular measurement stadia 400 disposed upon aim point field 850. Any system for defining relatively small angles may be used, so long as the same system is used consistently for both the stadia 400 and the distance v. angular measurement nomograph 450.

Additional alternative embodiments of the reticle and system of the present invention provide windage offsets which can be defined and communicated using standard angular dimensions such as milliradians ("MILS") or minutes of Angle ("MOA"), as illustrated in FIGS. 21-24. The Mil-MOA DTR reticles shown in FIGS. 21-24 are for users have been trained to adjust the windage component of aim in Mils or MOA, and include a plurality of crosswind-jump compensated MIL or MOA spaced indicia defined in nearly horizontal, sloped wind-dot arrays spaced vertically apart for designated range increments. FIGS. 21-24 illustrate in enlarged detail the four alternative reticle embodiments of aim point fields with MIL or MOA aiming indicia arrays for use with the ballistic effect compensating system of the present invention.

Figure 21:
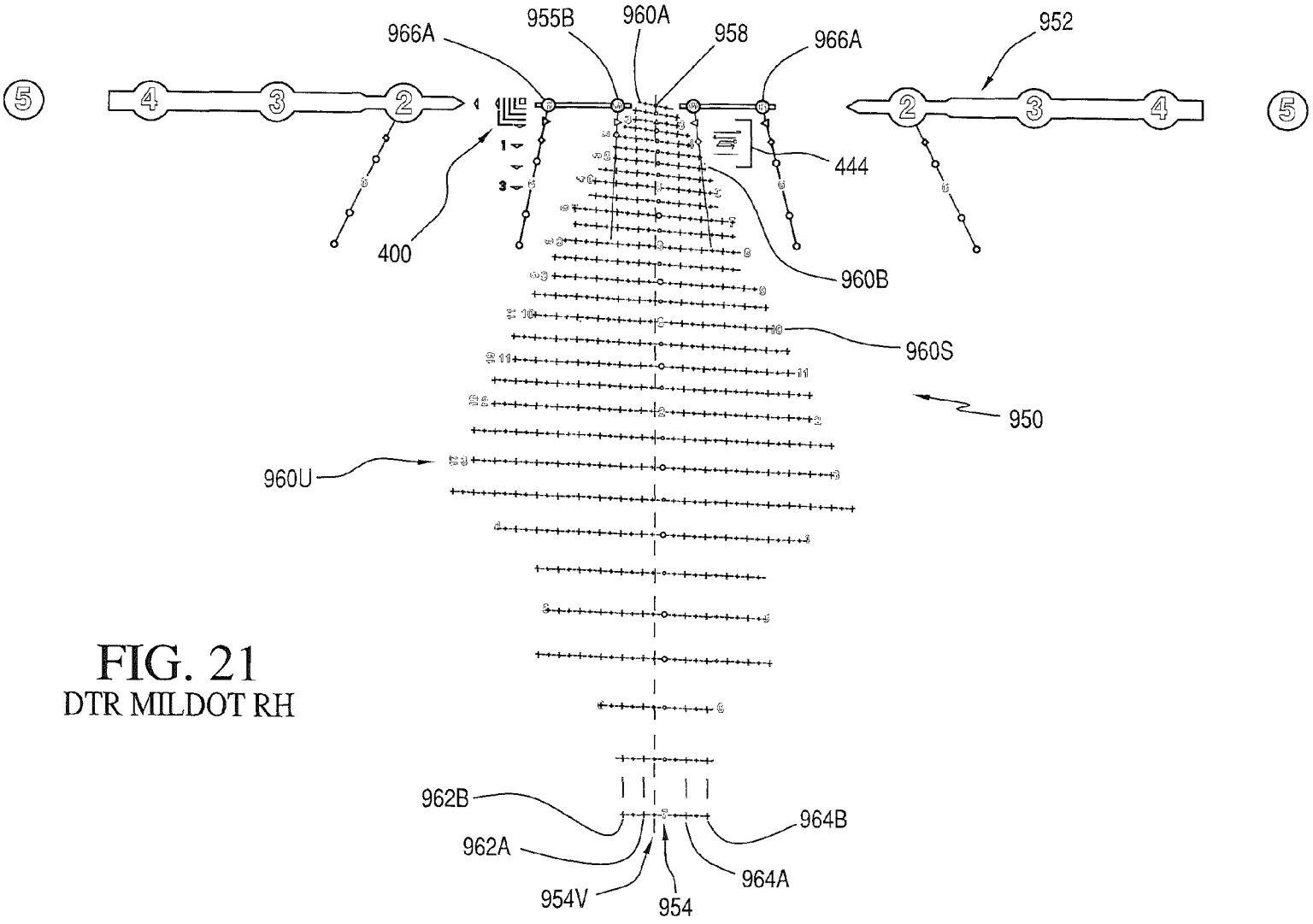
FIG. 21 illustrates a reticle aimpoint field 950 called a DTR Mil RH array, meaning the windage indicia or "dots" are spaced in increments of mils, and the spin-drift and crosswind jump compensations are configured for use with a spinning projectile stabilized by rifling having a right hand twist, in accordance with the present invention.

FIG. 21 illustrates a reticle aimpoint field 950 called a DTR Mil RH array, meaning the windage indicia or "dots" are spaced in increments of mils, and the spin-drift and crosswind jump compensations are configured for use with a spinning projectile stabilized by rifling having a right hand twist.

Figure 22:
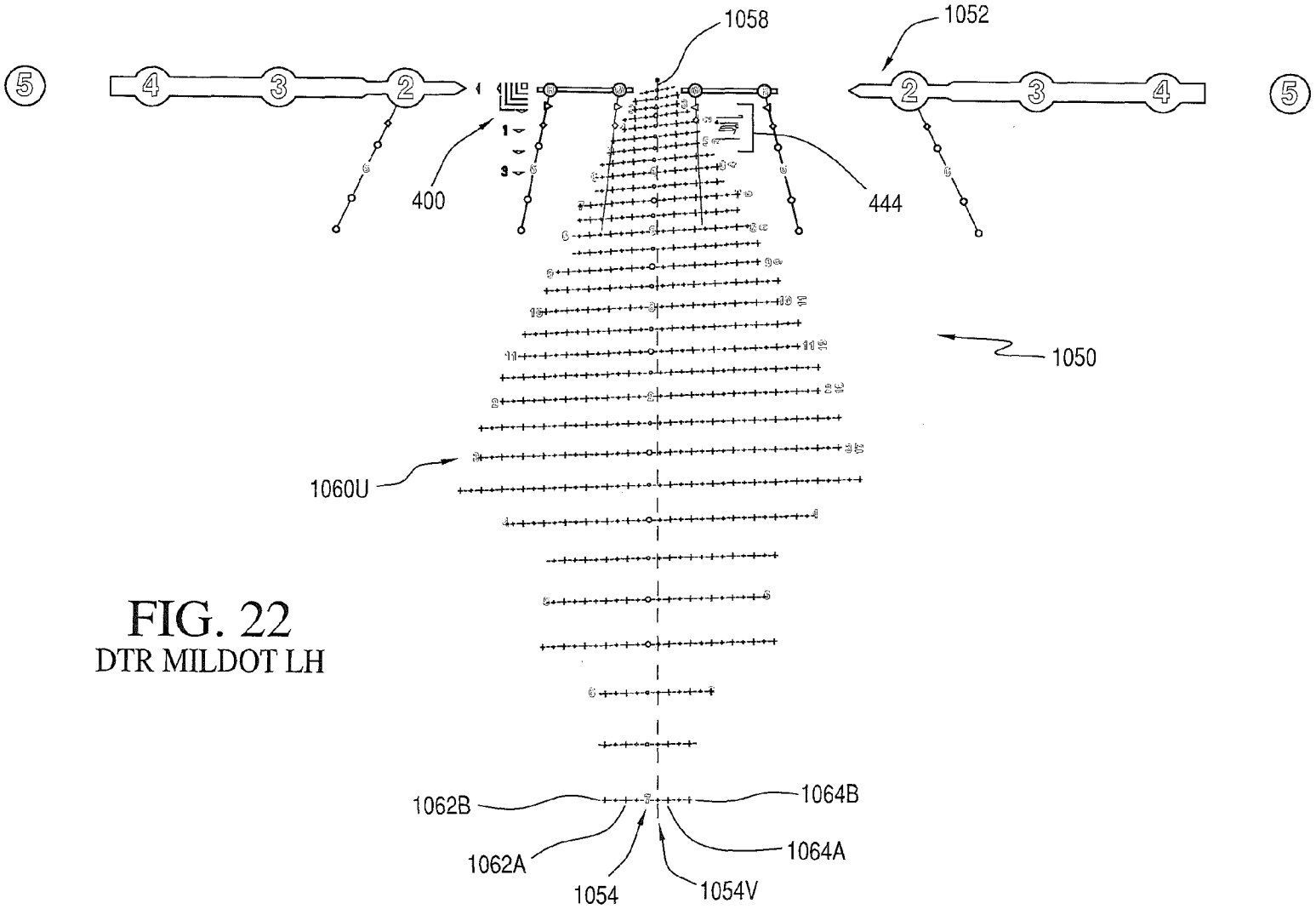
FIG. 22 illustrates a reticle aimpoint field 1050 called a DTR Mil LH array, meaning the windage indicia or "dots" are spaced in increments of mils, and the spin-drift and crosswind jump compensations are configured for use with a spinning projectile stabilized by rifling having a left hand twist, in accordance with the present invention.

FIG. 22 illustrates a reticle aimpoint field 1050 called a DTR Mil LH array, meaning the windage indicia or "dots" are spaced in increments of mils, and the spin-drift and crosswind jump compensations are configured for use with a spinning projectile stabilized by rifling having a left hand twist.

Figure 23:
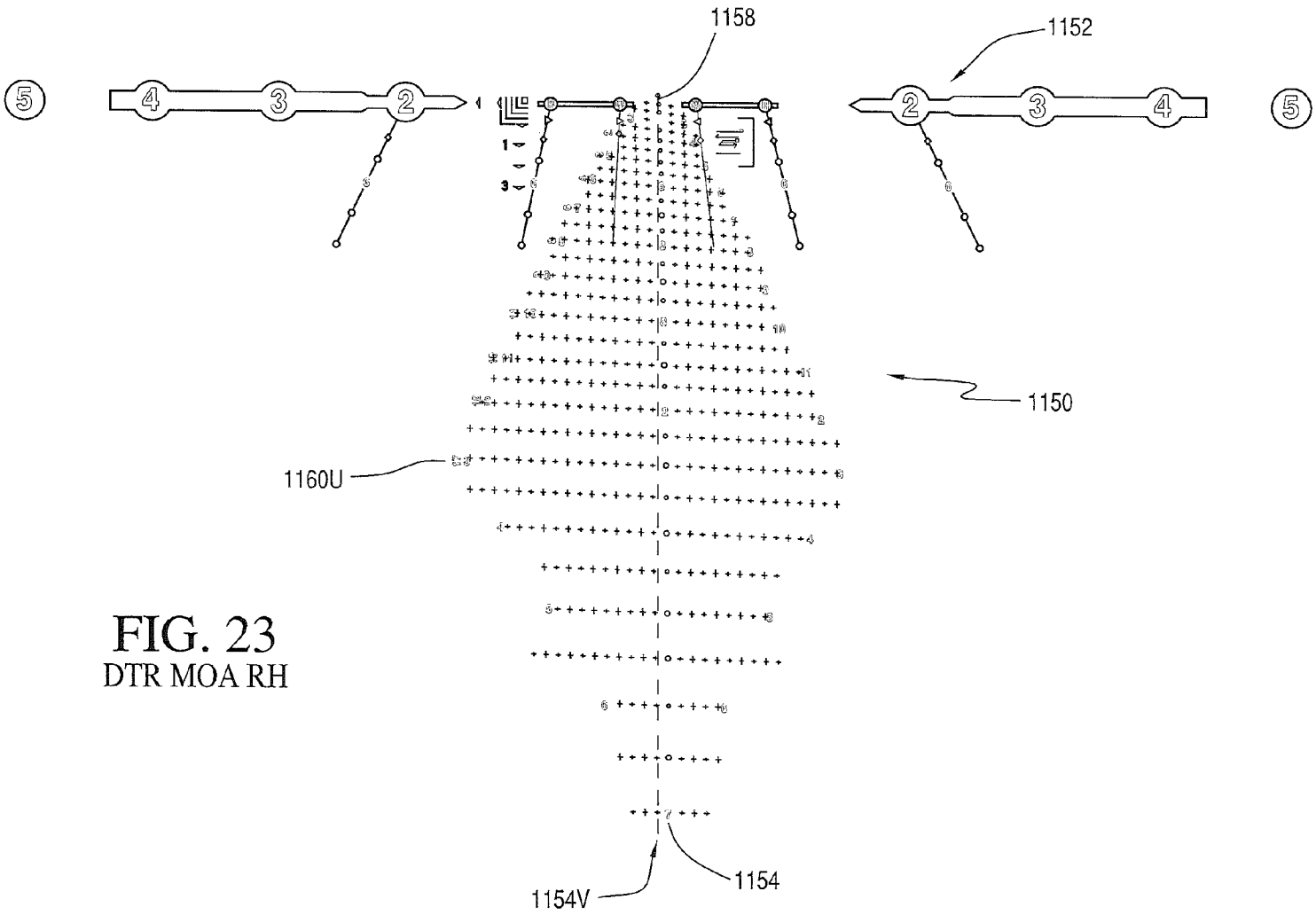
FIG. 23 illustrates a reticle aimpoint field 1150 called a DTR MOA RH array, meaning the windage indicia or "dots" are spaced in increments of Minutes of Angle (MOA), and the spin-drift and crosswind jump compensations are configured for use with a spinning projectile stabilized by rifling having a right hand twist, in accordance with the present invention.

FIG. 23 illustrates a reticle aimpoint field 1150 called a DTR MOA RH array, meaning the windage indicia or "dots" are spaced in increments of Minutes of Angle (MOA), and the spin-drift and crosswind jump compensations are configured for use with a spinning projectile stabilized by rifling having a right hand twist.

Figure 24:
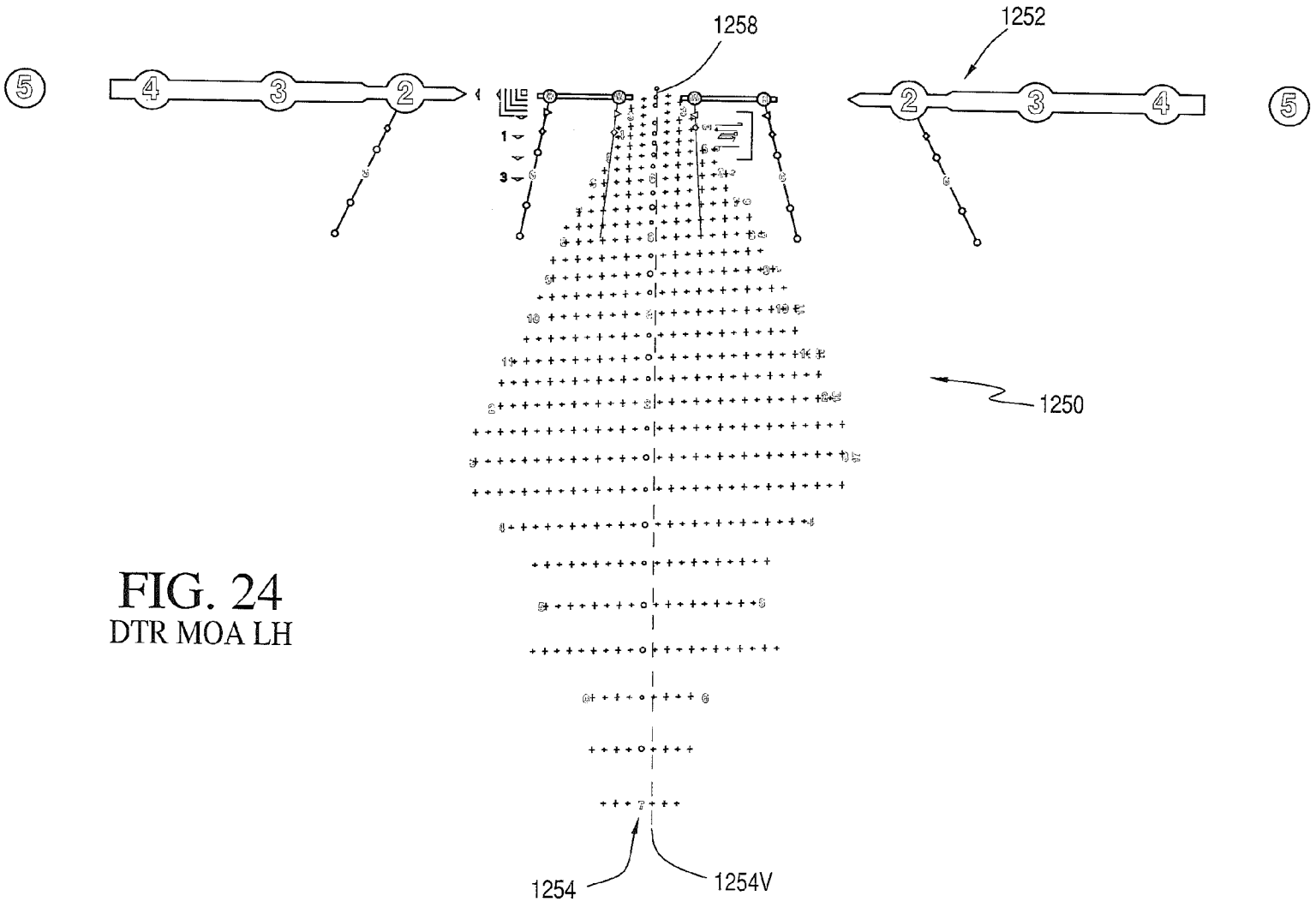
FIG. 24 illustrates a reticle aimpoint field 1250 called a DTR MOA LH array, meaning the windage indicia or "dots" are spaced in increments of Minutes of Angle (MOA), and the spin-drift and crosswind jump compensations are configured for use with a spinning projectile stabilized by rifling having a left hand twist, in accordance with the present invention.

FIG. 24 illustrates a reticle aimpoint field 1250 called a DTR MOA LH array, meaning the windage indicia or "dots" are spaced in increments of Minutes of Angle (MOA), and the spin-drift and crosswind jump compensations are configured for use with a spinning projectile stabilized by rifling having a left hand twist.

Returning to FIG. 21, Right Hand DTR MIL reticle aimpoint field 950 has windage indicia or "dots" are spaced in increments of milliradians, and the spin-drift and crosswind jump compensations are configured for use with a spinning projectile stabilized by rifling having a right hand twist, and is preferably incorporated in a multi-nomograph reticle with the accompanying horizontal and vertical angular measurement stadia 400 included proximate the horizontal crosshair aiming indicia array 952. The aim point field 950 is preferably incorporated in an adjustable scope reticle screen (e.g., such as 16), as the marksman uses the aim point field 950 for aiming at the target as viewed through the scope and its reticle. The aim point field 950 comprises at least the first horizontal line or crosshair 952 and a substantially vertical central aiming dot line or crosshair 954, which in the case of the field 950 is represented by a line of substantially or nearly vertical dots. An optional true vertical reference line 954V on the aim point field 950 may optionally comprise a vertical crosshair depending perpendicularly from horizontal array 952 from central aim point 958, if so desired. As noted above, the array 950 of aiming indicia illustrate the predicted Center of Impact (or "COI") for a user's projectile and the user expresses the aimed Hold Point or firing solution solely in dimensions of distance (e.g., in yards) and angular windage azimuth offset (e.g., in fractions of a milliradian.

It will be noted that the substantially or nearly vertical central aiming dot line or axis 954 is curved or skewed somewhat to the right of the true vertical reference line 954V. As above, this deflection of the "no wind" indicia axis 954 is to compensate for gyroscopic precession or "spin drift" of a spin-stabilized bullet or projectile in its trajectory. The exemplary (e.g., M24, M40 or M110) variant rifle barrels have "right twist" inwardly projecting rifling which spirals to the right, or clockwise, from the proximal chamber to the distal muzzle of the barrel. The rifling imparts a corresponding clockwise gyroscopically stabilizing spin to the standard M118LR 175 Grain Sierra Match King ("SMK") bullet (not shown). As noted above, the flying bullet's clockwise spin results in gyroscopic precession which generates a force that is transverse or normal (i.e., ninety degrees) to the arcuate trajectory, causing the bullet to deflect to the right. This effect is seen most clearly at relatively long ranges, where there is substantial arc to the trajectory of the bullet (e.g., as illustrated in FIG. 1E). The lateral offset or skewing of substantially vertical central aiming dot line to the right causes the user, shooter or marksman to aim or moving the alignment slightly to the left in order to position one of the aiming dots of the central line 954 on the target (assuming no windage correction). This has the effect of more nearly correcting for the rightward deflection of the bullet due to gyroscopic precession.

FIG. 21 also illustrates that horizontal crosshair aiming mark indicia array 952 and substantially vertical central aiming dot line 954 define the single central aim point 958 at their intersection. The multiple aim point field 950, as shown, is formed of a series of sloped and non-horizontal secondary rows of windage aiming indicia which are not parallel to horizontal crosshair array 952 (e.g., 960A, 960B, etc.) The secondary row aiming indicia are laterally spaced at intervals to provide aim points corresponding to selected windage or azimuth angular offsets. The windage aiming indicia for each selected crosswind velocity are aligned vertically to provide spin-drift corrected left side columns 962A, 9628, and spin-drift corrected right side columns 964A, 964B, etc. The left side columns and right side columns comprise aiming indicia or aiming dots (which may be small circles or other shapes, in order to minimize the obscuration of the target). It will be noted that the uppermost horizontal row above 960A actually comprises only a single dot, and provides a relatively close aiming point (e.g., for close-in zeroing, at one hundred yards). The aim point field 950 is configured for a rifle and scope system (e.g., 4) which has been "zeroed" (i.e., adjusted to exactly compensate for the drop of the bullet during its flight) at aim point 958, corresponding to a selected "zero" distance (e.g., two hundred yards), as evidenced by the primary horizontal crosshair array 952. Thus, a marksman aiming at a closer target must lower his aim to place his Hold Point slightly above the horizontal crosshair 952 (e.g., above 960A), as relatively little drop occurs to the bullet in such a relatively short flight.

In FIG. 21, most of the horizontal rows, (e.g. row 960B) are numbered to indicate the range in multiples of hundreds of yards for an accurate shot using the indicia or dots of that particular row, designating ranges of e.g., 500 yards. The row 960S has a mark "10" to indicate a range of one thousand yards. It will be noted that the spacing between each horizontal row gradually increases as the range to the target becomes longer and longer. This is due to the slowing of the bullet and increase in vertical speed due to the acceleration of gravity during its flight. The alignment and spacing of the horizontal rows more effectively compensates for these factors, such that the COI and particularly the vertical impact point of the bullet will be more accurately predicted at any selected range. After a selected row (e.g., 960U, for 1300 yards), the rows may be numbered differently, as a visual reminder that beyond 1300 Yards, it is estimated that the selected projectile has slowed into the transonic or subsonic speed range, where accuracy is likely to diminish in an unpredictable manner.

The vertical columns 962A, 962B, 964A, 964B, extend downwardly to greater and greater ranges, but are not configured to account for external ballistics factors including Crosswind Jump and Dissimilar Crosswind Drift, as discussed above. These vertical columns define aligned columns or axes of aim points configured to provide aiming aids permitting the shooter to compensate for windage, i.e. the lateral drift of a bullet due to any crosswind component at a selected range.

As noted above, when shooting at a moving target, the Hold Point must be corrected to provide with a "lead," somewhat analogous to the lateral correction required for windage. Thus aimpoint field 950 has approximate lead indicators 966B (for slower walking speed, indicated by the "W") and 966A (farther from the central aim point 858 for running targets, indicated by the "R"). These lead indicators 966A and 966B are approximate, with the exact lead depending upon the velocity component of the target normal to the bullet trajectory and the distance of the target from the shooter's position. Higher estimated speeds require larger leads, and so horizontal array 952 also includes laterally spaced mirror-image indicia with "2" indicating the estimated lead for a target travelling at 20 mph, "3" indicating the estimated lead for a target travelling at 30 mph, "4" indicating the estimated lead for a target travelling at 40 mph, and "5" indicating the estimated lead for a target travelling at 50 mph.

As above, in order to use the elevation and windage aim point field 950 of FIG. 10, the marksman must have a reasonably close estimate or measurement of the range to the target. An estimate is provided by means of the evenly spaced horizontal and vertical angular measurement stadia 400 disposed upon aim point field 950. Any system for defining relatively small angles may be used, so long as the same system is used consistently for both the stadia 400 and the distance v. angular measurement nomograph (e.g., 450). A one foot range finder nomograph 444 is configured with a selected plurality of spaced, substantially parallel line segments to estimate the range to a target adjacent object of known size (e.g., one foot tall or wide). Orientation, spacing and use of one foot range finder nomograph 444 in the method of the present invention are described above.

It will be appreciated by persons having skill in the art that the present invention provides a ballistic effect compensating reticle for rifle sights or projectile weapon aiming systems adapted to provide a field expedient firing solution for a baseline ammunition with a selected projectile when fired in a pre-defined baseline set of atmospheric conditions, comprising:

(a) a multiple point elevation and windage aim point field (e.g., 950, 1050, 1150 or 1250) including a primary aiming mark (e.g., 958, 1058, 1158 or 1258) positioned within a first horizontal array (e.g., 952, 1052, 1152 or 1252) and indicating a primary aiming point adapted to be sighted-in at a first selected range (e.g., 200 yards);

(b) the aim point field 950 a first sloped array of windage aiming marks 960A including the primary aiming mark 958;

(c) the aim point field 950 also includes a nearly vertical array of secondary aiming marks 954 spaced at progressively increasing incremental distances below the primary aiming point 958 and indicating corresponding secondary elevation aiming points along a curving, nearly vertical axis intersecting the primary aiming mark, where the secondary elevation aiming points are positioned to compensate for ballistic drop at preselected regular incremental ranges beyond the first selected range for the selected projectile having pre-defined ballistic characteristics;

(d) the aim point field also includes a second array 960B of windage aiming marks spaced apart along a secondary non-horizontal axis intersecting a first selected secondary elevation aiming point;

(e) the second array of windage aiming marks 960B includes a first windage aiming mark spaced apart to the left of the vertical reference axis 954V at a first windage offset or angular azimuth lateral distance (e.g., a fraction of a MIL or MOA) from the curving nearly vertical axis selected to compensate for right-to-left crosswind at the range of the first selected secondary elevation aiming point, and a second windage aiming mark spaced apart to the right of the vertical axis at the first windage offset or angular azimuth lateral distance (e.g., a fraction of a MIL or MOA) from the curving nearly vertical axis 954 selected to compensate for left-to-right crosswind at said range of said first selected secondary elevation aiming point;

(f) the first array of windage aiming marks 960A and the second array of windage aiming marks 960B each define a sloped row of windage aiming points having a slope which is a function of the direction and velocity of the projectile's stabilizing spin or a rifle barrel's rifling twist rate and direction, thus compensating for the projectile's crosswind jump at a selected range; and (g) the secondary elevation aiming points are configured with elevation indicia expressed in terms of range to a target where the windage aiming marks are configured for use with the pre-defined baseline set of atmospheric conditions.

The ballistic effect compensating reticle's first array of windage aiming marks 960A can define a sloped row of windage aiming points having a negative slope which is a function of the right-hand spin direction for the projectile's stabilizing spin or a rifle barrel's right-hand twist rifling, thus compensating for the projectile's crosswind jump.

The ballistic effect compensating reticle's secondary elevation aiming point can intersect a secondary array of windage aiming marks defining a sloped row of windage aiming points having a slope which is a function of the direction and velocity of the projectile's stabilizing spin or a rifle barrel's rifling twist rate and direction, and the sloped row of windage aiming points are spaced for facilitating aiming compensation for ballistics and windage for two or more preselected angular azimuth offsets (e.g., a fraction of a MIL or MOA), at the range of the corresponding secondary elevation aiming point. Preferably, at least one of the sloped rows of windage aiming points intersecting the nearly vertical array of secondary aiming marks is bounded by laterally spaced distance indicators (e.g. "3", "4", "5", "6". . . ) corresponding to a range or distance to a target (e.g. 300 yds, 400 yds, 500 yds, 600 yds . . . ).

Preferably, at least one of the laterally spaced distance indicators are proximate a range call adjustment indicator selected to provide a range call adjustment used to adjust the aiming elevation by selecting another secondary elevation aiming point when the user determines that extant atmospheric conditions vary from the pre-defined baseline set of atmospheric conditions. The range call adjustment indicator can be a Density Altitude (DA) or Density Unit (DU) correction indicator, and may be selected to provide a range call adjustment used to adjust the aiming elevation when the user determines that substitute ammunition varying from the baseline ammunition will be used.

The Mil-MOA DTR reticle's horizontal crosshair array 952 includes indicia positioned at a plurality of selected azimuth offsets for a plurality of estimated vehicle velocities and are preferably positioned at selected azimuth offsets for estimated vehicle velocities including 10 mph, 20 mph and 30 mph.

The ballistic effect aim compensation method for use when firing a selected projectile from a selected rifle or projectile weapon (e.g., 10) and developing a field expedient firing solution comprises:

(a) providing a ballistic effect compensating reticle comprising a multiple point elevation and windage aim point field (e.g., 950, 1050, 1150 or 1250) including a primary aiming mark (e.g., 958, 1058, 1158 or 1258) intersecting a nearly vertical array (e.g., 954, 1054, 1154 or 1254) of secondary aiming marks spaced along a curving, nearly vertical axis, the secondary aiming points positioned to compensate for ballistic drop at preselected regular incremental ranges beyond the first selected range for the selected projectile having pre-defined ballistic characteristics; and said aim point field also including a first array of windage aiming marks spaced apart along a secondary non-horizontal axis intersecting a first selected secondary aiming point; wherein said first array of windage aiming marks define a sloped row of windage aiming points having a slope which is a function of the direction and velocity of said projectile's stabilizing spin or a rifle barrel's rifling twist rate and direction, thus compensating for said projectile's crosswind jump;

(b) based on at least the selected projectile, identifying said projectile's associated nominal Air Density ballistic characteristics;

(c) determining a range to a target, based on the range to the target and the nominal air density ballistic characteristics of the selected projectile, determining a selected distance unit (e.g., yardage) equivalent aiming adjustment for the projectile weapon;

(d) determining a windage hold point expressed as an angular azimuth (e.g., a fraction of a MIL or MOA), based on target motion or any crosswind sensed or perceived, and (e) aiming the rifle or projectile weapon using said yardage equivalent aiming adjustment for elevation hold-off and said windage hold point.

The ballistic effect aim compensation method step (b) preferably comprises: providing ballistic compensation information as a function of and indexed according to density altitude for presentation to a user of a firearm, and associating said ballistic compensation information with a firearm scope reticle feature to enable a user to compensate for existing density altitude levels to select one or more aiming points displayed on the firearm scope reticle (e.g., proximate a selected aim point field 950, 1050, 1150 or 1250, or as described above).

The ballistic compensation information is encoded into markings disposed on the reticle of the scope via an encoding scheme and is graphed, or tabulated into markings disposed on the reticle of the scope 10. The ballistic compensation information preferably comprises density altitude determination data and a ballistic correction chart indexed by density altitude.

The foregoing describes preferred embodiments of reticles and methods, and it is believed that other modifications, variations and changes will be suggested to those skilled in the art in view of the teachings set forth herein. It is therefore to be understood that all such variations, modifications and changes are believed to fall within the scope of the present invention as set forth in the following claims.

I claim:

1. A ballistic effect compensating reticle for rifle sights or projectile weapon aiming systems adapted to provide a field expedient firing solution for a baseline ammunition with a selected projectile having pre-defined ballistic characteristics when fired in a pre-defined baseline set of atmospheric conditions, comprising:

(a) a multiple point elevation and windage aim point field including a primary aiming mark positioned within a first horizontal crosshair aiming indicia array and indicating a primary aiming point adapted to be sighted-in at a first selected range;

(b) said aim point field further comprising a first sloped array of windage aiming marks including said primary aiming mark;

(c) said aim point field also including a nearly vertical array of secondary aiming marks spaced at progressively increasing incremental distances below the primary aiming point and indicating corresponding secondary elevation aiming points along a curving, nearly vertical axis intersecting the primary aiming mark, the secondary elevation aiming marks positioned to compensate for ballistic drop at preselected regular incremental ranges beyond the first selected range for the selected projectile having pre-defined ballistic characteristics;

(d) said aim point field also including a second array of windage aiming marks spaced apart along a secondary non-horizontal axis intersecting a first selected secondary elevation aiming point;

(e) wherein said second array of windage aiming marks includes a first windage aiming mark spaced apart to the left of said nearly vertical array of secondary aiming marks at a first windage offset or angular azimuth lateral distance from the curving nearly vertical axis selected to compensate for right-to-left crosswind at the range of said first selected secondary elevation aiming point, and a second windage aiming mark spaced apart to the right of said nearly vertical array of secondary aiming marks at said first windage offset or angular azimuth lateral distance from the curving nearly vertical axis selected to compensate for left-to-right crosswind at said range of said first selected secondary elevation aiming point;

(f) wherein said first sloped array of windage aiming marks and said second array of windage aiming marks each define a sloped row of windage aiming points having a slope which is a function of the direction and velocity of said projectile's stabilizing spin or a rifle barrel's rifling twist rate and direction, thus compensating for said projectile's crosswind jump at a selected range; and (g) wherein said secondary elevation aiming points are configured with elevation indicia expressed in terms of range to a target and wherein the windage aiming marks of said first sloped array of windage aiming marks and said second array of windage aiming marks are configured for use with the pre-defined baseline set of atmospheric conditions.

2. The ballistic effect compensating reticle according to claim 1, wherein said first sloped array of windage aiming marks define a sloped row of windage aiming points having a negative slope which is a function of a right-hand spin direction for said projectile's stabilizing spin or a rifle barrel's right-hand twist rifling, thus compensating for said projectile's crosswind jump.

3. The ballistic effect compensating reticle according to claim 1, wherein each secondary elevation aiming point is intersected by a secondary array of windage aiming marks defining a sloped row of windage aiming points having a slope which is a function of the direction and velocity of said projectile's stabilizing spin or a rifle barrel's rifling twist rate and direction, and wherein said sloped row of windage aiming points are spaced for facilitating aiming compensation for ballistics and windage for two or more preselected angular azimuth offsets, at the range of the corresponding secondary elevation aiming point.

4. The ballistic effect compensating reticle according to claim 1, wherein at least one of the sloped rows of windage aiming points intersecting the nearly vertical array of secondary aiming marks is bounded by laterally spaced distance indicators corresponding to a range or distance to a target.

5. The ballistic effect compensating reticle according to claim 4, wherein at least one of said laterally spaced distance indicators are proximate a range call adjustment indicator selected to provide a range call adjustment used to adjust the aiming elevation by selecting another secondary elevation aiming point when the user determines that extant atmospheric conditions vary from the pre-defined baseline set of atmospheric conditions.

6. The ballistic effect compensating reticle according to claim 5, wherein said range call adjustment indicator is a Density Altitude (DA) correction indicator.

7. The ballistic effect compensating reticle according to claim 6, wherein said Density Altitude (DA) range call adjustment indicator is selected to provide a range call adjustment used to adjust aiming elevation when the user determines that substitute ammunition varying from the baseline ammunition will be used.

8. The ballistic effect compensating reticle according to claim 5, wherein said range call adjustment indicator is a Density Unit (DU) correction indicator.

9. The ballistic effect compensating reticle according to claim 1, wherein said secondary aiming marks' curving, nearly vertical axis is configured with a vertical reference line to indicate a spin drift correction.

10. The ballistic effect compensating reticle according to claim 1, wherein the primary aiming mark is formed by an intersection of the first horizontal crosshair aiming indicia array including a primary horizontal sight line and said nearly vertical array of secondary aiming marks indicating corresponding secondary elevation aiming points along said curving, nearly vertical axis.

11. The ballistic effect compensating reticle according to claim 10, wherein the first horizontal crosshair aiming indicia array includes a widened portion located radially outward from the primary aiming point, the widened portion having an innermost pointed end located proximate said primary aiming point.

12. The ballistic effect compensating reticle according to claim 1, said first horizontal crosshair aiming indicia array further comprising a set of velocity-specific windage aiming marks spaced apart along a primary horizontal sight line to the left and right of the primary aiming point to indicate aiming points for targets moving at selected velocities, at the first selected range.

13. The ballistic effect compensating reticle according to claim 12, wherein said velocity-specific windage aiming marks include a walking velocity and a running velocity.

14. The ballistic effect compensating reticle according to claim 12, wherein said velocity-specific windage aiming marks include indicia positioned at a selected azimuth offset for a plurality of estimated vehicle velocities.

15. The ballistic effect compensating reticle according to claim 12, wherein said velocity-specific windage aiming marks include indicia positioned at a selected azimuth offset for a plurality of estimated vehicle velocities including 10 mph, 20 mph and 30 mph.

* * * * *